US006072967A

United States Patent [19]

Sugihara et al.

[11] Patent Number: 6,072,967

[45] Date of Patent: Jun. 6, 2000

[54] PC DRUM INTEGRATED REVOLVING TYPE DEVELOPING UNIT WITH PULL-OUT SUPPORTER

[75] Inventors: Kazuyuki Sugihara; Tomoji Ishikawa, both of Yokohama; Yoshiyuki Kimura, Tokyo; Kenji Maeda, Isehara, all of Japan

[73] Assignee: Ricoh Company, Ltd., Tokyo, Japan

[21] Appl. No.: 09/366,802

[22] Filed: Aug. 4, 1999

Related U.S. Application Data

[63] Continuation of application No. 09/093,092, Jun. 8, 1998, Pat. No. 5,991,569.

[30] Foreign Application Priority Data

| | | | |
|---|---|---|---|
| Jun. 6, 1997 | [JP] | Japan | 9-165392 |
| Jul. 16, 1997 | [JP] | Japan | 9-208704 |
| Jul. 16, 1997 | [JP] | Japan | 9-208705 |
| Jul. 16, 1997 | [JP] | Japan | 9-208706 |
| Jul. 17, 1997 | [JP] | Japan | 9-208688 |
| Apr. 2, 1998 | [JP] | Japan | 10-108800 |

[51] Int. Cl.[7] ..... G03G 21/16

[52] U.S. Cl. ..... 399/110; 399/113; 399/119; 399/227

[58] Field of Search ..... 399/110, 111, 399/116, 117, 119, 227, 113

[56] References Cited

U.S. PATENT DOCUMENTS

| | | |
|---|---|---|
| 4,327,992 | 5/1982 | Babicz . |
| 4,530,588 | 7/1985 | Kimura . |
| 4,713,673 | 12/1987 | Kessoku . |

*Primary Examiner*—Richard Moses

*Attorney, Agent, or Firm*—Oblon, Spivak, McClelland, Maier & Neustadt, P.C.

[57] ABSTRACT

A color image forming apparatus having a revolving type developing unit detachably installed therein. The revolving type developing unit includes a plurality of different color developing devices each having a developing roller therein. Each of the developing rollers is movably mounted on the developing device so that a gap between each of the developing rollers and a periphery of a photoconductive drum which is to be formed when the revolving type developing unit is set in the color image forming apparatus is enabled to be adjusted.

8 Claims, 63 Drawing Sheets

| SETTING AMOUNT | 0 | 1 | 2 | 3 |
|---|---|---|---|---|
| VOLTAGE | 500V | 440V | 470V | 530V |

| SETTING AMOUNT | 0 | 1 | 2 |
|---|---|---|---|
| VOLTAGE | 620V | 590V | 650V |

PC DRUM INTEGRATED REVOLVING TYPE DEVELOPING UNIT WITH PULL-OUT SUPPORTER

This is a continuation of Ser. No. 09/093,092 filed Jun. 8, 1998, now U.S. Pat. No. 5,991,569.

BACKGROUND OF THE INVENTION

1. Field of the Invention

The present invention relates to an image forming apparatus such as a copying machine, a facsimile, a printer, etc., and more particularly to an image forming apparatus having a revolving type developing apparatus rotatably supported in the image forming apparatus.

2. Discussion of the Background

An image forming apparatus is known which includes a revolving type developing apparatus with a plurality of developing units having developing devices around a rotary shaft. The developing devices are rotated by rotation of the rotary shaft so as to move an arbitrary developing device to a developing station adjacent to a latent image carrier in order to develop the latent image formed on the latent image carrier by the developing device. A revolving type developing apparatus is also known which includes a rotary developing unit rotatably arranged close to a photo-conductive drum as a latent image carrier having a plurality of developing devices. In such a device, a rotary toner container unit having a plurality of toner containers corresponding one-to-one to the plurality of developing devices is arranged coaxially on one end of the rotary developing unit, and a toner conveying device connects each toner container and each developing device as shown in, for example, Japanese Non-examined Patent Publication No. 62-251772, Japanese Non-examined Patent Publication No. 63-78170, and Japanese Non-examined Patent Publication No. 63-41164.

In the above Japanese Non-examined Patent Publication No. 63-78170, a rotary developing unit supporting mechanism is disclosed for rotatably supporting a wall of one end of both end portions of a developing unit in a direction of a rotary shaft with a rotatable supporting roller which is in contact with its circumferential surface in order to support the rotary developing unit in the apparatus and for rotatably supporting the other end wall on a pin fixed to a center of it in a positioning hole on a side plate.

In addition, in order to enhance workability of maintenance such as exchanging developer in a developing device, an image forming apparatus is disclosed to have a constitution in which a photo-conductive drum as a latent image carrier and working devices such as a normal developing apparatus are supported by a unit supporter which is held to be pulled out of a body of the image forming apparatus (hereinafter, simply referred to as an apparatus body). Such a technology is shown in, for example, Japanese Patent Publication No. 61-58035, Japanese Patent Publication No. 62-37392, Japanese Patent Publication No. 3-34070, Japanese Patent Publication No. 58-54392 and Japanese Patent Publication No. 3-50268, etc.

One drawback in such background devices is that a revolving type developing apparatus, however, is grasped by an apparatus body for fixing in order to assure its rigidity and precision, which leads to extremely deteriorated maintainability around the developing unit. Furthermore, in an image forming apparatus having this constitution, the revolving type developing apparatus and the apparatus body cannot be individually assembled due to the grasped fixing method of the revolving type developing apparatus to be fixed to the apparatus body, which causes a serious problem in assembly properties in a mass production line.

Although there is also an image forming apparatus in which only a revolving type developing apparatus is removable from an apparatus body, in this type of image forming apparatus a number of components of the revolving type developing apparatus is increased, which expands a tolerance generated by building-up of the components from a stage of its photo-conductive drum to the revolving type developing apparatus, and therefore it becomes hard to assure a precision of a developing gap between a developing roller of a developing device in a developing unit of the revolving type developing apparatus and the photoconductive drum, and as a result a stable image quality cannot be obtained. In addition, in this constitution, the revolving type developing apparatus removed from the apparatus body is put on a floor before its maintenance work is started, which deteriorates stability and workability of the revolving type developing apparatus during the work, since the revolving type developing apparatus is a rotary body and the revolving type developing apparatus is attached or removed to or from the apparatus body in side directions which forces a user to work in an unnatural posture with poor workability.

As a further drawback in the image forming apparatus having the above unit support structure, various problems are generated when freely rotating the revolving type developing apparatus as the revolving type developing apparatus supported by the unit supporter.

For example, if a user pulls out the revolving type developing apparatus supported by the unit supporter and then tries to start a maintenance work such as mounting or removing each developing device in the rotary developing unit in this state, the revolving type developing apparatus freely rotates since it is separated from a driving input in the side of the apparatus body. This causes a problem in that it is hard to perform the maintenance work, which thereby deteriorates working efficiency.

Furthermore, if the revolving type developing apparatus rocks due to vibrations during transportation with the unit support housed in the apparatus body, the following problems may arise. For example, if the image forming apparatus has a drive transmission mechanism which drives a rotary member, such as, for example, a developing roller in the revolving type developing apparatus, by means of mating gears between the apparatus body and the revolving type developing apparatus and it is transported with the gears mated to each other, the revolving type developing apparatus rocks around a rotary shaft due to vibrations during the transportation. This may cause rotations in forward and reverse directions of members for stirring and conveying developer in each developing device of the revolving type developing apparatus and of the developing roller, and as a result toner may leak outside through a gap between an opening edge for an exposure of the developing roller in a developing device case and a surface of the developing roller (if 2-component developer is used, carrier and toner may leak) or the toner may scatter.

In addition, if the revolving type developing apparatus has a rotary toner container device and the apparatus body is transported with toner contained in each toner container of the rotary toner container device, the toner in each toner container may flow out and move into each developing device via the toner conveying device. The toner may then leak outside through the gap between the opening edge for the exposure of the developing roller in the developing device case and the surface of the developing roller, or the toner may scatter.

SUMMARY OF THE INVENTION

As one feature, the present invention provides a novel color image forming apparatus having a revolving type developing apparatus detachably installed therein. The revolving type developing unit includes a plurality of different color developing devices each having a developing roller therein. Each of the developing rollers is movably mounted on the developing device so that a gap between each of the developing rollers and a periphery of a photoconductive drum, which is to be formed when the revolving type developing unit is set in the color image forming apparatus, can be adjusted. Further, the novel image forming apparatus may include a unit supporter which can be pulled out of the apparatus body with supporting the revolving type developing apparatus for rotatably supporting the revolving type developing apparatus and a rotation stopper for stopping rotation of the revolving type developing apparatus when pulled out.

The pulled-out supporter may include a front side plate and a rear side plate for rotatably supporting the shaft of the latent image carrier and the revolving type developing apparatus and the pulled-out supporter may further include a stay member for integrating a front side plate with a rear side plate so that a rotary central axis of the latent image carrier is placed in parallel with a rotary central axis of the revolving type developing apparatus at a predetermined interval. The developing devices of each developing unit of the revolving type developing apparatus may be independently moved at least in a direction perpendicular to the rotary central axis of the revolving type developing apparatus so that an interval between the rotary central axis of the developing roller of the developing device and the rotary central axis of the latent image carrier is adjusted.

Further, the novel image forming apparatus may include a pulled-out supporter on which at least the revolving type developing apparatus is mounted and which is capable of being pulled out of an image forming apparatus body and an end portion in the side toward a pulling out direction of the rotary shaft to at least protrude from the pulled-out supporter so that the revolving type developing apparatus is mounted on the pulled-out supporter. A knob may also be provided for manually rotating the rotary shaft attached to the end portion in the side toward a pulling out direction of the rotary shaft.

Further, the novel image forming apparatus may include a toner container which rotates integrally with the developing unit in a state of being set in each developing device for containing toner to be supplied to each of the developing devices, a container removal hole having a large enough size for the toner container to be pulled out toward the axis on the front side plate and a jumping mechanism in which at least a part of the toner container is jumped out toward a predetermined side of the front side plate from the container removal hole by releasing the setting of the toner container from the developing device.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 34(*b*) is a schematic diagram of a developing unit for explaining toner flow of a toner supplying apparatus;

FIG. 37(*b*) is a schematic sectional view of a toner cartridge;

FIG. 42(*b*) is a schematic perspective diagram illustrating an arrangement position of a P sensor;

FIG. 43(*b*) is a table listing bias setting values and setting voltages;

FIG. 44(*b*) is a table listing bias setting values and setting voltages;

FIG. 45(*b*) is an explanatory diagram for an intense reflected light from a P sensor pattern image;

FIG. 45(*c*) is an explanatory diagram for a faint reflected light from a P sensor pattern image;

FIG. 48(*b*) is a diagram illustrating an output signal of a P sensor issued when a toner density is low;

FIG. 48(*c*) is a diagram illustrating an output signal of a P sensor issued when a toner density is high;

DETAILED DESCRIPTION OF THE PREFERRED EMBODIMENTS

The following describes an embodiment in which the present invention is applied to a color copying machine as an example of an image forming apparatus to which the present invention can be applied. Specifically, a description will be made of an embodiment of an image forming apparatus including a latent image carrier on which a latent image is formed and including a revolving type developing apparatus in which a plurality of developing units having developing devices around a rotary shaft are rotated by rotation of the rotary shaft to move an arbitrary developing device to a developing station opposite to the latent image carrier in order to develop a latent image formed on the latent image carrier by the developing device. A pulled-out supporter is provided on which at least the latent image carrier and the revolving type developing apparatus are mounted and which is held to be pulled out of the image forming apparatus body.

First, a constitution of a body of the color copy machine will be described below.

In this embodiment, three modules are used as basic composing elements and their constitutions and actions are shown in FIGS. 1 to 16. The basic modules are a scanner module 200, a printer module 400, and a system control module 600.

Figure 1:
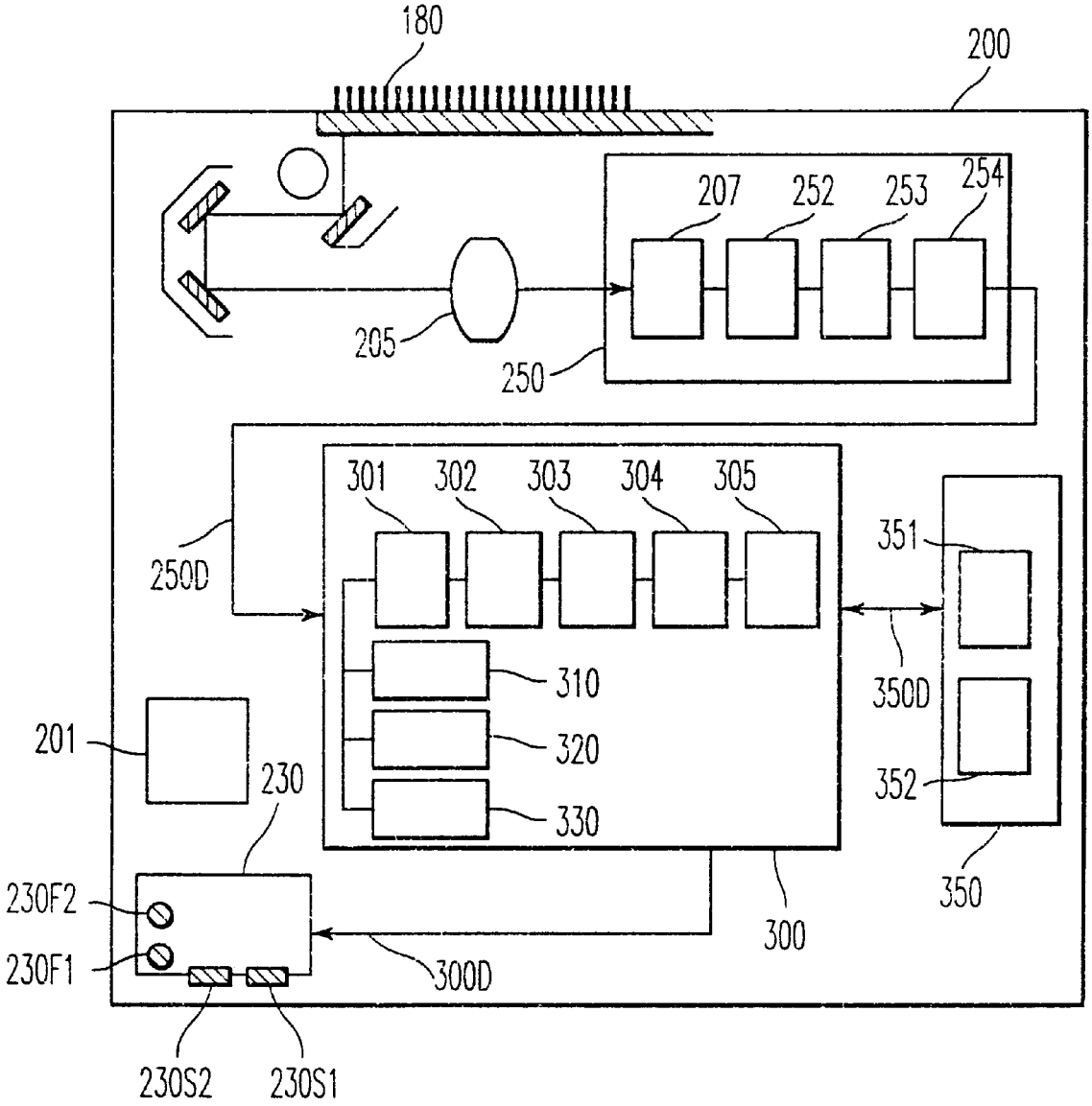
FIG. 1 is a block diagram of a scanner module of an image forming apparatus according to an embodiment of the present invention.

As shown in FIG. 1, the scanner module 200 includes at least an image reading device 250 for reading an original image after being decomposed into picture elements, a first communication controller 230, and a first power supply 201, and additionally a basic image processor 200 and an extended image processor 350 if necessary.

Figure 6:
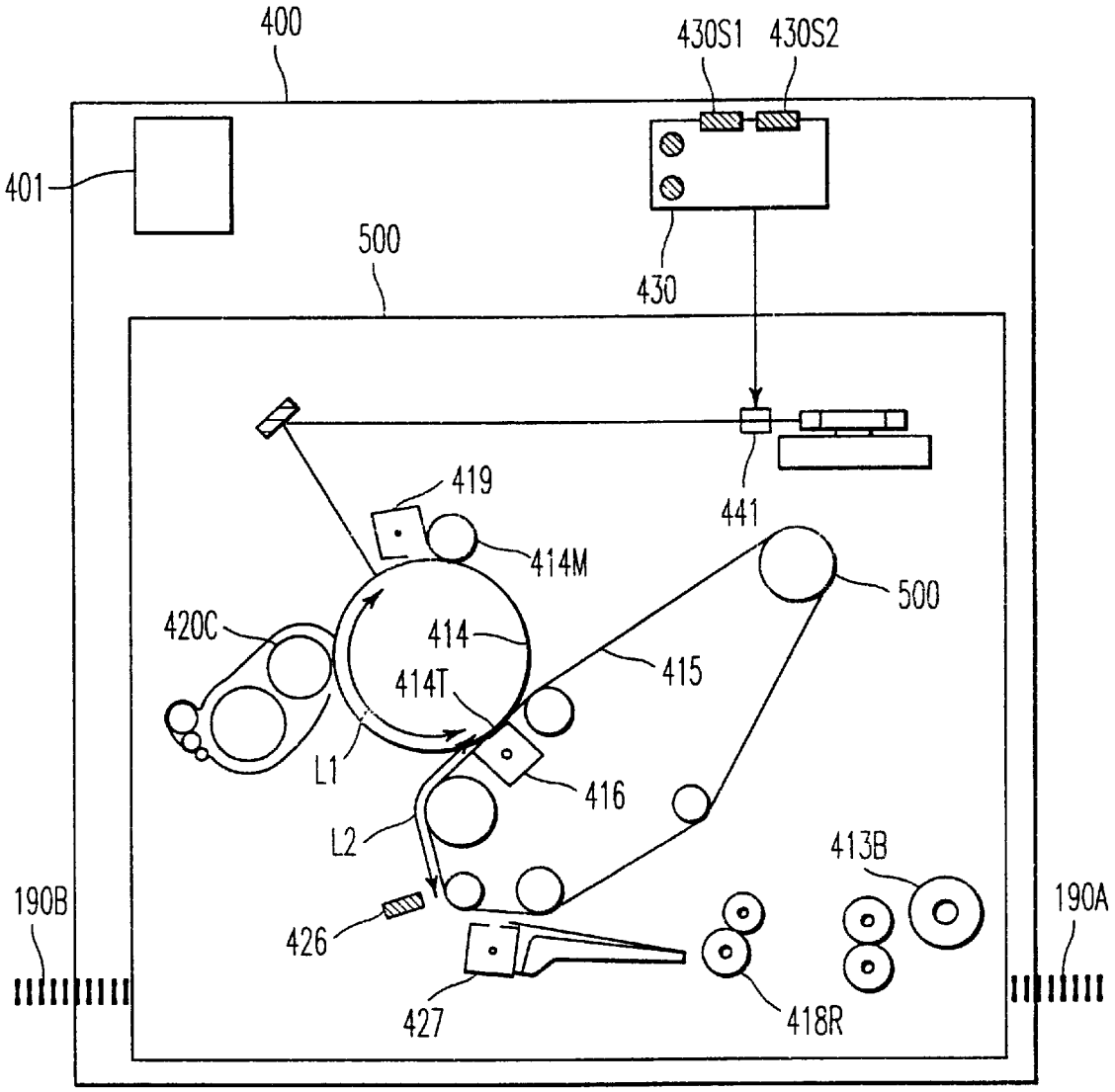
FIG. 6 is a block diagram of a printer module of an image forming apparatus.
Figure 7:
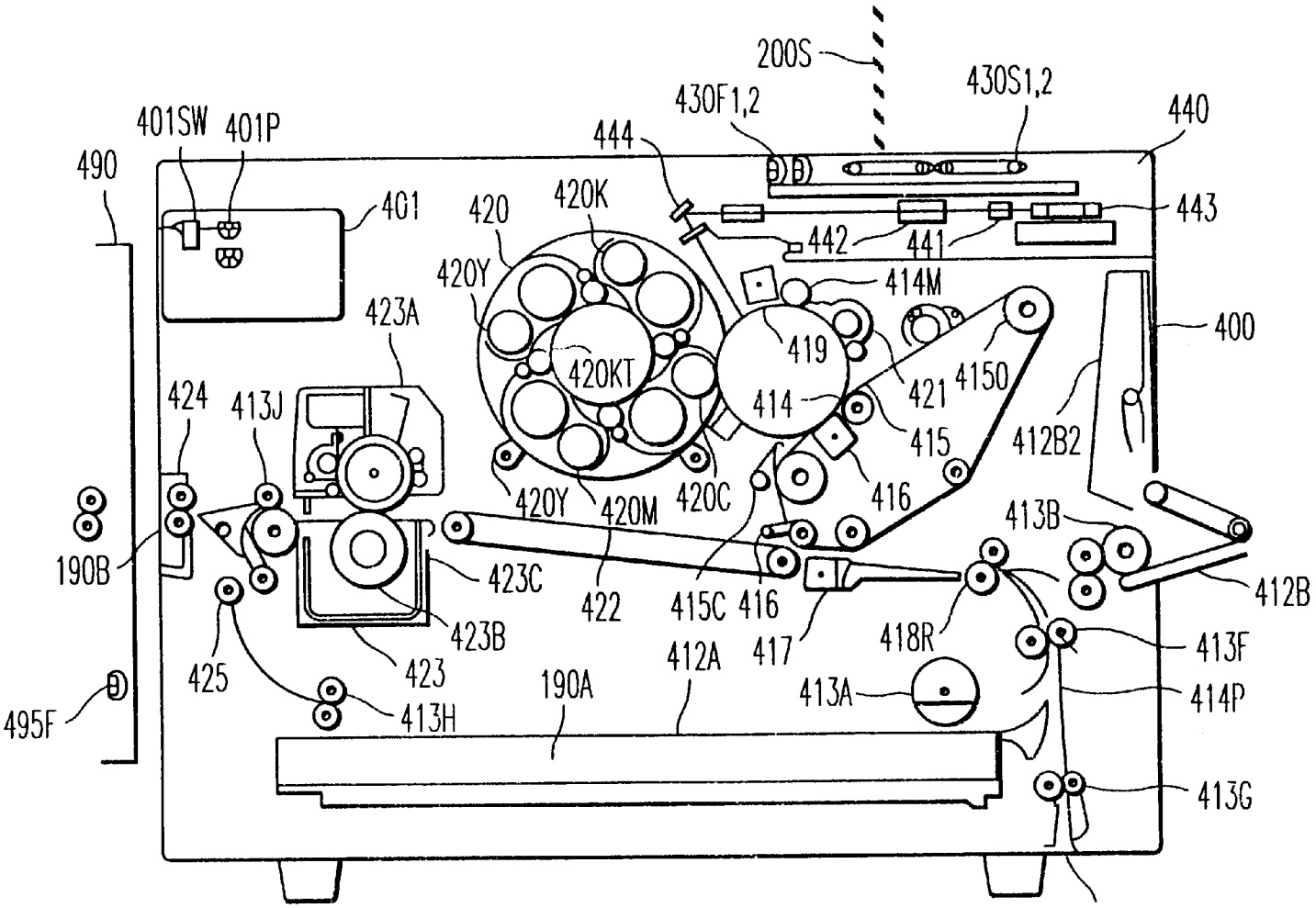
FIG. 7 is a mechanical diagram of a printer module.

As shown for example in FIGS. 6 and 7, the printer module 400 includes an image formation device 500 for forming an image as a permanent visible image on a record medium 190, a second communication controller 430, and a second power supply 401. The image formation device 500 is an assembly of a plurality of elements described below. The image formation device 500 is assumed to include elements required for an image formation such as a photoconductive drum 414, a charger 419, a laser exposing device 441, a developing device 420, a first transferring device 416, an intermediate transferring body 415, and a second transferring device 417.

Figure 11:
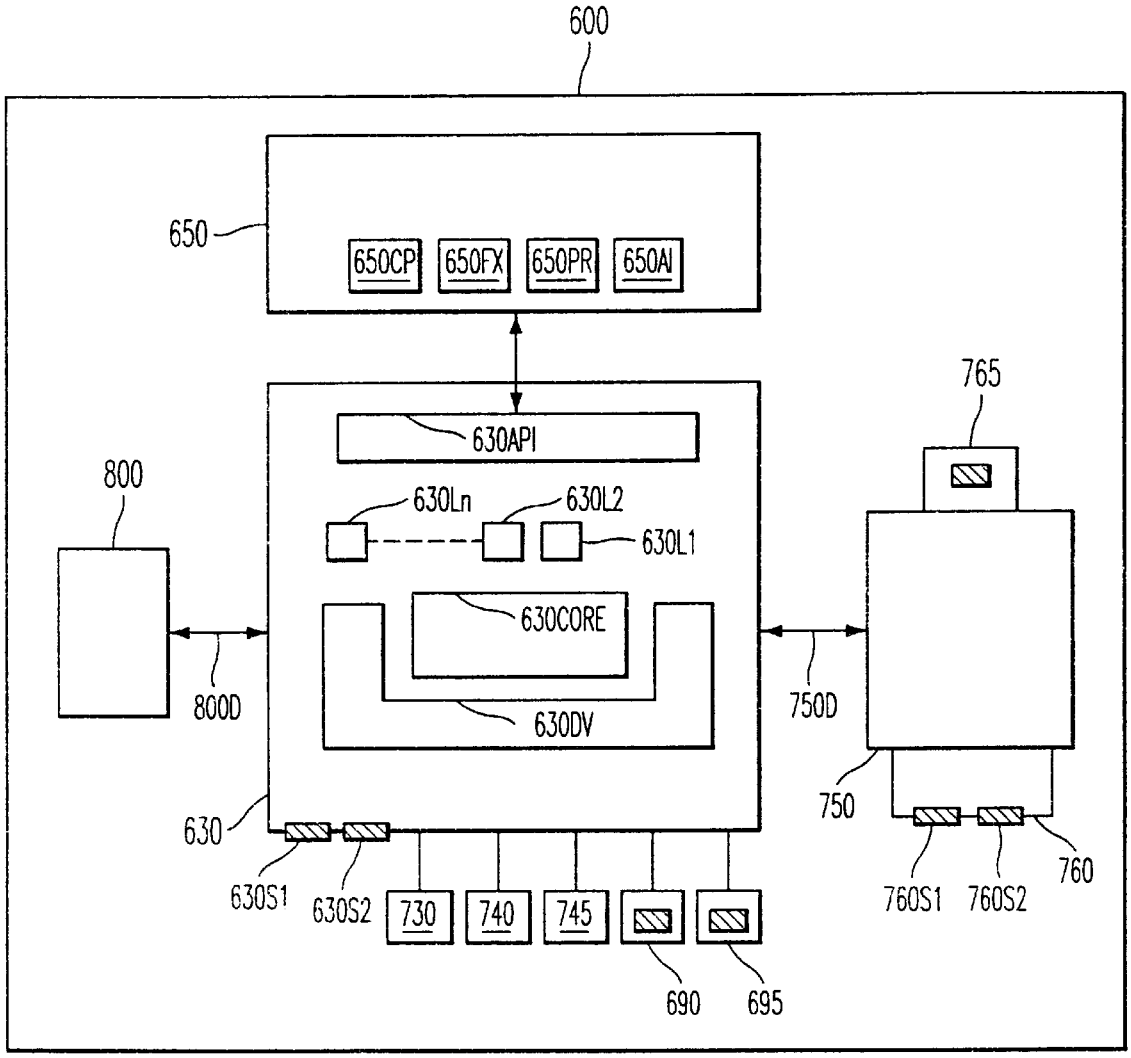
FIG. 11 is a block diagram of a system control module of an image forming apparatus.

As shown for example in FIG. 11, the system control module 600 includes a third communication device 630 and a system controller 650 having at least one of the following functions: energizing the scanner module 200 for controlling image reading, and energizing the printer module 400 for controlling image formation.

Figure 2:
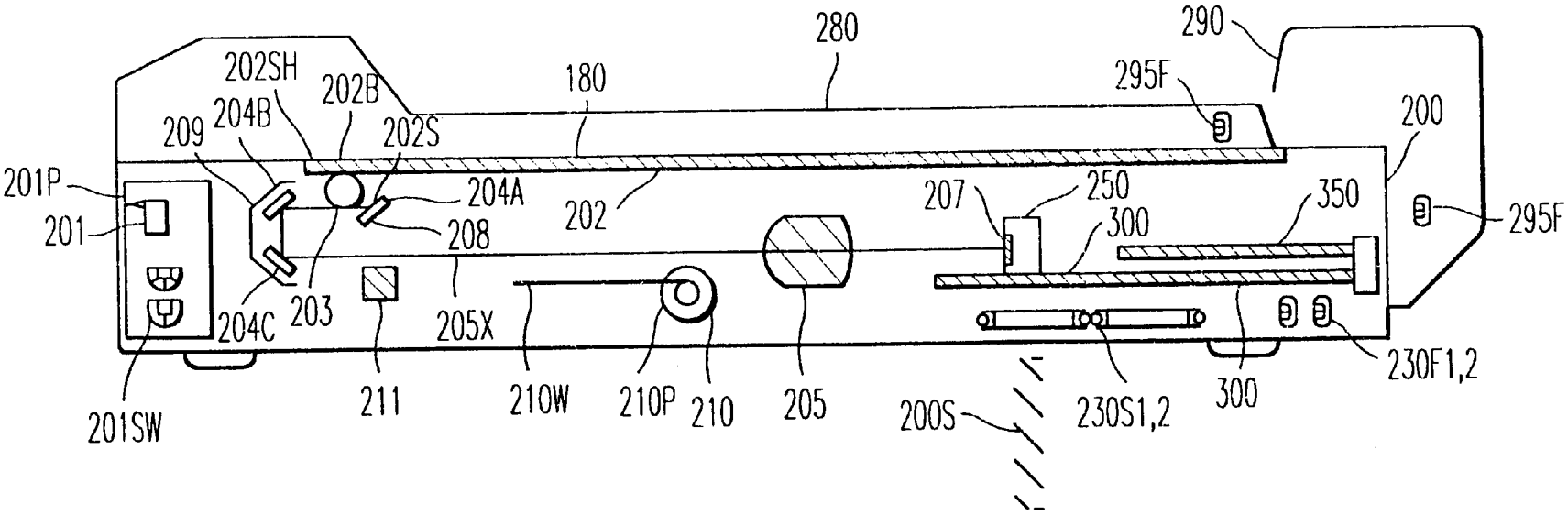
FIG. 2 is a mechanical diagram of a scanner module.
Figure 12:
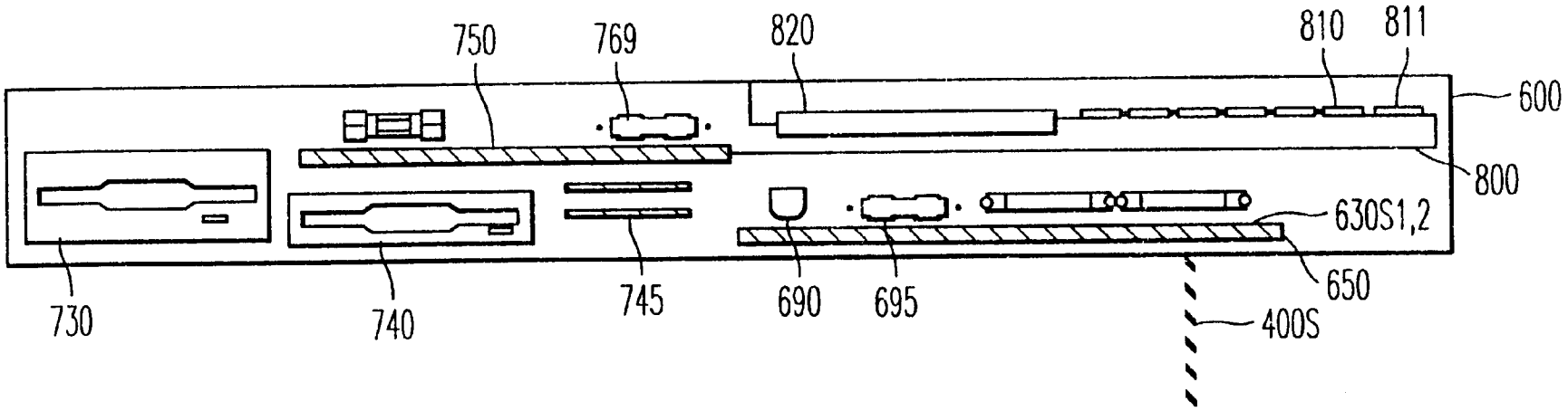
FIG. 12 is a mechanical diagram of a system control module.

These three modules 200, 400, 600 are configured so as to satisfy system functions even if they are separated from each other in the mechanism as shown in FIGS. 2, 7, and 12. In a constitutional example of a copying system described later, the scanner module 200 is packed in a unit as it is in order to obtain a compatibility between a weight reduction of a transportation unit and a simplicity of system assembly, while the printer module 400 and the system control module 600 are packed together in a box for factory delivery with the printer module 400 integrated with the system control module 600 by mounting the system control module 600 on the top of the printer module 400 fixedly.

Furthermore, in the factory delivery system, it is possible to cope with problems such as operability or aesthetic unification of the integrated modules, a space efficiency or other considerations for a user, or technical problems such as electromagnetic radiation, noise immunity, heat emission, prevention of mechanical resonance, etc. For example, for a constitution of a copying system, at least the above modules are combined with a table or a selective multistage feeder, and preferably the modules are vertically stacked from a viewpoint of space efficiency and preferable operability of document mounting is obtained when a height of a platen is set to 900 mm to 1,100 mm. In addition, an adequate human interface is achieved by positioning various buttons on a platen surface or a slightly lower surface. From a viewpoint of these advantages, the modules in this constitution are stacked with stacked surfaces having generally equal projected shapes in order to prevent an unshaped form, and to prevent upper modules from dropping from the lower module and the platen and the scanning device surface are put in the above positions when the modules are stacked. In addition, from a viewpoint of compatibility between an appearance and electromagnetic boundary, the number of connection cables is decreased as much as possible and terminals are as close to each other as possible so that shorter cables can be used. The system control module 600 can have an extremely compact constitution in a case that it is necessary to achieve only a copying function, and therefore this system control module 600 can be built into another module. If the system control module 600 is built into another module, only the above considerations are required to be taken on the combination of the two modules, without departing from the object of the constitution.

The constitution and action of each module will be described below in order.

Referring to FIG. 2, a mechanical constitution of scanner module 200 is shown to include a DC power supply as a first power supply 201, a power plug 201P for a connection to a commercial power supply, a power switch 201SW, a platen glass 202, an image front reference position 202S, a shading correction white board 202SH, a solid identification barcode board 202B, a first carriage 208, a second carriage 209, a document lighting lamp 203, a first mirror 204A, a second mirror 204B, a third mirror 204C, an imaging lens 205, a lens optical axis 205X, a color phototaking device 207, a carriage home sensor 211, SCSI connectors having an identical shape and an identical interface on a first communication controller 230, 230S1,2, optical fiber connectors for scanner optional additional device communication 230F1 and 230F2, a circuit board on which a document reading device 250 is mounted, a circuit board on which a basic image processor 300 is mounted, and a circuit board on which an extended image processor 350 is mounted.

Referring to FIG. 1 the image reading device 250, color phototaking device 207, an analog-digital converter (hereinafter, A-D converter) 252, a shading corrective circuit 253, and a sampling position deviation compensating circuit 254, are also shown.

A document 180 is placed on the platen glass 202 with a surface to be copied facing downward and with a reading start position at a left end 202S of the platen glass 202 as shown in FIG. 2. The imaging lens 205 is used to project and form a document image, with reducing, on a light receiving surface of the color phototaking device 207. The color phototaking device 207 is, e.g., a charge coupled device (CCD) having a color phototaking function and can include a R phototaking section including one-dimensionally arranged 4,752 picture elements covered by a red filter, a G phototaking section including one-dimensionally arranged 4,752 picture elements covered by a green filter, and a B phototaking section including one-dimensionally arranged 4,752 picture elements covered by a blue filter, which are arranged in parallel with each other in three rows in a horizontal scanning direction (a perpendicular direction to the surface of the paper in FIG. 2). Three scanning lines are almost close to each other, and specifically the intervals are equivalent to 4/16 mm when converted to intervals on the surface of the document 180. Note that the scanning in a direction of such a one-dimensional phototaking device is referred to as horizontal scanning and the scanning in a direction intersecting orthogonally is a vertical scanning.

The document lighting lamp 203 and the first mirror 204A are mounted on the first carriage 208, and the second mirror 204B and the third mirror 204C are fixed to the second carriage 209. Before reading a document, the first carriage 208 and the second carriage 209 are driven for scanning (vertical scanning) at a vertical scanning speed Vsub and Vsub/2 by a document scanning motor 210 and a driving wire 210W, respectively, from the left end to the right end while an optical conjugate relationship is maintained. For the document scanning motor 210, a stepping motor can be used.

The vertical scanning speed Vsub is variable by 1% in a range of ⅛ to 4 times of a reference speed, and an arbitrary speed is selected by a command from other modules.

Figure 4:
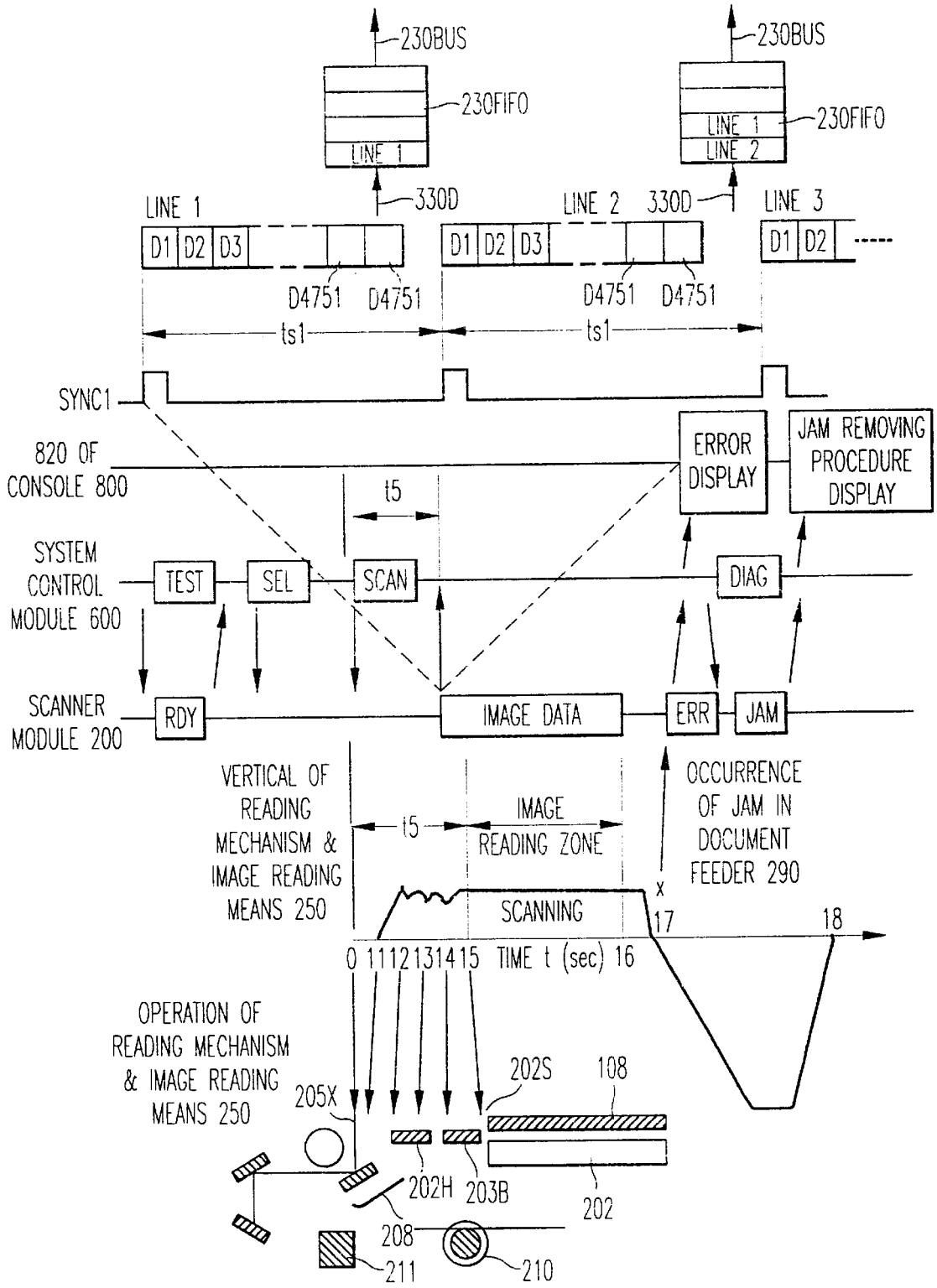
FIG. 4 is a timing chart of an operation of a scanner module.

Referring to FIG. 4, a speed diagram of an image reading mechanical section is shown. Document scanning will be described below by using FIG. 4. The first carriage 208 is generally stationary right above a carriage home sensor 211 in a standby state. A sensor output in this condition is ON. After receiving a read scanning command SCAN or REQ, the document lighting lamp 203 is turned at a time t1 and the document scanning motor 210 is driven to start the scanning rightward. After an elapse of a t2 time period, the first carriage 208 deviates from a detection range of the carriage home sensor 211 and the output is set OFF. The position where first carriage 208 deviates is stored as a scanning reference position and is used as a correction reference point for a position. The first communication controller 230 calculates an optimum acceleration plan in order to achieve a hitting time t5 up to the image front end reference position 202S and a speed Vsub required precision and calculates a step pulse string of the document scanning motor 210. Then, first carriage 208 is driven at a speed of this pulse string so as to achieve a hitting time up to the image front end reference position 202S and a desired fixed speed scanning as expected.

After passing the correction reference point, the color phototaking device 207 reads an image having various colors projected by the imaging lens 205 in units of horizontal scanning lines. This method is favorable to fix an electric charge storage time of the color phototaking device 207. The horizontal scanning cycle is a cycle ts1 of a pulse string generated by a first synchronous signal generator 230SYNC shown in FIG. 3, and the pulse string is connected to document reading device 250 via a bus 230BUS. The first synchronous signal generator 230SYSNC outputs the pulse string to the bus 230BUS with dividing an oscillation frequency of a crystal oscillator 230XTL. The number of the picture elements of the color photostating device 207 is, e.g., 4752 in total, and a horizontal scanning line is decomposed in units of 16 picture elements per millimeter in a document image and is sampled to be read, and then an analog voltage is output according to a RGB reflected light in units of a picture element from the document 180. Afterward, the analog voltage is converted to an 8-bit digital signal by A-D converter 252, in other words, quantized into 256 tones, and the digital signal is then passed to a subsequent circuit.

After the above reference point is passed by, first at time t3, the white reference board 202SH is read and an 8-bit digital converted value is stored into the shading correction circuit 253. After that, image data which has been read is subjected to an effective shading correction. At time t4, if the first carriage 208 detects an attempt of an illegal copying of securities and it passes under the solid identification barcode board 202B for providing it to a remote service, the document is read and the image data is transmitted to a system control module 600.

Subsequently when the document 180 reaches the document front end reference position 202S at time t5, the document reading device 250 reads an image on the document 180 in units of a scanning line and then outputs color separation digital data 250D for each picture element sequentially to a basic image processor 300 at a next stage.

Data of 6,720 scanning lines can be read as all data on an A3 document 180 and the first carriage 208 reaches the right end at time t6, the document scanning motor 210 is then rotated in an opposite direction in order to return the first carriage 208 to a detecting position of the carriage home sensor 211 to be stopped at a home position to prepare for a next scanning.

Referring again to FIG. 1, the basic image processor 300 includes a space filter circuit 301, a reduction circuit 302, a color processing circuit 303, a tone processing circuit 304, an image additional circuit 305, an image region automatic separation circuit 310, a color document automatic detecting circuit 320, and a securities detecting circuit 330.

The space filter circuit 301 is used to smooth or sharpen an image. In general, the smoothing processing is applied if the document is a halftone dot printed matter while the sharpening processing is applied if only characters are printed on the document. This selection is entered on a document specification screen of a console 800 (see e.g. FIG. 11) or is determined depending on a separation result obtained from the image region automatic separation circuit 310 as described later.

The reduction circuit 302 is used to reduce the image, e.g., to 25% to 40%, in the horizontal scanning direction. A copy reduction in the vertical scanning direction is achieved by changing an image reading speed (a vertical scanning speed).

The color processing circuit 303 has a function of masking processing on a document image RGB signal and its conversion to cyan, magenta, yellow, and black image formation signals which are recording signals. Furthermore, color processing circuit 303 is used for color processing suitable for each of a character image and a shaded image, for example, completely blackening black character portions and other adjustment processing. In addition, the RGB signal is output to the system control module 600 via the first communication controller 230 as it is, if necessary.

The tone processing circuit 304 is used to generate a 2-bit recording image signal from one of the 8-bit C, M, Y, and K image signals by a dither processing. Furthermore, tone processing circuit 304 is used to perform a tone conversion suitable for each of a character image and a shaded image, in other words, adjustment tone processing.

The image additional circuit 305 is used to generate small pattern data for tracing in preparation an attempt of for illegal copying of securities to add it to document image data.

The image region automatic separation circuit 310 is used to discriminate character image portions from shaded image portions on an image of a document sheet in units of a picture element and to output the result to the space filter circuit 301, the color processing circuit 303, and the tone processing circuit 304. The color document automatic detecting circuit 320 is used to determine whether the document 180 is a color document or a monochrome document. The securities detecting circuit 330 determines whether or not the document 180 is a securities paper which is inhibited to be copied.

The RGB image data 250D of the read document is input to the space filter circuit 301, the image region automatic separation circuit 310, the color document automatic detecting circuit 320, and the securities detecting circuit 330 in parallel and is then processed in parallel. The functions of the basic image processor 300 are classified into two categories. Functions of a first category are used not to operate image signals directly, but to support image operations. For example, there are image region separation processing for discriminating character regions from tone image regions, document size detecting processing, and color/monochrome document discriminating processing. This category includes processing which requires all document image information on the platen glass 202 to be checked such as color/monochrome document discriminating processing, which is performed before copy image formation and generally referred to as a pre-scan.

Functions of a second category are used for processing of operating image signals, for example, space filter processing, reduction, image trimming, image moving, color correction, tone conversion, and other image processing. Theses types of processings are classified into a common processing for all image regions such as reduction and a processing different between character image portions and shaded image portions such as tone processing.

Many of the results of the first category processing are transmitted to the system control module 600. The system control module 600 which receives the results progresses an image formation process by issuing control commands to other elements based on the results. For example, if the basic image processor 300 detects a monochrome document, the basic image processor 300 reports this to the first communication controller 230, the first communication controller 230 reports this to the system control module 600, and the system control module 600 sends a command of energizing K development and halting CMY development to the printer module 400. Then, a second communication controller 430 in the printer module 400 energizes only K developing device 420K and halts multicolor development so as to form an image efficiently.

The contents of the second category image processing are a processing automatically energized based on a result of the first category processing, a processing entered from a console 800 by an operator with specification, and a combined processing of the above. As an example of these types of processings, a specific color image erasing processing will be described below. In this processing, a specific color included in a document image is erased while other colors are stored to form an image on a transfer paper 190A, which is performed by a color processor included in the basic image processor 300. The specific color is entered from the console 800 by an operator.

In any case, in the copy mode, the RGB image signal entered to the basic image processor 300 is finally converted to signals C (cyan), M (magenta), Y (yellow), and B (black) for recording, and then this data is transmitted to the printer module 400.

When determining that the document 180 is a monochrome document or when receiving a black single color processing command, the basic image processor 300 performs monochromatic processing, outputting 0 for signals other than the K signal.

Figure 3:
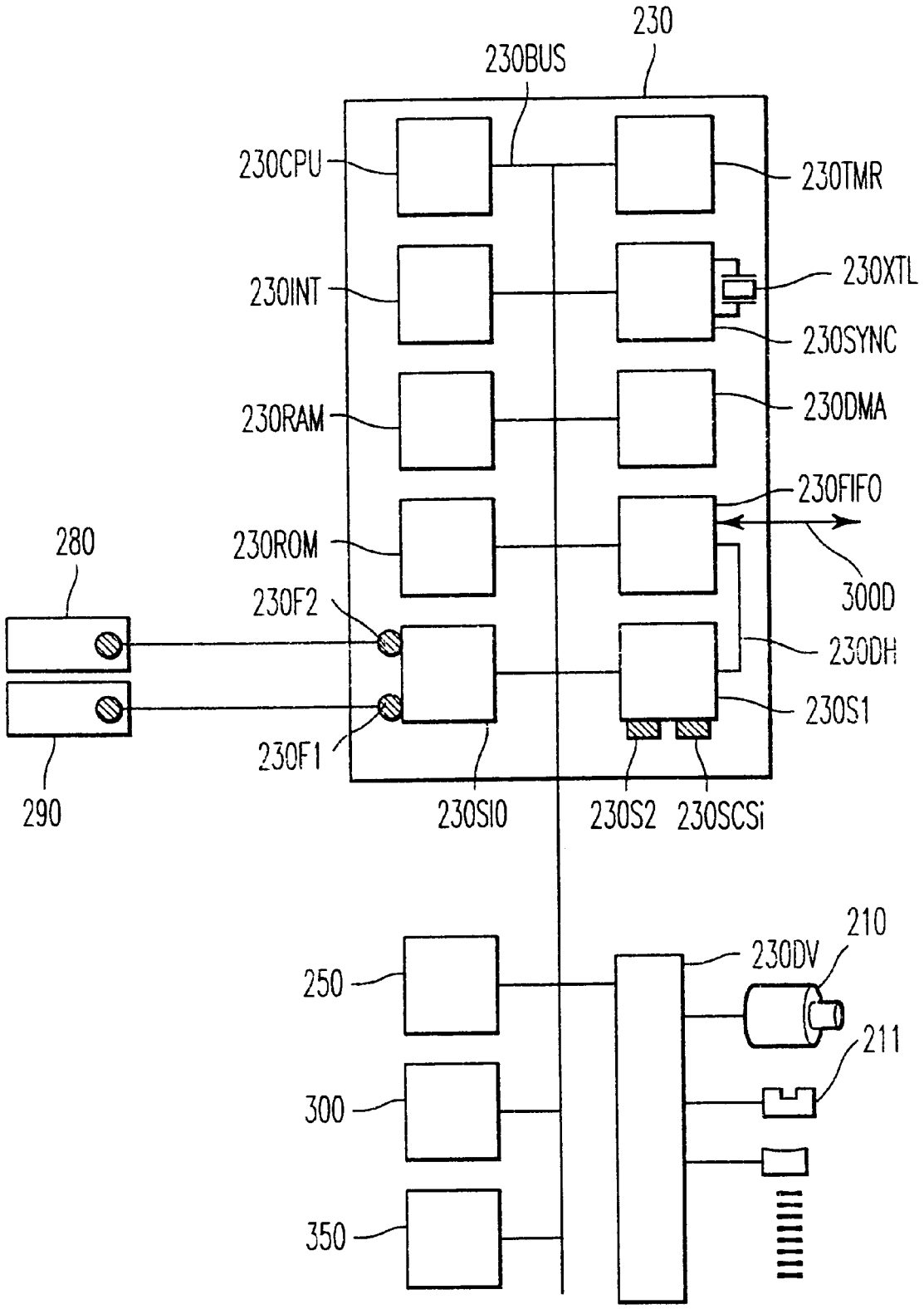
FIG. 3 is a diagram illustrating a first communication controller of a scanner module.

A constitution of the first communication controller 230 is shown in FIG. 3. Referring to FIG. 3, there are shown a microprocessor 230CPU, a read/write memory 230RAM, a read only memory 230ROM, an interrupt controller 230INT, a timer counter 230TMR, a serial communication unit 230SIO, a first synchronous signal generator 230SYNC, a crystal oscillator 230XTL, a DMA controller 230DMA, a first-in first-out memory 230FIFO, an SCSI controller 230SCSI, a bus 230BUS, and an image data channel 230DH.

The first communication controller 230 communicates with the system control module 600 or the printer module 400 in a predetermined protocol and controls the scanner module 200 based on its command with energizing a document image reading to output document image data. The first communication controller 230 integrally controls all the elements in the scanner module 200 and optional additional devices such as an automatic document feeder 280.

In a general image system having an image reading device and an image formation device as separate modules, for example in an optical file system, normally some page buffer memory is provided. In this constitution, however, a time difference is inevitably generated between an image reading process to an image formation process. In a copying machine, this time difference leads to an increase of a first copy time. Therefore, in this constitutional example, a page buffer is omitted to reduce cost and the image reading is synchronized with the image formation, in other words, these operations are executed without almost any time difference. The synchronization of the image reading and the image formation includes two aspects, one is a match of a cycle and the other is that of a phase of the head of the image.

Unless this synchronization can be maintained, in the former aspect a problem may occur such as, for example, a copy image is extended or reduced and in the latter aspect such as a copy image position cannot be correctly reproduced on a record paper.

Furthermore, while, in a color copying system for which a printer is used in a method of forming images in an order of the C, M, Y, and K images like this constitutional example, the printer module 400 sequentially lays the C, M, Y, and K images one by one on top of the previous one to form an image, a page buffer memory is preferably omitted in order to make a commercially reasonable device, and therefore it is preferable to use a system in which the scanner module 200 performs scanning four times in total per document and sends out one of the C, M, Y, and K colors at every document image scanning. Accordingly, in four-time color sequential scanning, securing a scanning value precision for document image scanning, in other words, a synchronization, is a serious problem. If this synchronization is not obtained, color prints deviate from each other and a correct color image cannot be obtained.

A method of solving the above problem is described below using FIG. 4. Referring to FIG. 4, a single-time document image scanning is shown, providing details of two scanning lines of a top of the drawing. First, when receiving a SCAN command from the system control module 600, the first carriage 208, as described above, controls the first communication controller 230 so that a lens optical axis 205X reaches the image front end reference position 202S always after an elapse of t5 time period from the reception and that the vertical scanning speed is Vsub. Due to this control, image data is output always after a certain time t5 from a command reception timing, by which at least a synchronization of a phase is maintained. For this synchronization, a carriage home sensor 211 is arranged for detecting a carriage position so as to correct every time scanning reference positioning and a vertical scanning movement (a movement of the first carriage 208) of the document scanning motor 210, which may be set to 1/16 mm or shorter at a single step angle. As a motor driving method, a micro step driving method can be used.

Next, for the synchronization of a cycle, a horizontal scanning line is read in synchronization with the cycle ts1 of a pulse string generated by the first synchronous signal generator 230SYNC and it is entered into the sending buffer 230FIFO. Then in the side of receiving this data, the system control module 600 sends it out sequentially at practically the same cycle as the cycle ts1. In a copy mode, the printer module 400 is assumed to be in the side of receiving data so as to maintain the above synchronization mechanism. Accordingly, even if a document image is scanned many times, document image data is obtained always after an elapse of a certain time period from a command reception, a positional relationship (registration) between a transfer paper and an image is always correctly maintained, an excess buffer memory is not required in color copying, a color print registration is maintained, and copies are quickly output.

The scanner module 200 basically receives the above command from one of the system control module 600 or the printer module 400.

Figure 5A:
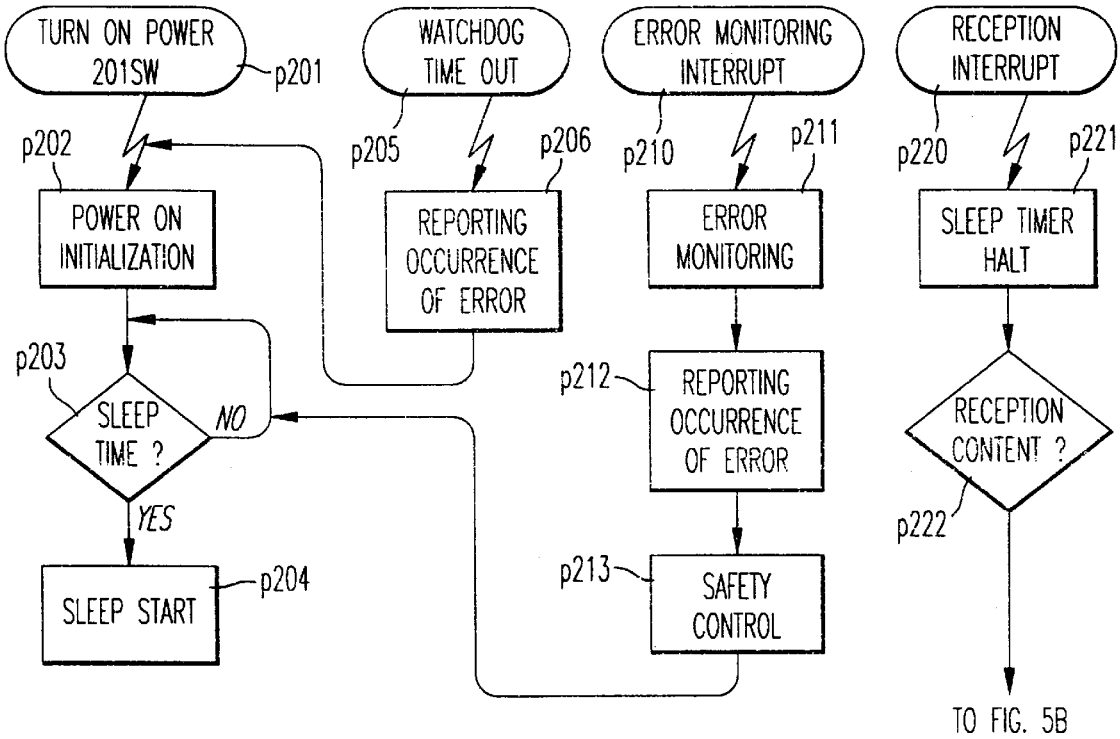
FIG. 5 is a flowchart of an operation control of a scanner module.
Figure 5B:
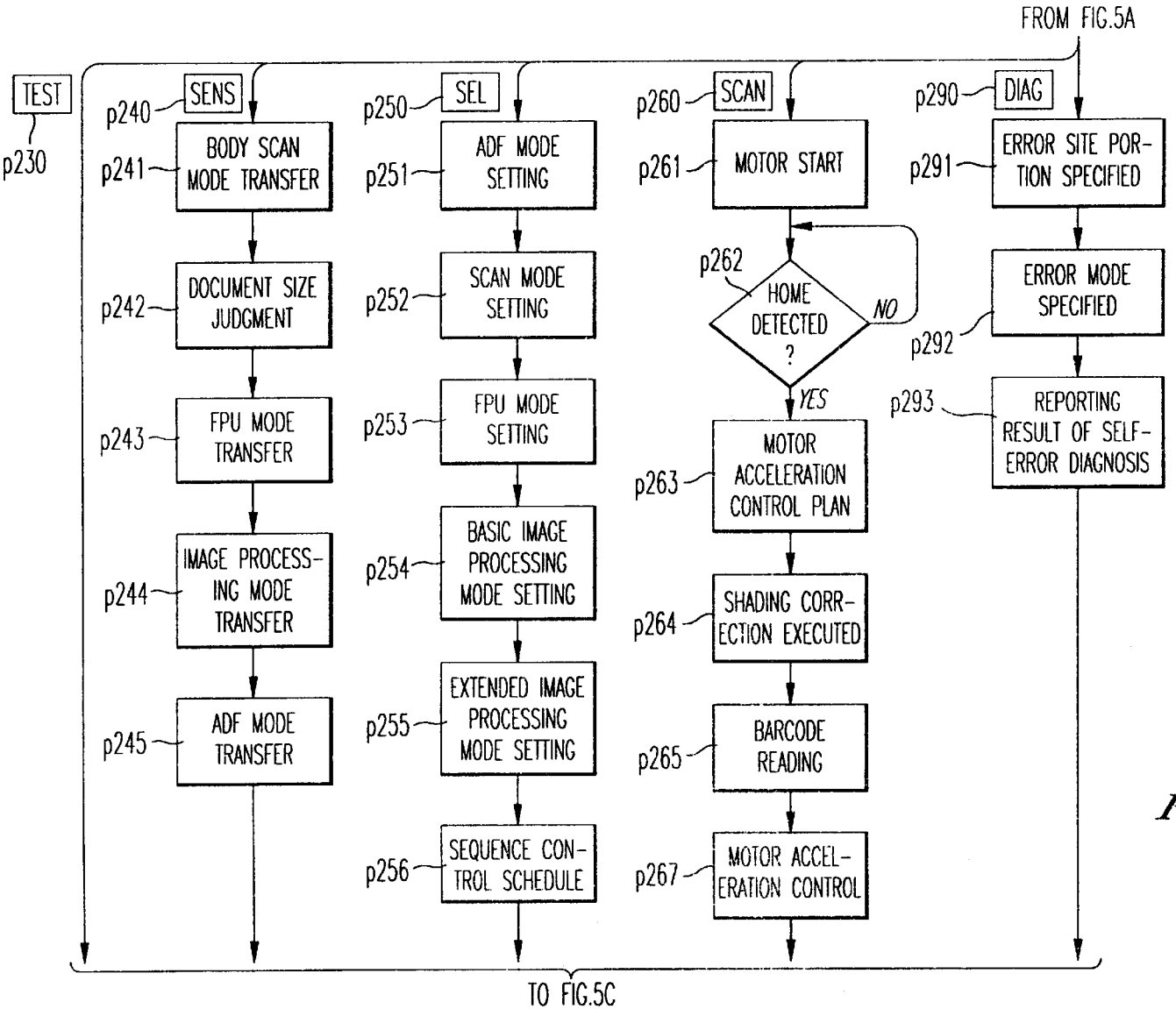
Figure 5C:
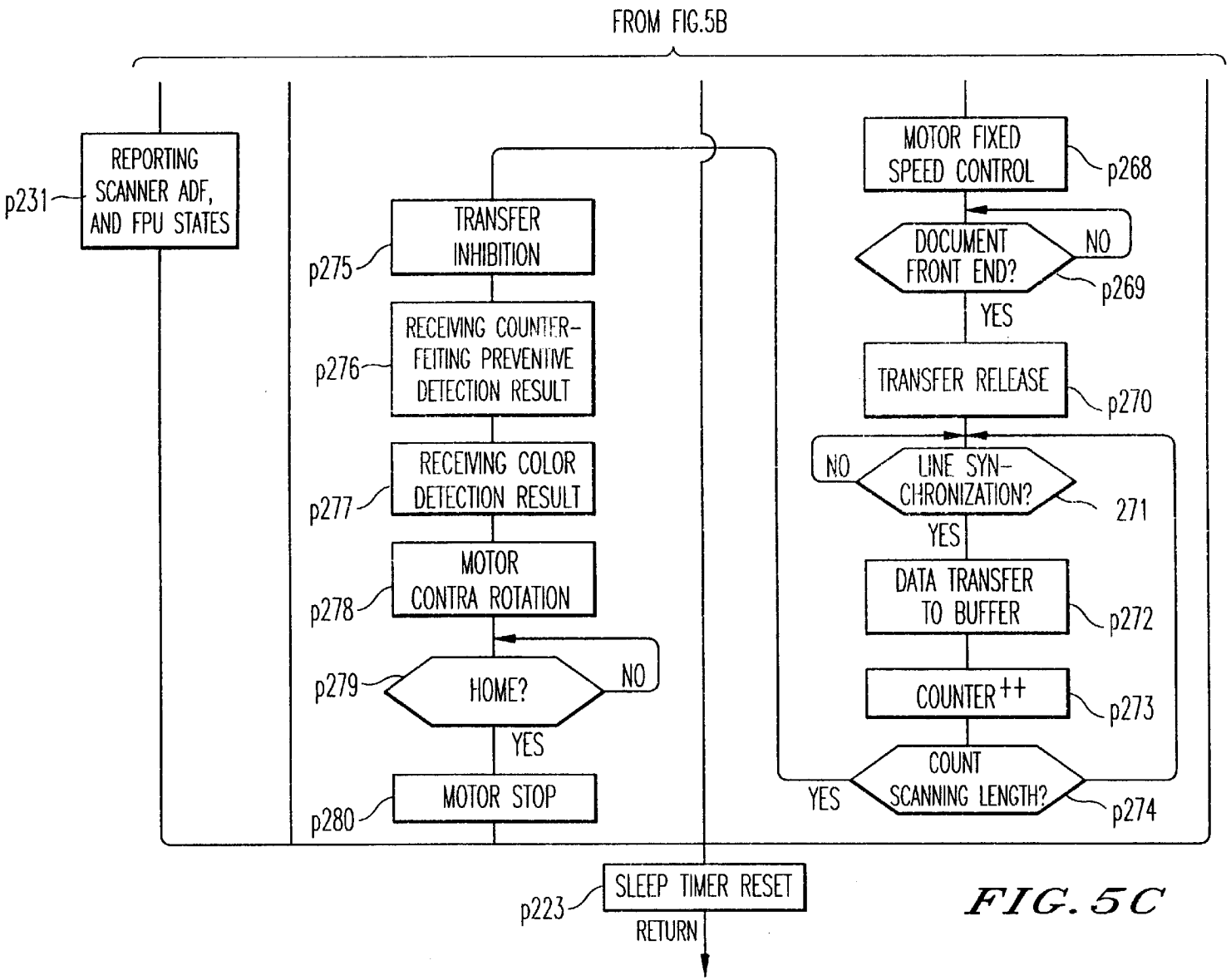

FIG. 5 is a flowchart illustrating actions of the first communication controller 230, and these functions are used in an execution of a program made by the microprocessor 230CPU shown in FIG. 3. The execution program is stored in the read only memory 230ROM. Step p201 indicates tuning on the power supply 201SW, while step p202 indicates an initialization processing, for example, an initial parameter setting for various circuit elements, a watchdog timer start, and moving the carriage 208 to an initial position (on the carriage home sensor 211). In step p203 processing, it is determined whether or not a command input from a terminal 202S1 or 202S2 is received in a predetermined time (time-out time). Step p204 indicates a function of turning off the document reading device 250 and decreasing a line voltage of the basic image processor 300 and the extended image processor 350 up to the limit at which data of registers in the circuit elements can be held, which contributes to a reduction of power consumption in a standby state and to a lowering noise of a cooling fan. Step p205 is activated when the watchdog timer deviates from a normal execution of a program, and at this time an error occurrence reporting function in step p206 reports the error to the system control module 600. Step p210 indicates an interrupt vector used when an error has occurred in the document reading device 250, the basic image processor 300, or the extended image processor 350, and step p211 is used to specify an error site portion and to analyze a cause of the error, and step p212 is used to report the errors to the system control module 600. Step p213 is used for fail-safe processing in order to prevent a fire or other risks, for example, when the document scanning motor 210 has a heating error.

Step p220 indicates an interrupt vector used when information is entered into the SCSI terminal 202S1 or 202S2, and a sleep timer is halted at this time by using step p221. Step p222 is used to check the contents of a reception and then sends the contents to one of five types of branches. First, there is a path used when there is an inquiry whether or not the scanner module 200 can start scanning of a document in TEST (TESUT unit ready) of step p230, and step p231 is used to make a response of scanner module preparation conditions including optional additional devices (the automatic document feeder 280 and the film projector 190 in FIG. 18).

A route of step p290 is used when self diagnosis (DIAG) is required for the scanner and is required after an error is reported by the error occurrence reporting functions in steps p206 or p212, and self diagnosis and its responding processing are performed in step p291 to step p293.

Step p240 is an inquiry SENS (mode sense) of various setting modes for the scanner module 200 and is used for making response of currently set scan modes of the scanner module including the optional additional devices 280 and 290 in step p241 to step p245 processing.

Step p250 is a path used for requiring various setting mode specifying SEL (mode select), being paired with above SENS. Various parameters are set in respective routines of step p251 to step p256.

Step p260 is a path used for requiring SCAN or COPY; generally there is one request per document for monochrome processing and one request for RGB processing in color processing, and there are four consecutive requests for CMYK processing. When this request is made, first the document scanning motor 210 is started in step p261, and subsequently in step p262 the carriage home sensor 211 monitors the first carriage 208 to detect its passing for a correcting operation of resetting a positional counter arranged in the read/write memory 230RAM. This counter is incremented by one by a synchronous pulse which the first synchronous signal generator 230SYNC generates once per scanning line. In step p263, a driving schedule of the motor 210 is calculated in order to achieve a steady state in which it reaches correctly the document image front end 202S after an elapse of t5 time counted from the previously received SCAN or COPY request and it has the scanning speed Vsub preset based on a mode specifying SEL (mode select) request.

Next in step p264, a shading correction white board 202SH is read and a shading correction parameter is calculated and set, so as to contribute to shading correction of subsequent image reading data. Subsequently, the solid identification braced board 202B is read in step p265 and a motor acceleration is controlled in step p267, and when it reaches a desired speed, the motor is switched to a low-speed control in step p268. In step p270, an entry gate of an image data buffer memory 230FIFO is opened to prepare for receiving an image signal transmitted from the basic image processor 300 through an image signal line 300D.

Subsequent step p271 to step p274 are a task group used for sending out document image data to the 230FIFO. First, in step p271, the first synchronous signal generator 230SYNC detects a synchronous pulse generated for every scanning line. In step p272, image data of 4,752 picture elements in a scanning line is stored in the 230FIFO through the image signal line 300D. At this time, the counter is incremented to the carriage position in step p273. In step p274, this loop is repeated the number of times equivalent to a document size, for example 6,720 times for an A3-size document based on 6,720 scanning lines. When scanning of a single document is completed, an entry gate of the 230FIFO is closed in step p275, a result of a report is received from the securities detecting circuit 330 in step p276, and a color detecting result is received from the color document automatic detecting circuit 320 in step p277. These information exchanges are performed via a bus 230BUS.

Next, the document scanning motor 210 is driven for contrarotation in step p278, a home position is detected in step p279, and the document scanning motor 210 is halted in step p280. In addition, a sleep time is started in step p223.

The extended image processor 350 includes two circuits shown in FIG. 1, an image region specification image processing circuit 351 and an image editing circuit 352. The extended image processor 350 is arranged nearby an outer periphery of the scanner module 200 so that it can be optionally built in the body according to a user request.

The region specification image processing circuit 351 has a function of performing image processing for a document image specific region specified by an operator different from image processing to be performed for other general regions. In addition, an image editing circuit 352 has various image processing functions such as, for example, right and left inverting function, mosaicing, solarization, posterization, high-contrasting, line imaging, and other special effect image formations.

As an example of the above processings, an image trimming processing will be described below as one of the region specification image processings. Image trimming is a processing of copying a specific region of a document image and blanking other parts. As its processing method, a known technology is used as disclosed in Japanese Non-examined Patent Publication No. 62-159570. According to the known technology, however, a felt pen mark recorded in an image to be subjected to image trimming is directly applied to a document, and therefore a damage of the document is a problem of this technology.

From a viewpoint of this problem, in this constitutional example, a document image is read by a prescan and is displayed on a display 820 of the console 800 (see e.g. FIG. 13), so that an operator specifies an input of a trimming range of an image using a cursor move key 813 and a decision key 814 while viewing the displayed image, and the region specification image processing circuit 351 blanks the entered region.

Referring to FIGS. 6 and 7, there is shown a schematic constitution of the printer module 400, and this module includes an image formation device 500, a second communication controller 430, a second power supply 401, and optional additional devices. The image formation device 500 is a name of an assembly of elements required for image formation such as a photoconductive drum 414, a first transferring device 416, an intermediate transfer body 415, and a second transferring device 417.

FIG. 7 illustrates a schematic constitution of the printer module 400. In FIG. 7, there are shown a commercial power plug 401P, a power switch 401SW, a second power supply 401, a circuit board on which a second communication controller 430 is mounted, SCSI connectors 430S1 and 430S2 having an identical shape and an identical interface on the second communication controller 430, optical fiber connectors for printer optional additional device communication 430F1,2, a laser optical device 440, a laser exposing device (e.g., laser diode) 441, an fθ lens 442, a rotary multi-plane mirror 443, a mirror 444, an automatic feeding cassette also used for double-sided copying 412A, a manual feed tray 412B, feed rollers 413A and 413B, a pair of register rollers 418R, pairs of carrying rollers 413F, 413G, 413H, and 413I, a photo-conductive drum 414, an intermediate transfer body (e.g., an intermediate transfer belt) 415, an intermediate transfer belt cleaner 415C, a first transferring device (e.g., a primary transferring corotron) 416, a second transferring device (e.g., a secondary transferring corotron) 417, a charger (e.g., a charging scorotron) 419, cyan, yellow, magenta, and black developing devices 420C, 420M, 420Y, and 420K, a revolving type developing apparatus 420 as a developing unit configured as an assembly of the developing devices, a cleaner 421, a carrying belt 422, a fixing roller 423A, a fixing backup roller 423B, a discharging roller 424, a discharge switching roller 425, and an image front end position detecting device 426.

The composing elements of the image formation device 500 are those other than the commercial power plug 401P, the power switch 401SW, the second communication controller 430, and the connectors 430S1 and 430S2 for connection in the mechanical constitution of the printer module 400 in the above.

The printer module 400 forms and outputs a full-color visible image onto a transfer paper made of dot patterns in a recording dot density of, e.g., 1/16 mm or 1/24 mm relating to respective C, M, Y, and K colors for both of the horizontal scanning and the vertical scanning based on 2-bit recording data in a picture element density 1/16 mm or 1/24 mm for both of the horizontal scanning and the vertical scanning relating to respective C, M, Y, and K colors input in the second communication controller 430. A dot selection of the recording dot density 1/16 mm or 1/24 mm is previously specified by a mode selection command. The default can be, e.g., dot density 1/16 mm.

In the above constitution, after starting an image formation cycle, first, the photoconductive drum 414 and the intermediate transfer belt 415 are rotated counterclockwise and clockwise, respectively, by a photosensitive body driving motor 414M. Together with a rotation of the intermediate transfer belt 415, a C toner image, a M toner image, a Y toner image, and a K toner image are formed, and finally a toner image is formed by superposing the C, M, Y, and K toner images on the intermediate transfer belt 415 in this order.

The C toner image is formed as described below, as one example. First, the charging scorotron 419 charges the photo-conductive drum 414 to a negative charge of, e.g., −700 V uniformly with corona discharging. Next, the laser diode 441 of the laser optical device 440 performs a raster exposure based on a C signal. A recording signal for image formation is supplied from the scanner module 200 in a general copy mode or from the system control module 600 in a special mode such as a copy mode or a facsimile mode including intelligent image processing. A data request signal REQ, "Transmit recording data after a fixed period of time", is previously issued to the scanner module 200 in the copy mode or to the system control module 600 in the printer mode or the facsimile mode.

The recording signal is entered from an SCSI terminal, 430S1,2 of the second communication controller 430 and a laser driving circuit 441D, which is a recording control circuit, controls a light emission of the laser diode 441 in units of an input picture element based on the recording signal. The recording signal is a 2-bit signal per picture element. More specifically, laser light is emitted by an amount equivalent to all the horizontal scanning width for the highest C density picture elements, there is no light emission for white picture elements, and light is emitted for a time period which is proportional to density data for a moderate density signal.

When a raster image is exposed to light in this manner, charges proportional to the exposure light amount are lost in the exposed portions on the photo-conductive drum 414 which has been uniformly charged in the initial stage, by which an electrostatic latent image is formed.

Toner in the developing devices of the revolving type developing apparatus 420 is charged to the negative polarity by a stir with a ferrite carrier, and the cyan developing roller of the C developing device 420C is biased to a potential of a negative DC potential and an AC potential is superposed by a power supply (not shown) to a metallic substrate layer of the photo-conductive drum 414. As a result, toner is not attached to portions where charges are left on the photo-conductive drum 414 while C toner is absorbed into portions where no charges are left, in other words exposed portions, by which a C visible image is formed having a similar shape to the latent image.

In this manner, when the C toner image formed on the photo-conductive drum 414 is rotated counterclockwise so as to reach a position opposite to the primary transfer corotron 416, the photo-conductive drum 414 is put into contact with the photoconductive drum 414 for a corona transfer onto the intermediate transfer belt 415 which is driven at a synchronous speed. Remaining toner which has not been used for the transfer on the photo-conductive drum 414 after the transfer is cleaned by a cleaning apparatus 421 in preparation for using the photo-conductive drum 414 again. The toner collected by the cleaning apparatus 421 is stored in a waste toner tank (not shown) via a collection pipe.

For the above intermediate transfer belt 415, materials having a relatively great specific resistance value are used in order to maintain image carrying characteristics for a long time which is often required particularly in the printer mode. This allows the intermediate transfer belt 415 to carry toner without disturbing a toner image even for a long time such as, for example, 20 minutes up to the next M toner image formation.

Next, a M toner image is formed based on a M signal. Prior to raster exposure for the M toner image formation, the revolving type developing apparatus 420 is rotated counterclockwise, so that the M developing roller of the M developing device 420M is brought to a position opposite to the developing station of the photo-conductive drum 414. Subsequently, the beginning position of the previously formed C visible image is detected by the image position detecting device 426 which is the front end detecting device, and a request signal REQ, "Transmit a record M image data after a predetermined time period", is issued again to the scanner module 200 in the copy mode. This request signal is issued when detecting a registration C toner mark image appended slightly forward of the valid C image in the previous process by the image front end position detecting device 426. Naturally, however, it is possible to use a method in which the image front end position detecting device 426 detects a permanent mark which has been previously appended to the intermediate transfer belt 415 instead of the C toner mark image to issue the request signal.

If a M signal is sent accurately in synchronization with this request signal, a M image is subjected to an exposure, a development, and a primary transfer, and then color print matching on the previously formed C image is performed, in other words, a M toner image is accurately superposed on the C toner image on the intermediate transfer belt 415. In this manner, when a M raster image is exposed to light, the exposed portions on the photoconductive drum 414 which has been uniformly charged in the initial stage loses charges at an amount which is proportional to the exposure light volume, by which an electrostatic latent image is formed.

The M toner in the M developing device of the revolving type developing apparatus 420 is charged to the negative polarity, and the developer on the developing roller of the M developing device 420M of this revolving type developing apparatus 420 is put into contact with the photo-conductive drum 414 and is biased to the same potential as for the C development. As a result, the M toner is not attached to portions where charges are left on the photoconductive drum 414 while M toner is absorbed into exposed portions based on the M signal, by which a M visible image is formed having a similar shape to the latent image.

In the same manner, a Y image is formed on the same image as for the C and M images and a K image is formed on the same image as for the C, M, and Y images so that they are superposed. The basic image processor 300 performs UCR (under-color removal) processing, and therefore one picture element is hardly developed with all the four toner colors.

As mentioned above, a full-color image formed on the intermediate transfer belt 415 with at least four rotations is subsequently moved with a rotation to the secondary transfer site portion in which the secondary transfer corotron 417 is arranged.

On the other hand, when an image formation is started, the recording medium 190 is fed and carried by a feeding or carrying action of the feeding rollers 413A and 413B or the pair of carrying rollers 413F from one of three feeding sections, in other words, the cassette 412A, the manual feed tray 412B, and an external feeding outlet 412C, and the recording medium 190 is then put into a standby state in a nip between a pair of register rollers 418R After that, when a front end of the toner image on the intermediate transfer belt 421 begins to pass the secondary transfer corotron 417, the register rollers 418R are driven so that a front end of the transfer paper 190A matches a front end of this image, for example, for registration between the transfer paper 190A and the toner image.

In this manner, the transfer paper 190A passes under the secondary transfer corotron 417 connected to the positive potential power supply with being superposed on the toner image on the intermediate transfer belt 415. At this point, the transfer paper 190A is charged by positive charges with corona discharging current, by which almost all of the toner image is transferred to the transfer paper 190A. Subsequently, the transfer paper 190A discharges when passing a discharging device, e.g., a charge removing needle (not shown) connected to a ground source which is shown slightly leftward of the secondary transfer corotron 417, which removes an adsorbability almost completely between the intermediate transfer belt 415 and the transfer paper 190A. When a tare weight of the transfer paper 190A exceeds the adsorbability of the intermediate transfer belt 415, the transfer paper 190A peels off the intermediate transfer belt 415 and is passed to the carrying belt 422.

The transfer paper 190A on which the toner image is formed is carried to the fixing apparatus 423 by the carrying belt 422. Heat and pressure are applied to the transfer paper 190A which has been carried to the fixing apparatus 423 in the nip portion between a heated fixing roller 423A and a backup roller 423B, and then fluxed toner cuts into fibers of the transfer paper 190A by which the image is fixed and a full-color copy is obtained. This copy is discharged outside of the apparatus body by a pair of discharging rollers 424 and then is stacked with its copy image facing upward on a discharge tray (not shown).

Toner on the intermediate transfer belt 415 which has not been transferred to the transfer paper 190A is removed from the intermediate transfer belt 415 by the intermediate transfer belt cleaner 415C.

Figure 8:
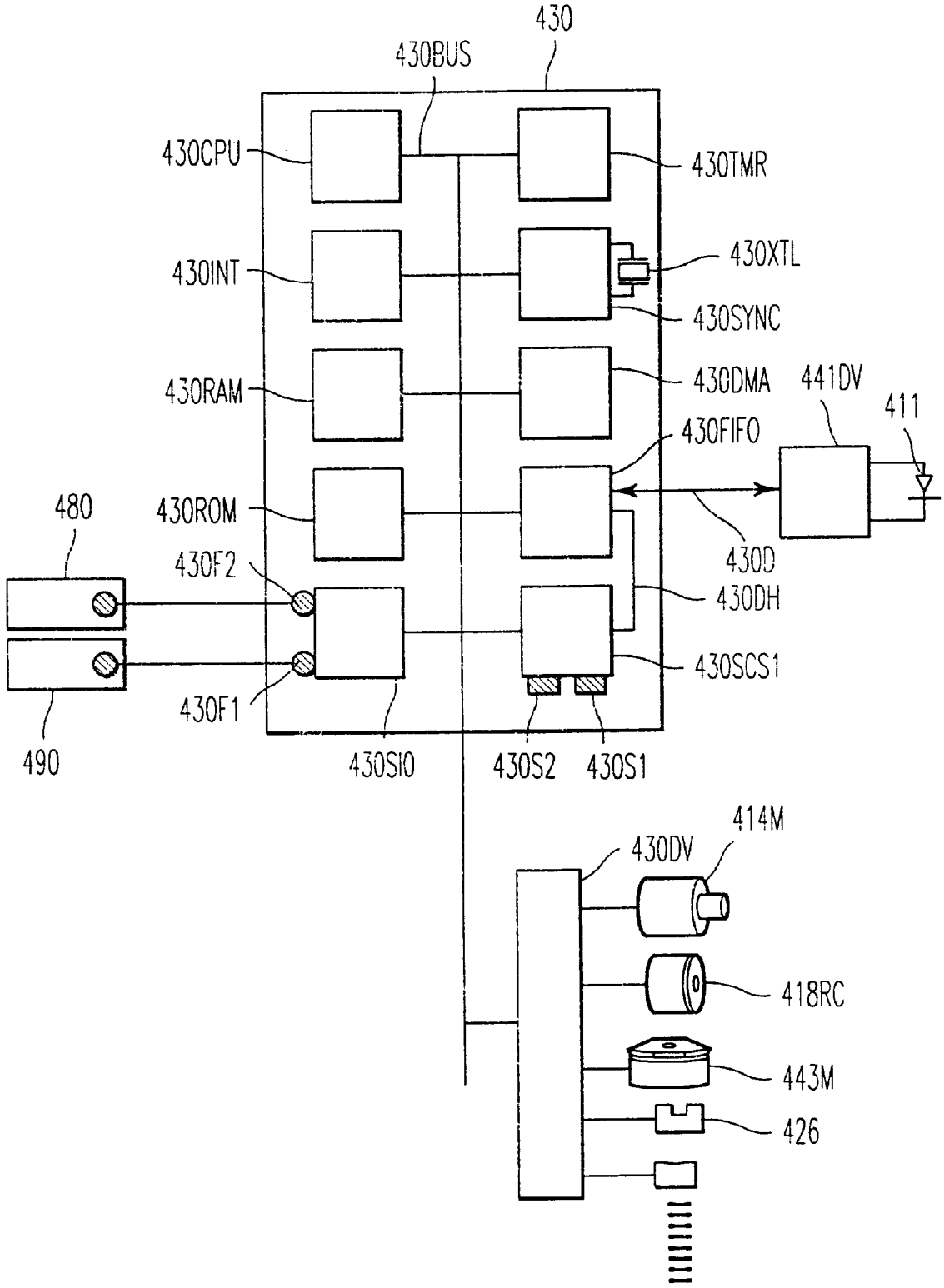
FIG. 8 is a diagram illustrating a second communication controller of a printer module.

A constitution of the second communication controller 430 is shown in FIG. 8. In FIG. 8, there are shown a microprocessor 430CPU, a read/write memory 430RAM, a read only memory 430ROM, an interrupt controller 430INT, a timer counter 430TMR, a serial communication unit 430SIO, a second synchronous signal generator 430SYNC, a second crystal oscillator 430XTL, a DMA controller 430DMA, a first-in first-out memory 430FIFO, an SCSI controller 430SCSI, a bus 430BUS, and a data channel 430DH.

In addition, for connection to the bus 430BUS of the second communication controller 430, there are input-output circuit 430DV for a sensor or a motor and a driving circuit 441DV for the laser 441.

The second communication controller 430 communicates with the system control module 600 or the printer module 400 in a predetermined protocol and basically obtains image data in units of a horizontal scanning line, forms an image by controlling all the elements in the modules based on a specified print mode with cooperation and energizing, and outputs a final image to the transfer paper 190A. In addition, second communication controller 430 controls a sorter 490 integrally which is optionally added to the printer module 400.

In a color print mode, a plane sequential image formation system is applied in which planes of respective C, M, Y, and K colors are formed and then superposed on the intermediate transfer belt 415 before being transferred to the transfer paper 190A so as to be a final image. Accordingly, in the color copy mode, a scanning request is output four times for a print sheet to the system control module 600 or the scanner module 200. In the color image formation, it is important to ensure a position precision (registration) of a color print on the intermediate transfer belt 415, and a method of achieving it is described below with reference to FIG. 9.

Figure 9:
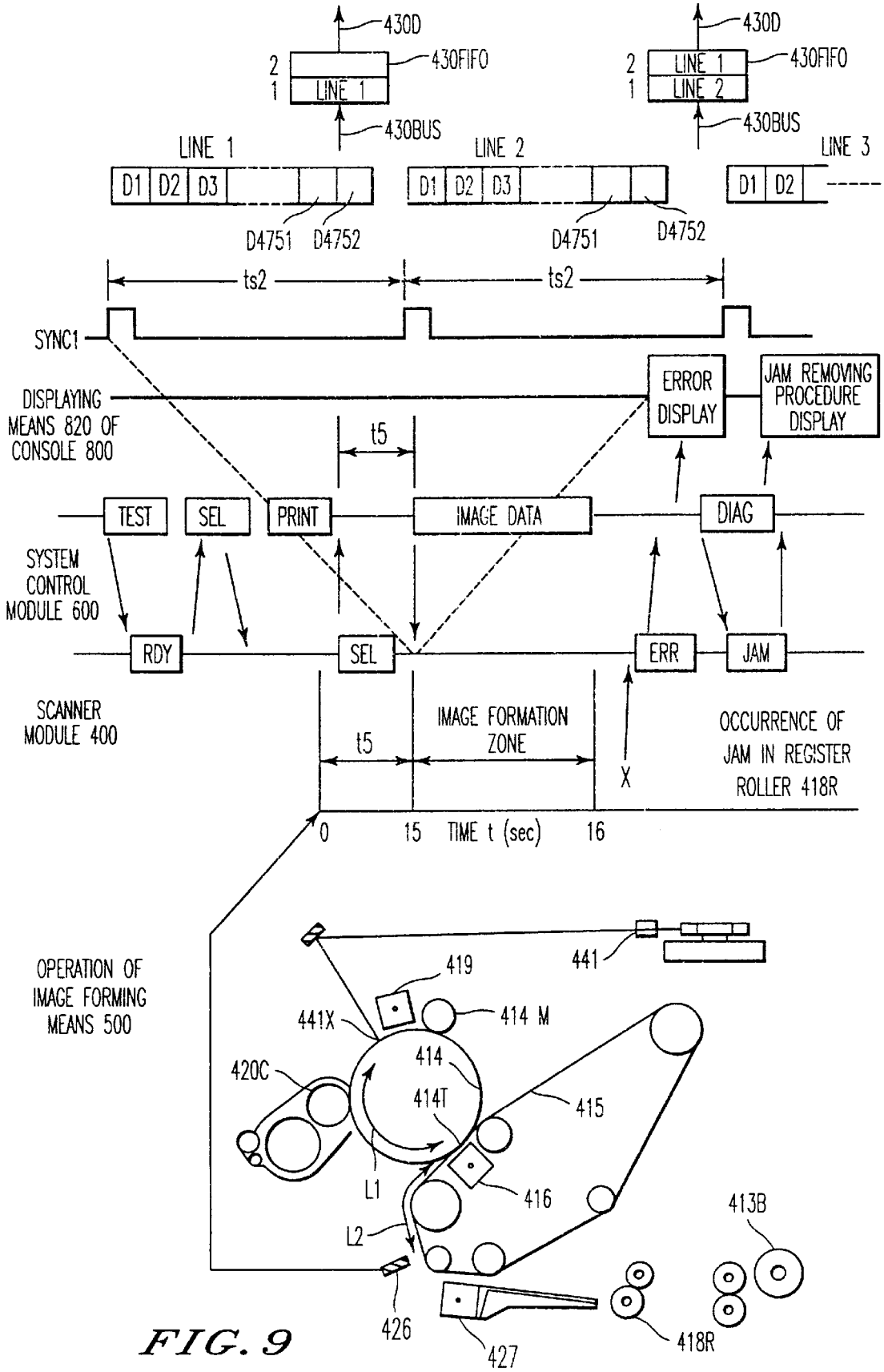
FIG. 9 is a timing chart of an operation of a printer module.
Figure 10A:
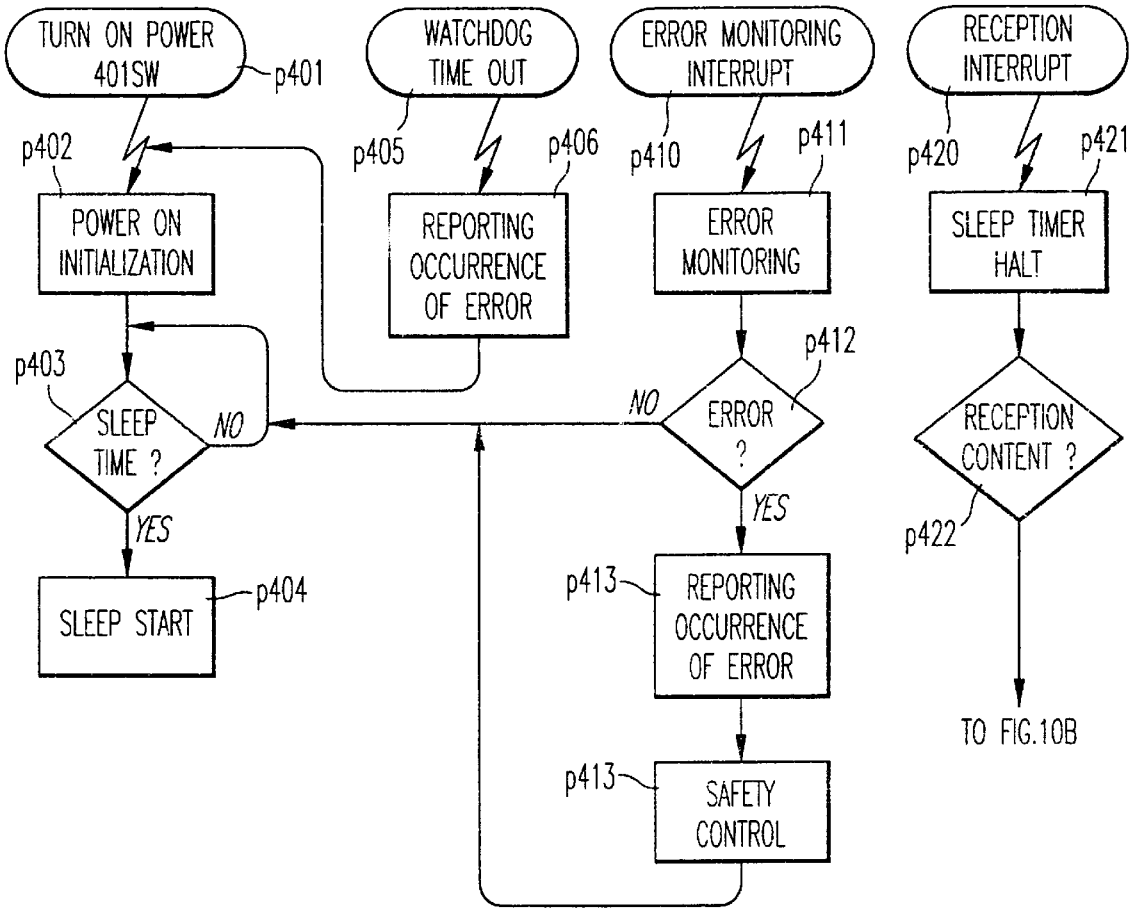
FIG. 10 is a flowchart of an operation control of a printer module.
Figure 10B:
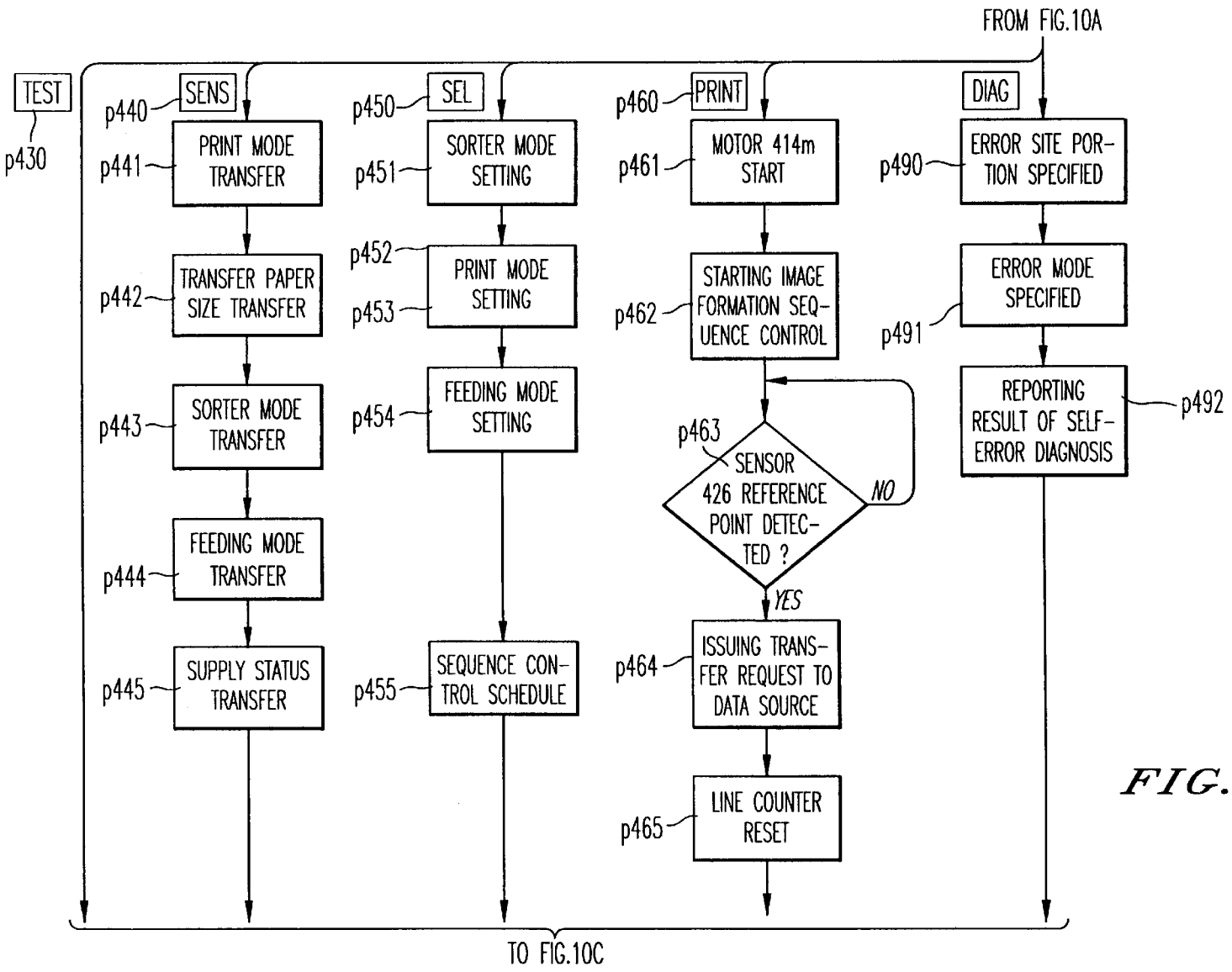
Figure 10C:
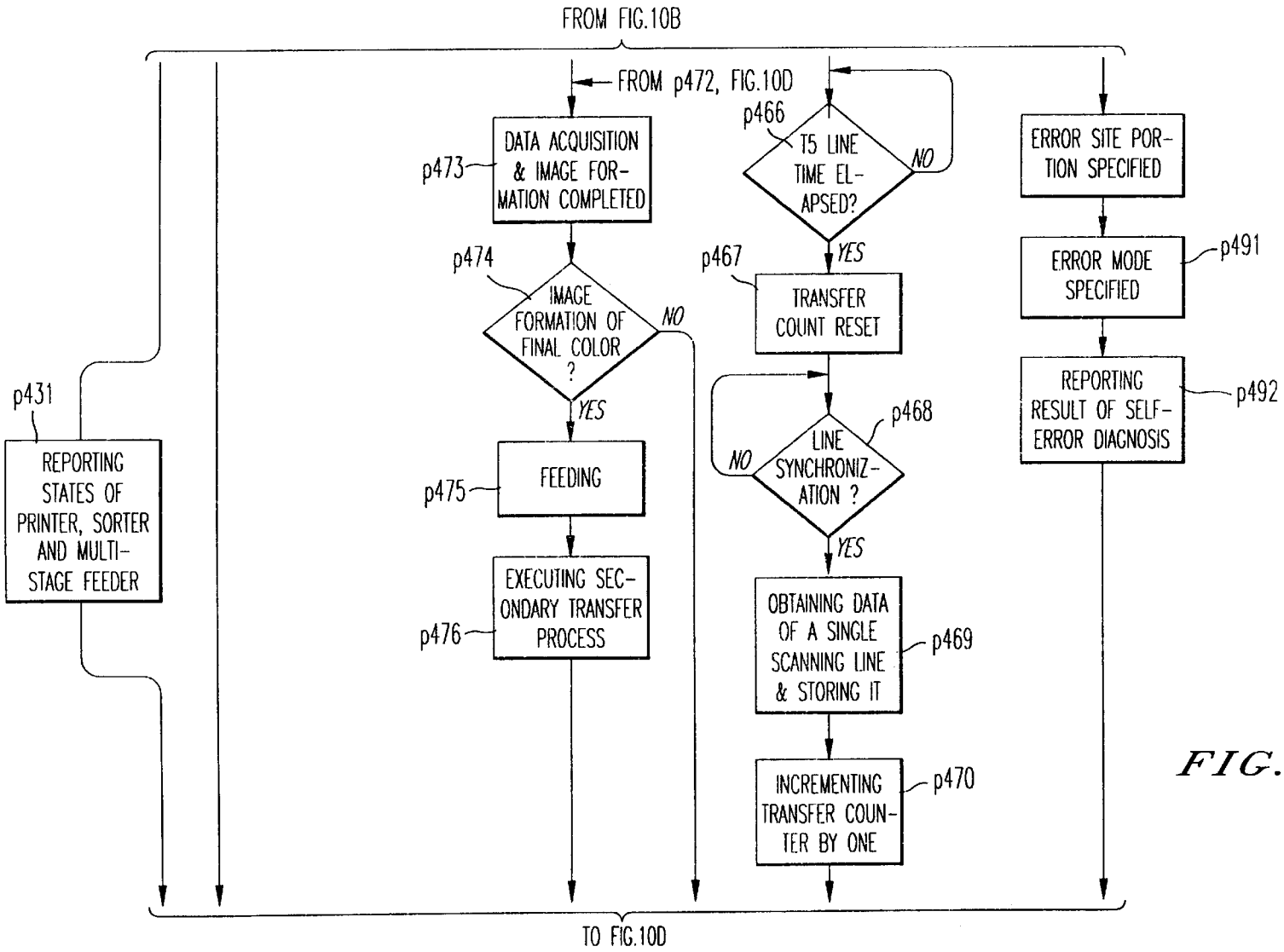
Figure 10D:
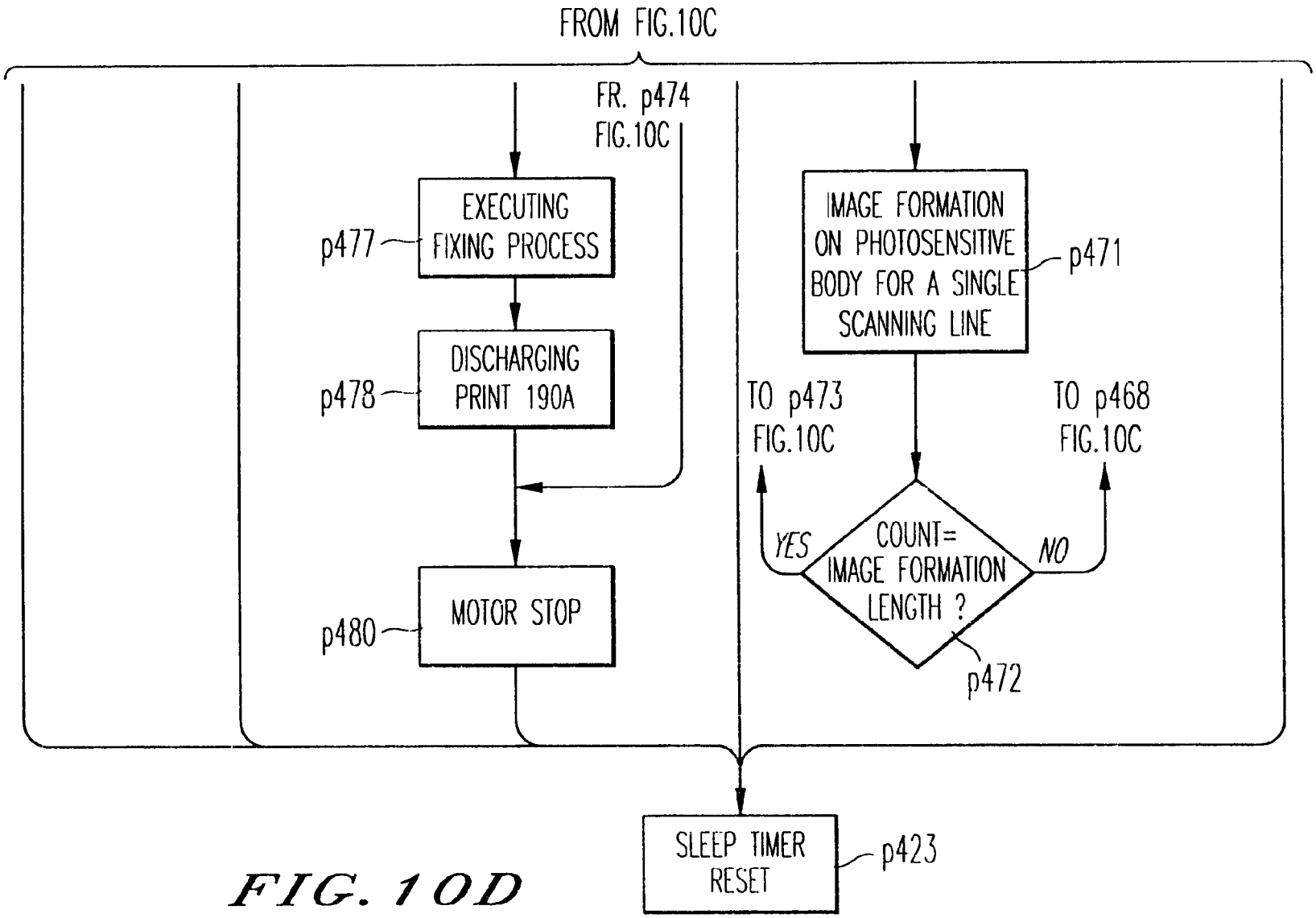

Referring to FIG. 9, there is shown a synchronization of an image signal for a single time, first of all illustrating a system in which a data request command REQ is transmitted at a certain time period t5 before an image data reception to the system control module 600 or the scanner module 200. In a color image formation, a data request signal REQ may be issued at the time period t5 before a time point when the previous color print image front end is estimated to reach an exposing point 441X in the second and subsequent color print formations. In order to measure precisely the time when the head of the previous color print image is estimated to reach the exposing point 441X, the image front end detecting device 426 is arranged opposite to the intermediate transfer belt 415 in this image formation device. Basically, a value obtained by adding a product of a circumferential velocity Vpc of the photo-conductive drum 414 and t5 to a distance L1 from the exposing point 441X to the primary transfer point 414T is matched to a distance L2 from the primary transfer point 414T to a detecting position of the image front end position detecting device 426, and in the second and subsequent color print formations, a front end reference image of a color formed in the previous stage is detected and a data request signal REQ is issued simultaneously with the detection.

This fixed time preceding data request method is particularly effective for a data transmission source whose destination has a scanner having some quality and quantity such as the scanner module 200 and requires an adequate preparation time until image data is output.

In this manner, only by issuing a data request command REQ a certain time period t5 before an image data reception, the first scanning line data is prepared in the data generation side after an elapse of time period t5 based on the inter-module protocol as described in the section of the scanner module 200. This maintains a synchronization at least relating to a phase.

Next, in order to take a phase relating to a cycle, first of all recording data of a scanning line is received from the destination in synchronization with a pulse string cycle ts2 generated by the second synchronous signal generator 430SYNC and is input to the receiving buffer 430FIFO. In addition, the rotary multi-plane mirror 442 is driven in synchronization with the pulse string cycle ts2, specifically phase lock servo driving is applied, so that a mirror plane is changed to another at the cycle ts2. This causes a scan for exposure of the exposing point 441X of the laser 441 in a ts2 cycle on the photo-conductive drum 414. Naturally, during this scanning of the exposing point, the laser driving circuit 441DV controls the laser 441 by turning it on, e.g., 4,752 times in units of a picture element based on the image data D1 to D4752. In the copy mode, the scanner module 200 is put in the data transmission side so as to maintain the above synchronization mechanism. Accordingly, document image data is always obtained after a certain period of time since a command is received even if scanning is repeated many times for a document image, and a positional relationship (registration) between the transfer paper and the image is always maintained correctly so as to maintain the color print registration.

Referring to FIG. 10, there is shown a flowchart illustrating actions of the second communication controller 430, and these functions are used by program executions with the microprocessor 430CPU shown in FIG. 8. The execution programs are stored in the read only memory 430ROM.

Step p401 indicates turning on the power switch 401SW of the power supply, while step p402 indicates an initialization processing, for example, an initial parameter setting for various circuit elements, starting a watchdog timer, and moving the revolving type developing apparatus 420 to an initial position. In step p403, it is determined whether or not a command input from a terminal 402S1 or 402S2 is received in a predetermined time (sleep time). Step p404 indicates a function of turning off a heater power of the fixing device 423 to start a sleep mode, which contributes to a reduction of power consumption in a standby state. Step p405 is activated when the watchdog timer deviates from a normal execution of a program, and at this time an error occurrence reporting function step p406 reports the error to the system control module 600. Step p410 indicates an interrupt vector used when an error has occurred in the image formation device 500 or other element in this module, step p411 is used to specify an error site portion and to analyze a cause of the error, and step p412 is used to report the errors to the system control module 600. Step p413 is used for fail-safe processing in order to prevent a fire or other risks, for example, when the photosensitive body driving motor 414M has a heating error.

Step p420 indicates an interrupt vector used when information is input into the terminal 402S1 or 402S2, and a sleep timer is halted at this time in step p421. Step p422 is used to check the contents of a reception and then send the contents to one of five types of branches. First, there is a route used when there is an inquiry whether or not the printer module 400 can start scanning of a document in TEST (TESUT unit ready) of step p430, and step p431 is used to make a response of printer module conditions including optional additional devices 480 and 490.

A route of step p490 is used when self diagnosis (DIAG) is required for the printer module 400; typically it is required after an error is reported by the error occurrence reporting functions in step p405 or step p412, and self diagnosis and its responding processing are performed in step p491 to step p493.

Step p440 is an inquiry SENS (mode sense) of various setting modes for the printer module 400 and is used for making responses of mode settings of the printer module 400 including the optional additional devices 480 and 490 in step p441 to step p445 processing.

Step p450 is a path used for requiring various setting mode specifying SEL (mode select), being paired with above SENS. Various parameters are set in respective routines of step p451 to step p455.

Step p460 is a path used for requiring PRINT; generally there is one request for a single print for monochrome image processing, and there are four requests for full-color processing and two consecutive requests for secondary color mono-color processing. When one of these requests is made, first the photosensitive body driving motor 414M is started in step p461, and subsequently in step p462 the image formation sequence control is started, and in step p463 a detecting operation is monitored on the home sensor 426 as an image front end position detecting operation. When the home sensor 426 detects the front end of an image, step p464 is started immediately and a data transfer request signal REQ is output. In addition, a line counter (a scanning line counter) is reset which is arranged in the read/write memory 430RAM. This counter is incremented by one by a synchronous pulse which the second synchronous signal generating means 430SYNC generates once per scanning line.

Step p466 is a task of monitoring a time period required for preparing the first line data in a data transfer destination after the data transfer request signal REQ is issued, in other words, if there has already been an image having another color, a time period required for its returning to a position equivalent to the exposing point 441X in circulation. Immediately after an elapse of this time period, step p467 is used to make the second reset of the above line counter, to open an outlet gate of 430FIFO which is a buffer memory of the image data, and to prepare for passing a recording image signal to the laser driver 44IDV, which is a laser driving circuit, through the image signal line 430D.

Subsequently, step p468 to step p472 compose a task group used for storing recording image data received from the terminals 402S1 and 402S2 into the 430FIFO in units of a scanning line. First, in step p468, the second synchronous signal generator 430SYNC detects a synchronous pulse generated for every scanning line. In step p469, recording image data of, e.g., 4,752 picture elements in a scanning line is stored in the 430FIFO after the data is obtained from the terminals 402S1 and 402S2. At this time, the line counter is incremented in step p470, and image formation is executed in step p471. In step p472, this loop is repeated the number of times equivalent to a recording size, for example, 6,720 times for an A3-size transfer paper based on 6,720 scanning lines. When laser scanning of a sheet of transfer paper is completed, an outlet gate of the 430FIFO is closed in step p473 to cut the driving signal of the laser driver 441DV. Naturally, it is completed to receive recording image data from the terminals 402S1 and 402S2.

In step p474, it is checked whether or not the current image formation is the last color image formation of the final recording color image. Unless it is the final color, the remaining image formation sequence control is completed and the photosensitive body driving motor 414M is halted in step p480. If the final color image formation is completed, feeding, a secondary transfer, fixing, and paper output processes are executed as described in step p474 to step p478 and then a recording image 190B is discharged to the outside of the printer module 400.

The constitution of the system control module 600 is shown in FIG. 11 and its mechanism is shown in FIG. 12. The system control module 600 mainly includes an application controller 650 as a system controller, a console 800 composed of a key input 810 and a bit map display 820, a floppy disk drive unit 740, a magneto-optical memory or a CD-ROM drive unit 730, an IC card driver 745, a third communication controller 630, and an accelerated processor 750.

All of these devices are housed in a casing of the system control module 600 shown in FIG. 12. The casing of the system control module 600 has a mechanical configuration in which it can be connected to the top of printer module 400 through a connector (not shown).

Referring to FIG. 12, there is shown a vertical sectional view of the system control module 600, illustrating the console 800 with its operator panel arranged on the top being exposed and arranged in a front side of the casing so that the module can be operated even if the scanner module 200 is mounted on the system control module 600. Additionally, respective insertion faces of the record mediums such as the floppy disk drive unit 740, the magneto-optical memory or CD-ROM drive unit 730, and the IC card driver 745 are arranged in the front side taking into consideration an operator's convenience for use, while the SCSI connector of the third communication controller 630 is arranged at the back of the module.

The floppy disk drive unit 740, the magneto-optical memory or CD-ROM drive unit 730, the IC card driver 745, and other record medium drives are selected according to an aimed system configuration so as to be incorporated into the system control module 600.

Figure 13:
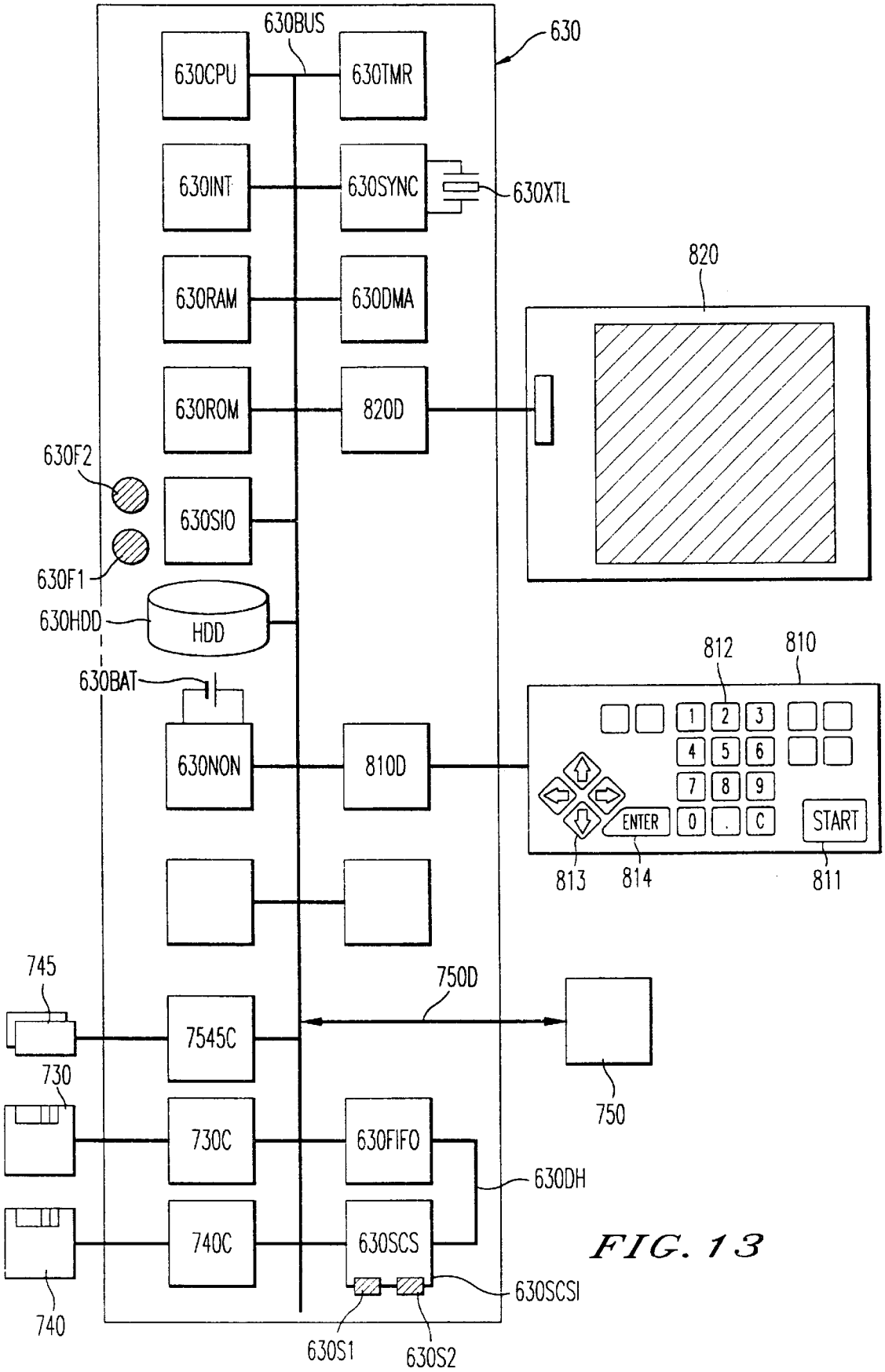
FIG. 13 is a diagram illustrating a third communication controller of a system control module.

The detailed constitution of the third communication controller 630 is shown in FIG. 13. In FIG. 13, there are shown a microprocessor 630CPU, a read/write memory 630RAM, a read only memory 630ROM, a nonvolatile memory 630NON, an interrupt controller 630INT, a timer counter 630TMR, a serial communication unit 630SIO, a synchronous signal generator 630SYNC, a crystal oscillator 630XTL, a DMA controller 630DMA, a first-in first-out memory 630FIFO, a SCSI controller 630SCSI, SCSI terminals 630S1 and 630S2, a bus 630BUS, a data channel 750D to an accelerated processor 750, and a magnetic disk drive 630HDD.

In addition, there are shown a console interface 810D, a controller 740C of a floppy disk drive unit 740, a controller 730C of a magneto-optical memory or CD-ROM drive unit 730, and a controller 745C of the IC card driver 745.

The first function of the third communication controller 630 is a control of at least one module of the scanner module 200 and the printer module 400 to an integral control of up to 7 modules, the second function is a control of the console 800 through an image display and a keyboard entry, and the third function is an operation of record mediums such as the floppy disk drive unit 740, the magneto-optical memory or CD-ROM drive unit 730, and the IC card driver 745.

As shown in FIG. 11, the third communication controller 630 includes an operating system 630CORE, library routines 630L1 to 630Ln, an application processing interface 630API, and a device driver 630DV. All these functional devices are used by an execution of a program stored in the 630ROM and the 630HDD utilizing hardware resources of the third communication device 630.

The first function of the device driver 630DV is a control of at least one module of the scanner module 200 and the printer module 400 to an integral control of up to 7 modules.

The second function is a control of the console 800 through an image display and a keyboard entry from a key device 810, and the third function is an operation of record mediums such as the floppy disk drive unit 740, the magneto-optical memory or CD-ROM drive unit 730, and the IC card driver 745. These types of control processings are appropriately started with a multitask real-time control management of the operating system 630CORE.

The application processing interface 630API is an interface with the application processor 650, and this application processor 650 serves as a window for using the third communication controller 630 and its related devices. The application processor 650 includes a copy processor 650CP, a facsimile processor 650FX, a print processor 650PR, and an intelligent image processor 650AI. All these processor share hardware resources of the third communication controller 630 and are used by an execution of a program stored in the 630ROM or the 630HDD.

The copy processor 650CP is used to achieve an image copy function by controlling an entire system integrally in the system in which the scanner module 200, the printer module 400, and this system control module 600 are connected with each other. The facsimile processor 650FX is used to achieve a facsimile function by controlling an entire system integrally in the system in which the scanner module 200, the printer module 400, and this system control module 600 are connected with each other. The print processor 650PR is used to achieve a printer function by controlling an entire system integrally in the system in which the scanner module 200, the printer module 400, and this system control module 600 are connected with each other.

The intelligent image processor 650AI is used to achieve an intelligent image processing function by controlling an entire system integrally in the system in which the scanner module 200, the printer module 400, and this system control module 600 are connected with each other. The intelligent image processor here performs image processing of forming an output image 190 significantly different from a document image 180 such as recognizing characters from an image read by the scanner module 200 and creating a graph base on the characters. In this intelligent image processor 650AI, unlike the general copy mode, image data is read into the system controller once and is then affected by an action of this intelligent image processor 650AI, and then processed image data is passed to the printer module 400 so that the image is formed.

Any of the above four types of the application processors are selected according to an aimed system constitution and then incorporated into the system control module 600.

Figure 14A:
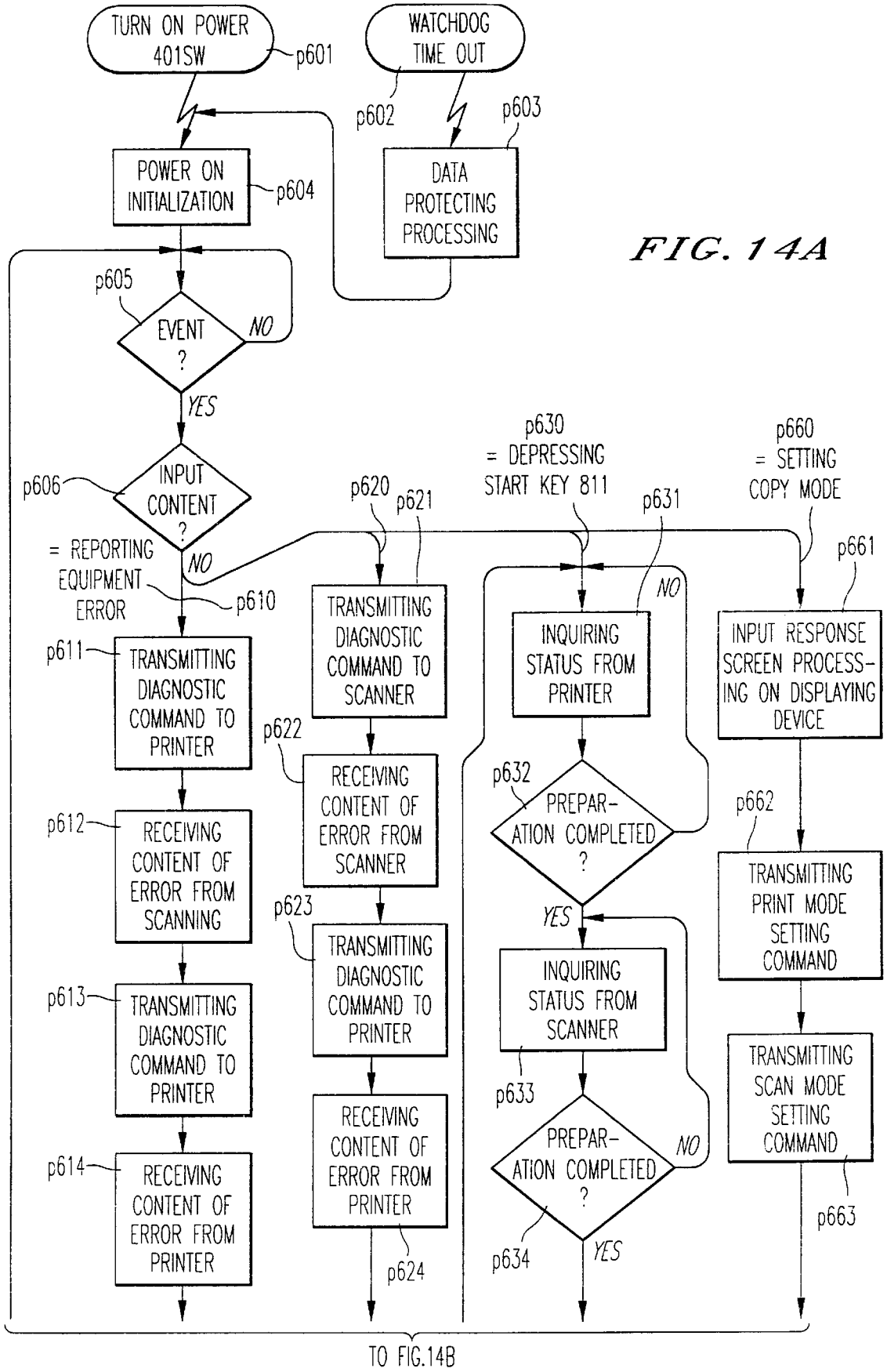
FIG. 14 is an explanatory diagram of actions of operations of a copy processor in a system control module.
Figure 14B:
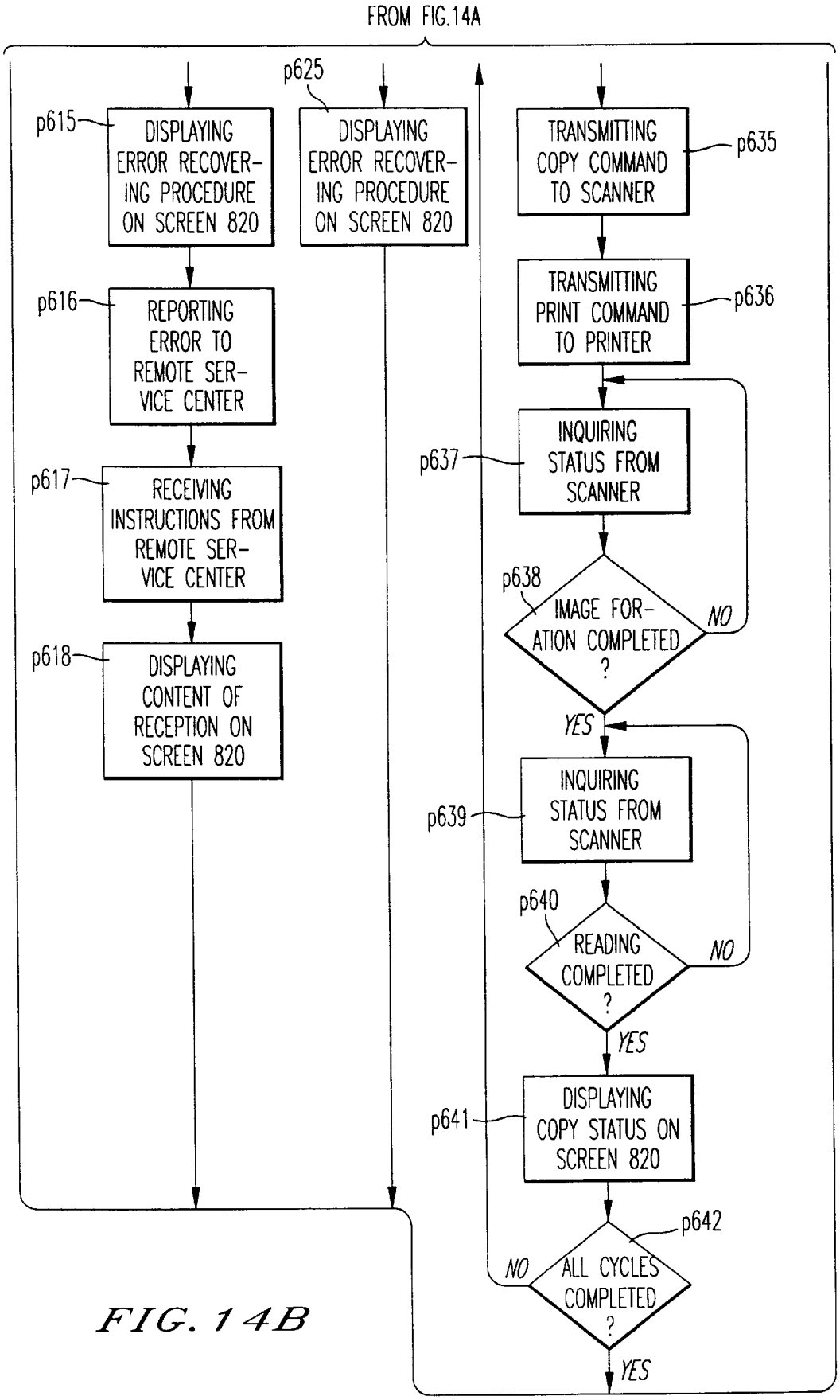
Figure 15:
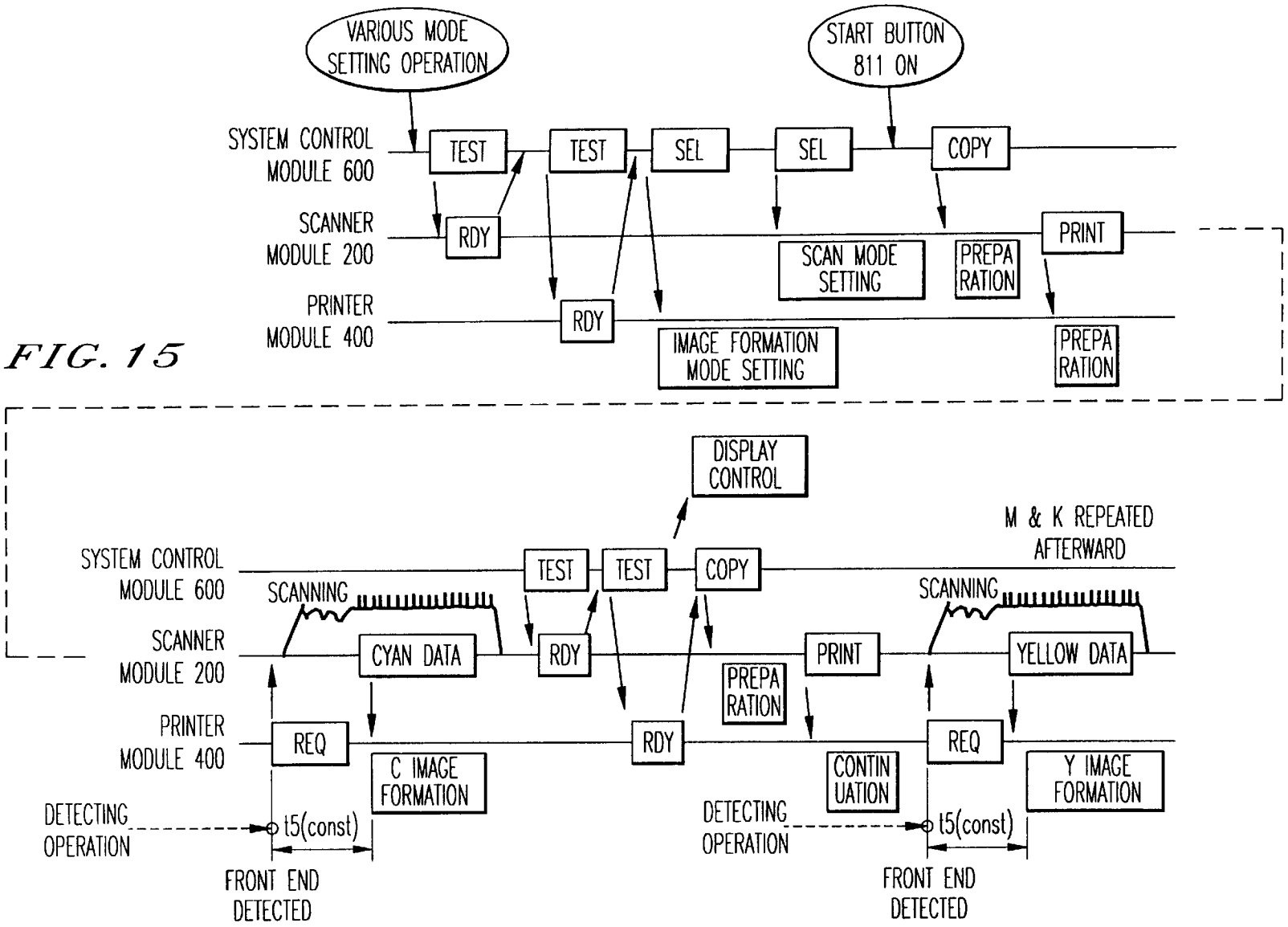
FIG. 15 is a timing chart of copy processing operations treated by a copy processor.
Figure 16:
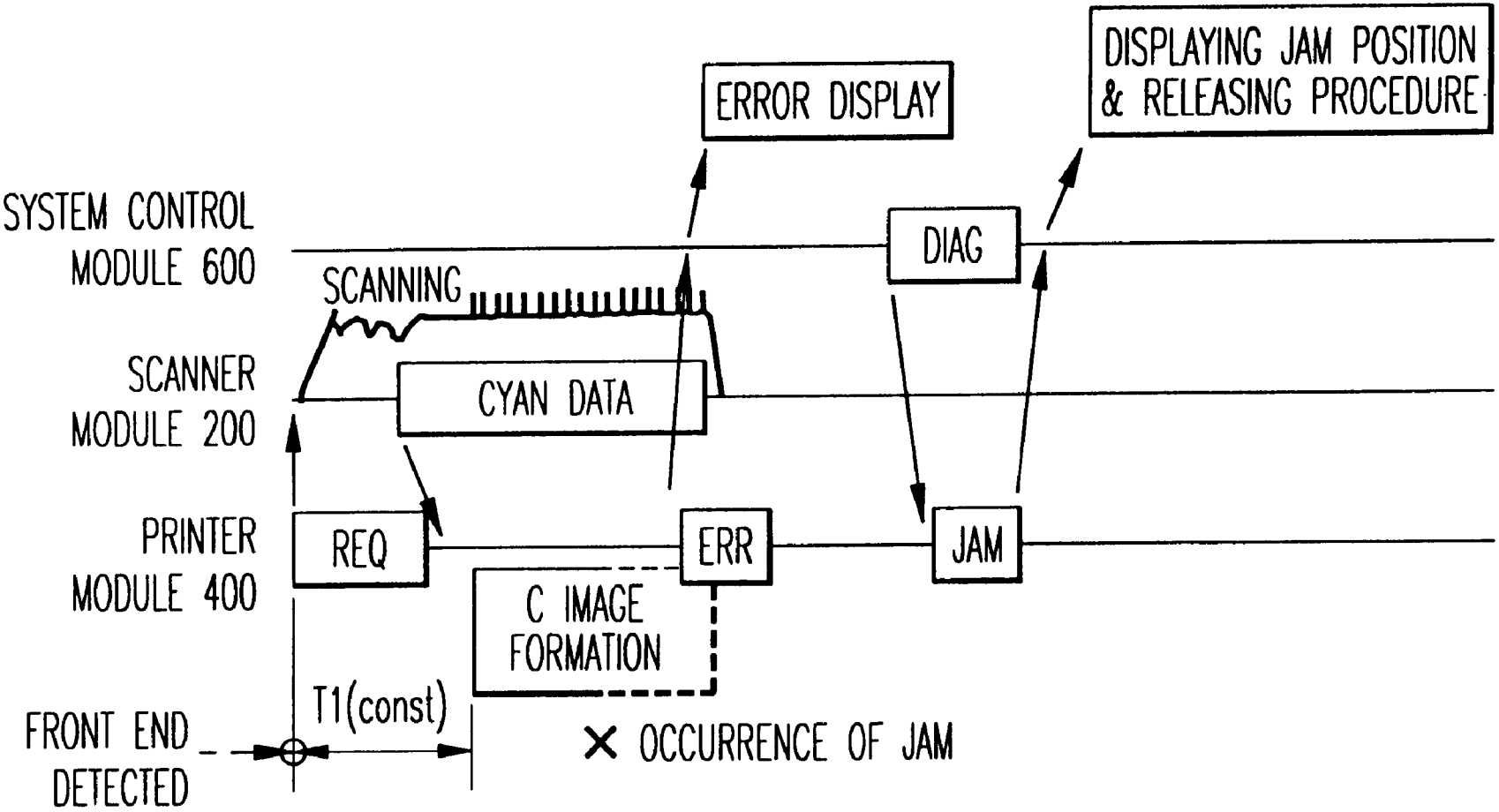
FIG. 16 is a timing chart at an occurrence of an error treated by a copy processor, FIGS. 17(*a*)–17(*e*) are block diagrams illustrating examples of various systems made of combined modules.
Figure 17A:
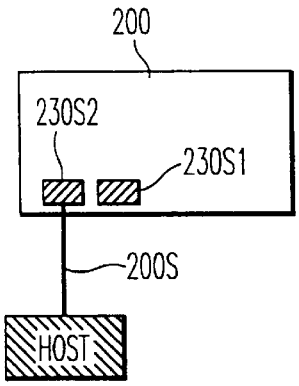
Figure 17B:
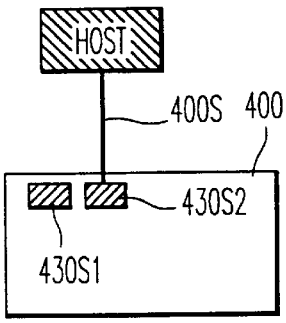
Figure 17C:
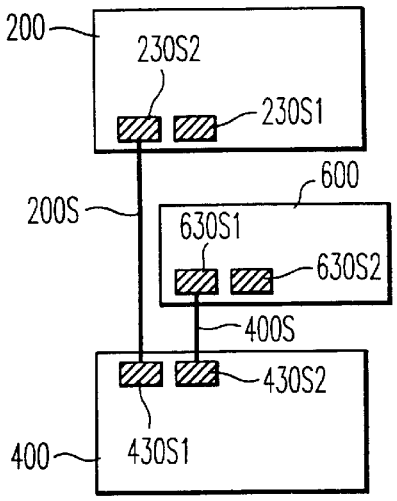
Figure 17D:
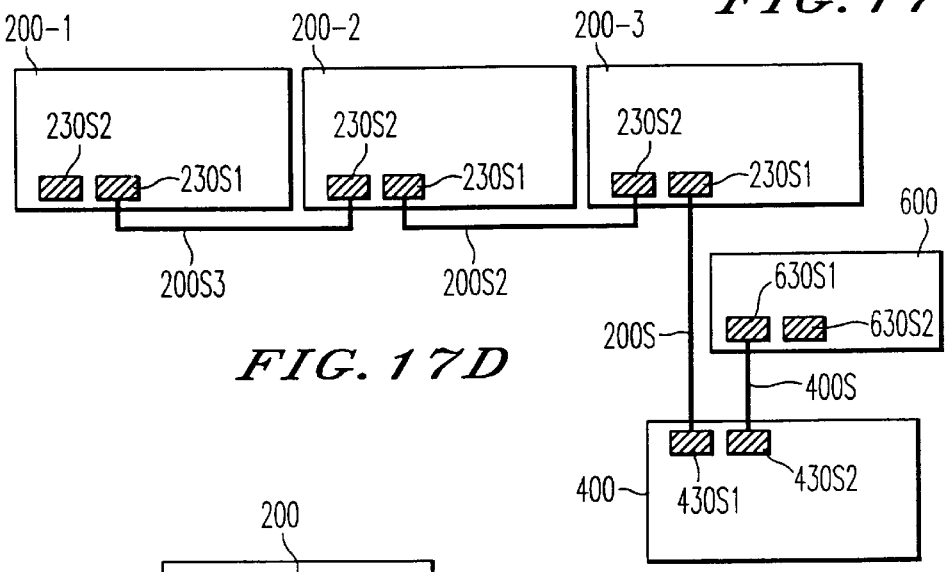
Figure 17E:
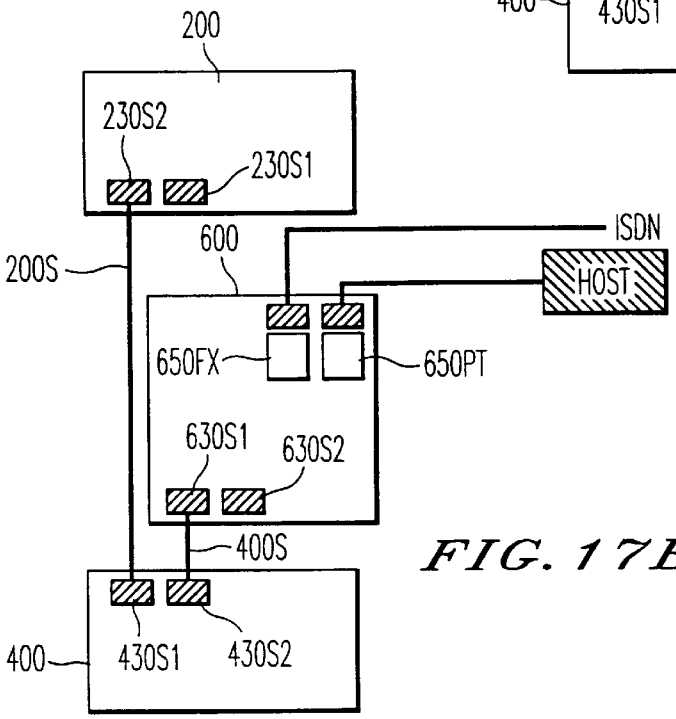

FIG. 14 shows a flowchart for an explanation of actions of the copy processor 650CP to achieve an image copy function in a system in which the scanner module 200, the printer module 400, and the system control module 600 are connected with each other, FIG. 15 shows a timing chart illustrating an operation timing of the copy processing, and FIG. 16 shows a timing chart for an occurrence of a failure during the copy processing operation.

In FIG. 14, step p601 is a start address at turning on the power supply of the printer module 400. The reason why the power supply of the printer module 400 is turned on here is that the system control module 600 is integrated with the printer module 400 so as to be powered from the printer module 400. In step p604, a parameter on various types of software such as, for example, an internal register of an interrupt controller 630INT is initialized. Step p602 is used to indicate that the watchdog timer enters a time-out state, by which protecting processing of data to be backed up, in other words, the data is saved to the 630NON and then the control branches to initialization processing. Step p605 is used for monitoring a presence or absence of various types of events and step p606 is used for checking the contents of various types of events to make jumps to four types of paths.

Step p610 is used to make a branch when receiving a report of an occurrence of a failure from the scanner module 200 or the printer module 400, and the contents are checked in step p611 to step p614. Step p615 is used to display a screen on a display 820 so that an operator understands the contents of the failure, and step p616 is used to report the information to a service center connected through a public circuit. Step p617 is used to receive a specification of a failure recovery procedure from the service center and it is displayed on a screen in step p618.

In step p620, a branch is taken when receiving a report of an occurrence of an abnormality from the scanner module 200 or the printer module 400. The abnormality indicates a status such as a short supply of toner, transfer paper, or the like, or an opened door of the casing, which can be easily shifted to a normal status by supplying the shortage or by closing the door, and the contents are checked in step p621 to step p624. In step p625, a screen is displayed on the display 820 so that the operator can understand the contents of the failure and a message on a recovering procedure to the normal status such as prompting a supply for the shortage is displayed on the screen of the display 820 of the console 800.

Step p660 is activated at a mode setting of various copy modes entered from the console 800 by an operator, for example, at a specification of an image processing mode or at a specification of a sort mode. A response screen is displayed on the displaying means 820 in step p661 and a mode setting command is transmitted to the printer module 400 and the scanner module 200 in step p662 and step p663.

In step p630, a branch is taken when a start button 811 is depressed, and an inquiry is made about the preparation conditions to the scanner module 200 and the printer module 400 in step p631 to step p634. If the two modules are ready to operate, a COPY command is issued to the scanner module 200 in step p635 and a PRINT command is issued to the printer module 400 in step p636. With this processing, the commands are exchanged between the scanner module 200 and the printer module 400, image data is sent or received in the procedure described in the module section, and then a copy is created. In step p637 to step p640, an inquiry is made as to whether or not the sequential image reading process and image formation process have been completed. At this point, the initial status is resumed and displayed on the screen of the display 820 in step p641. In step p642, it is checked whether all cycles are completed for the predetermined number of color prints or for the predetermined number of copies, and if remaining image formations are required, the control returns to the first step. In a color copy processing, this loop is repeated four times.

Referring to FIG. 17, there are shown diagrams illustrating examples of the system constitution in which three types of modules are combined with each other, giving examples of formations of various apparatuses useful in the industry. In FIG. 17, each rectangle indicates a functional block, a line between the rectangles primarily indicates an image signal, thick lines 200S and 400S indicate transmission lines of a control signal and an image signal between the modules, e.g. SCSI cables.

First, FIG. 17(*a*) shows a system which simply includes a scanner module 200, in which a first communication controller 230 is connected to a host computer HOST and the first communication controller 230 directly communicates with the host computer HOST to pass read image data, in other words, a system which serves as a scanner.

FIG. 17(*b*) shows a system which serves as a bit map laser printer using a printer module 400 singly. In this system, a second communication controller 430 directly communicates with the host computer HOST and image data is obtained from the host computer HOST to form a hard copy.

FIG. 17(*c*) shows a constitutional example of a general copying machine, including a scanner module 200, a printer module 400, and a system control module 600 connected with each other. In this system control module 600, the copy processor 650CP is incorporated so as to achieve a copying function by controlling other modules integrally.

FIG. 17(*d*) shows a triple reading copying machine, including a first scanner module 200-1, a second scanner module 200-2, a third scanner module 200-3, a printer module 400, and a system control module 600 connected with each other. If the first scanner module 200-1 is predetermined to be used as a general scanner module for an A3 form or the like and the second scanner module 200-2 is to be used as a color scanner module, for example, various advantages are expected in comparison with a situation of installing dedicated copying machines, respectively. In addition, combinations between the modules and the number of the modules can be arbitrarily changed according to a frequency of use. In this system control module 600, the multiple reading copy processor 650CP2 is incorporated so as to achieve a copying function by controlling other four modules integrally.

In FIG. 17(*d*), it is possible to arrange a plurality of printer modules 400, though the constitution is not shown. In this constitution, the multiple reading copy processor 650CP3 is incorporated into the system control module 600 so as to achieve a copying function by controlling other modules integrally. In this multiple system, e.g., seven scanner modules and printer modules can be concatenated.

FIG. 17(*e*) shows a complex system including a copying machine, an advanced functional printer, and a color facsimile, including a scanner module 200, a printer module 400, and a system control module 600. The system control module 600 contains the fourth communication device 680P connected to the host computer HOST, a print processing 650PT for converting print data in a page description language format received from the fourth communication device 680P to raster data, a fifth communication device 680F for connections to the public circuit ISDN, and a (color) facsimile processing device 650FX for expanding data in a predetermined compressed format which has been received from the fifth communication device 680F and for compressing document image data read by the scanner module 200 into the above predetermined format.

Figure 18:
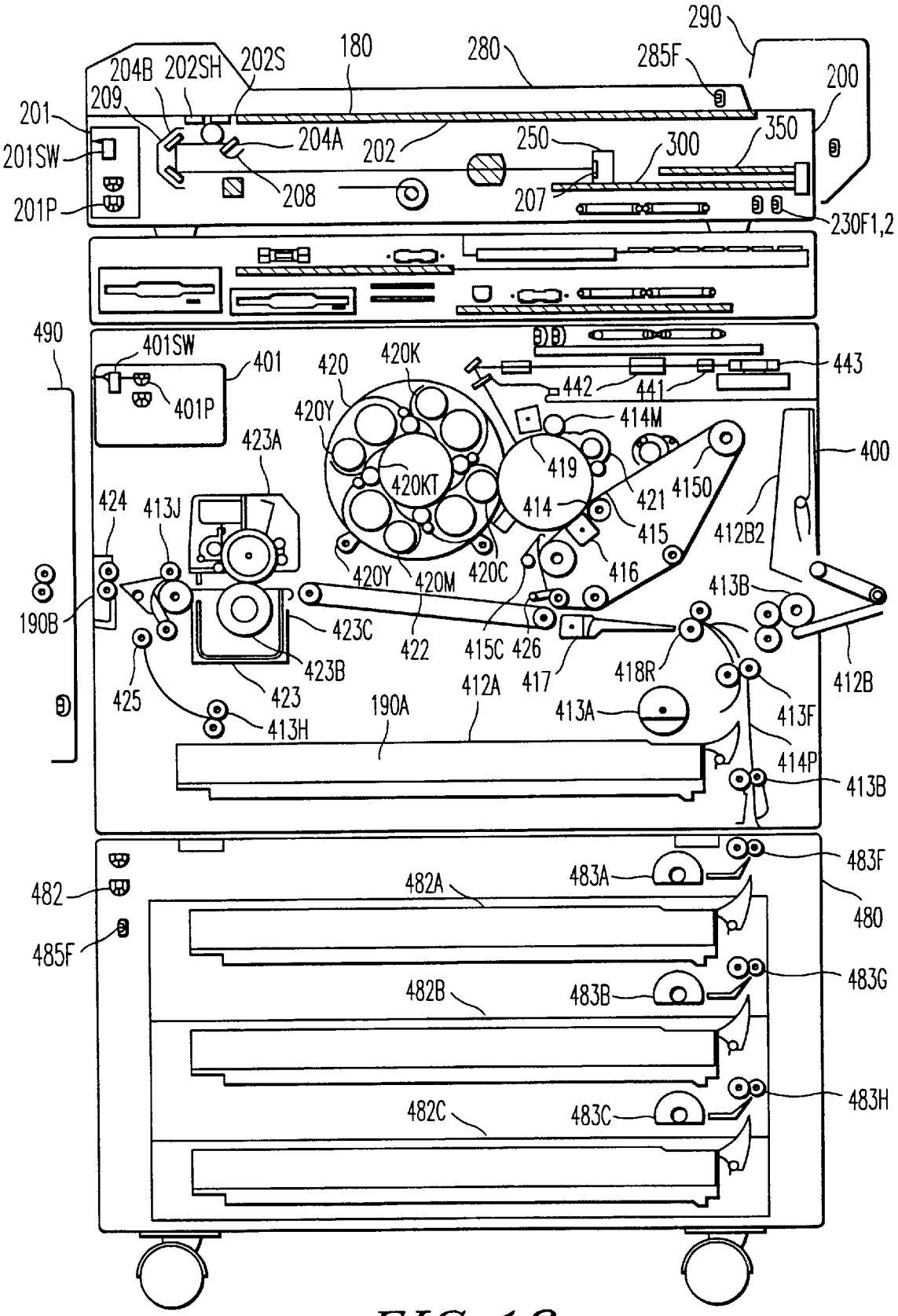
FIG. 18 is a schematic diagram explaining a specific mechanical face of modules configured as a copying system.

Hereinbelow, and see for example FIGS. 18 and 19, an image forming system is explained in detailed referring to the drawings. The system is explained in more detail than that explained referring to FIG. 17(*c*). The system includes additional modules including an auto document feeder (ADF) module 280 and a film projector module 290 beside the scanner module 200. A copysheet feeding apparatus 480 having a plurality of sheet cassettes 480 vertically disposed and a sorter 490 for sorting a plurality of copysheets when ejected from the image forming apparatus are additionally disposed to the printer module 400.

Figure 19:
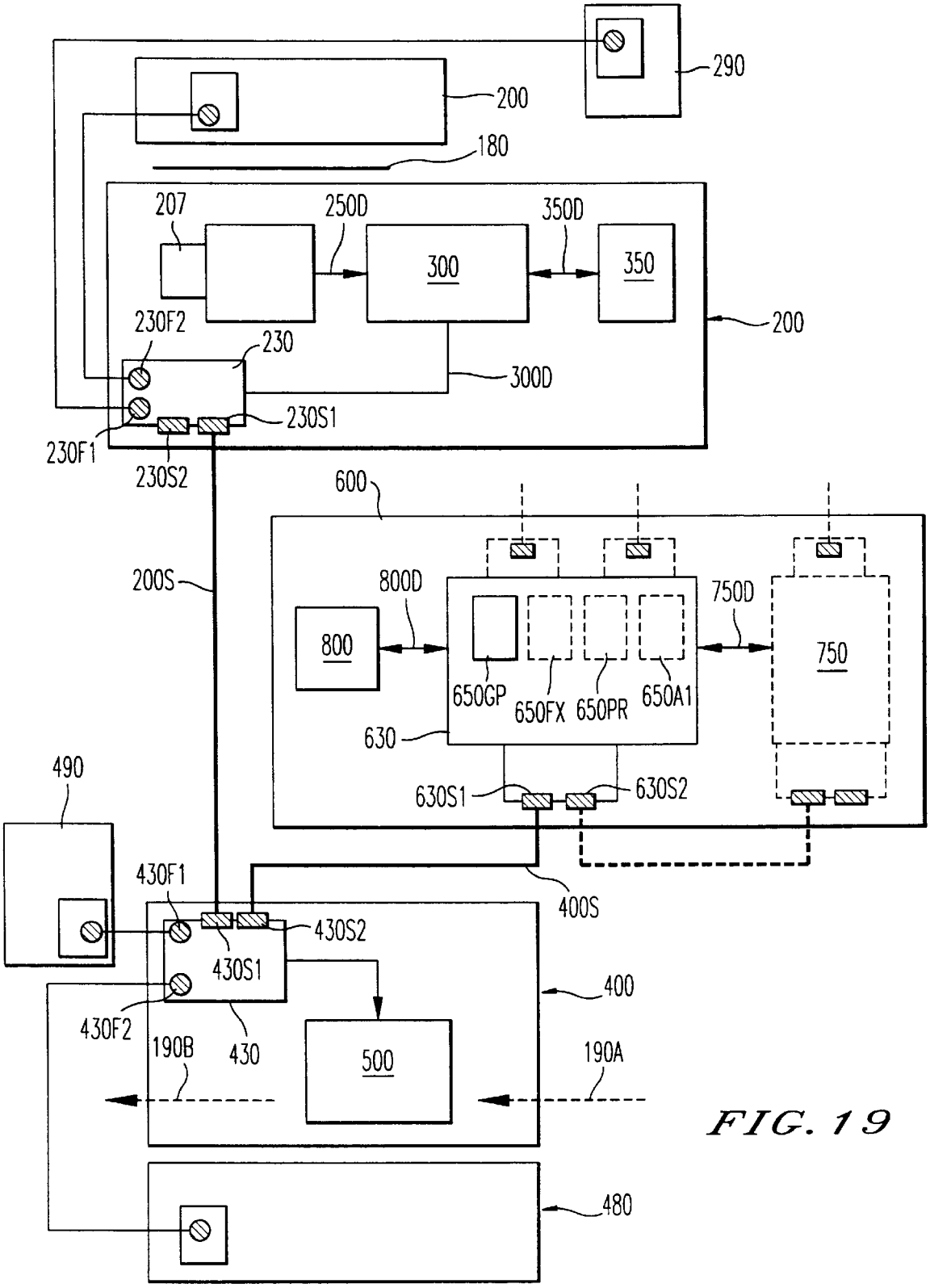
FIG. 19 is a block diagram illustrating a functional block of a copying system.

A plurality of blocks as illustrated by dotted lines shown in FIG. 19 indicate additional functions, an ADF, a sorter and so on, to be selectively added to the system. These functions can to be added to a system control module of an image forming system which a user is presently using. If all of the functions are added, the complex system as shown in FIG. 17(*e*) is constituted.

Figure 20:
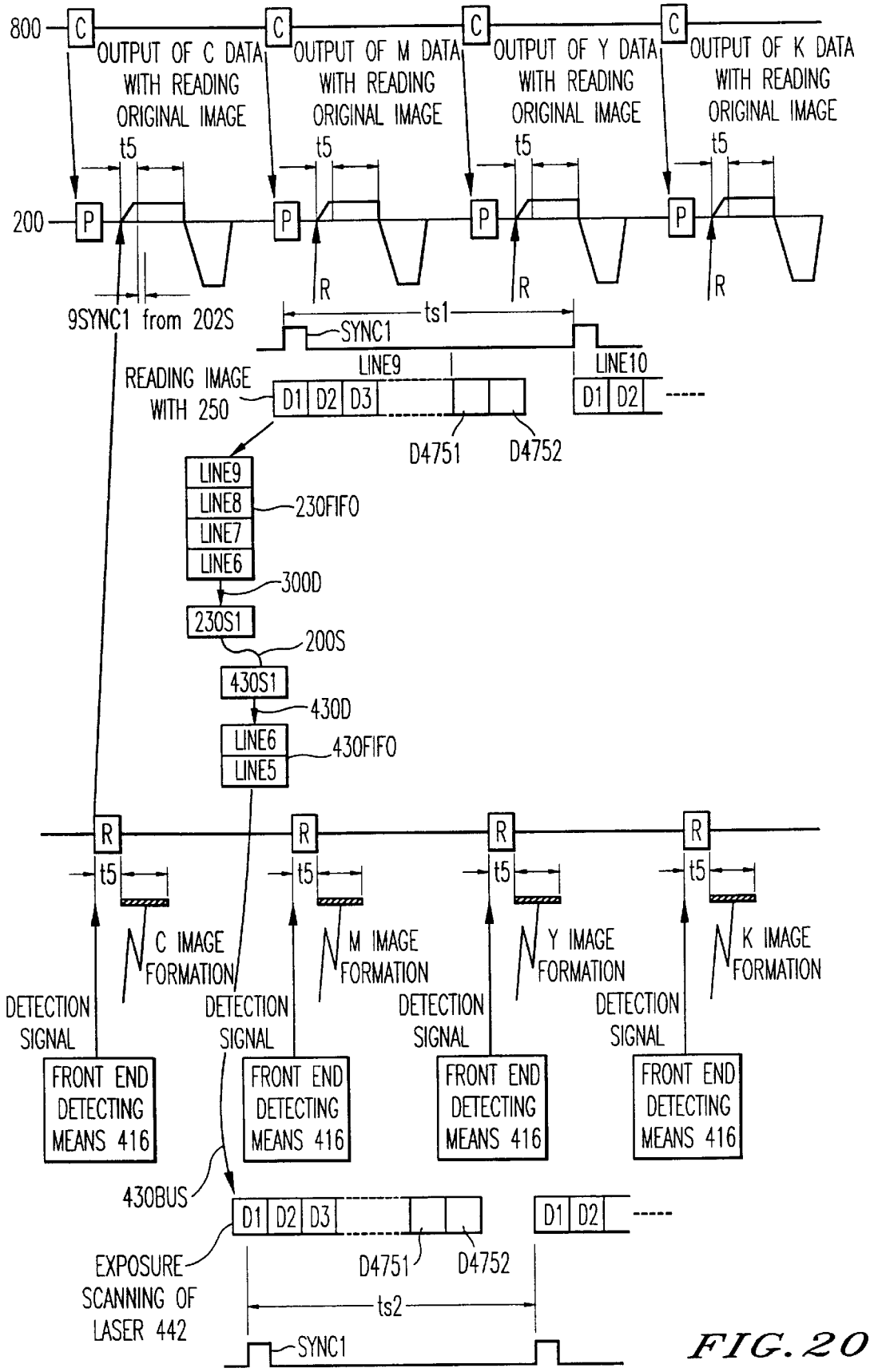
FIG. 20 is a timing chart illustrating an image synchronization timing of a copying system.

Hereinbelow, operations of a color image forming system are explained. A timing chart of the color image forming operation of the image forming system shown in FIG. 18 is illustrated in FIG. 20. Namely, operations of a system control module 600, a scanner module 200, and a printer module 400 are respectively illustrated therein. In FIG. 20, a letter C written in a square box indicates COPY, a letter P written in a square box indicates PRINT and a letter R written in a square box indicates REQ. When a first COPY command is sent from the system control module 600 to the scanner module 200, the scanner module 200 transfers the same as a PRINT signal to the printer module 400. When a leading edge detector 426 detects a mark put on an intermediate transfer belt 415, a second communicating control apparatus 430 sends a print data request signal REQ to the scanner module 200. At the same time, the printer module 400 resets and after that sets a counter to prepare to start counting down from a predetermined time interval t5 which corresponds to a time before the color image forming process is started. The scanner module 200 controls a carriage 208 to move to accord with the time interval t5.

When the time t5 has elapsed, the carriage 208 of the scanner module 200 arrives at a leading portion 202S of an image of the document and a portion on a photoconductive drum 414 of the printer module 400 corresponding to the leading portion 202S is positioned at an exposure point 441X. Then, the scanner module 200 outputs a plurality of image signals D1 through D4752 through a main scanning unit. The printer module 400 receives these signals and executes main scanning line by line based upon the signals, thereby forming a latent image of the document on the photo-conductive drum 414. A status in which the scanner 200 reads ninth lines of the image after synchronizing image signals start communicating as described above is illustrated in FIG. 20 at a middle portion thereof.

As shown in this middle portion, if an image buffer memory 230FIFO having a capacity for storing image information of 4 lines is employed in the scanner module 200 and another image memory 430FIFO having a capacity for storing image information of 2 lines is employed in the printer module 400, a delay of six scanning lines are caused therebetween Accordingly, an image forming phase is 0.4 mm behind of a predetermined phase. This difference causes a difference in timing of a color tone image transferring.

However, since each of mono color toner transfers is executed at a same delayed registration timing, each of the mono color images is precisely superimposed. Further, such a difference is cleared by adjusting a registration timing for the copysheet to be fed to synchronize a color toner image to be transferred to the photoconductive drum. Namely, a second transferring of the color toner image onto the copysheet is delayed by six lines. The reason why the image buffer memory 230FIFO has a capacity for storing image information of 4 lines and another image memory 430FIFO has a capacity for storing image information of 2 lines is that slight unevenness existing between crystal oscillators 230XTL and 430XTL is absorbed by such buffer memories.

To explain in more detail, in such devices, even if 430XTL is either slightly higher or lower than 230XTL in frequency, a difference in numbers of lines which are converted from numbers of line-synchronize frequency for a scanning start and scanning end ranges from 6718 to 6722 lines. Such a range is almost within an allowance of a reference of lines of 6720. Accordingly, problems of both read-data passing and overflowing of the data can respectively be stopped.

After the above described image forming process, a mono color image is formed on an intermediate transfer belt 415. A predetermined four kinds of different color toner images are precisely superimposed thereon, if the above described synchronizing procedure is executed for each of the four kinds of color toner image transferring, since a difference in registration timing does not exist. A full color copy 190B is then obtained by transferring the superimposed color toner image onto a copysheet 190A, fixing the toner image thereto, and ejecting the copysheet from the color image forming apparatus.

Figure 21:
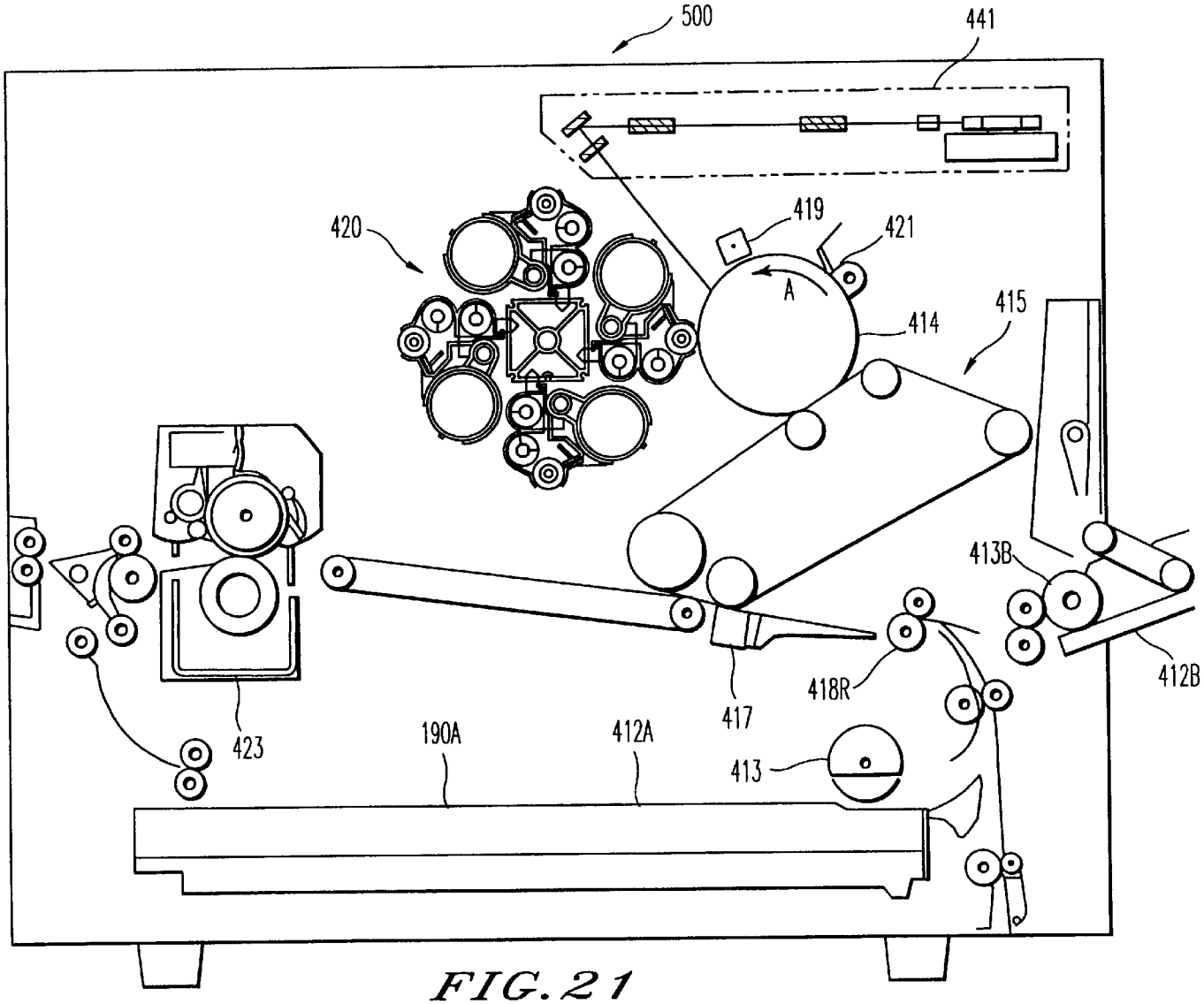
FIG. 21 is a schematic diagram illustrating an image forming apparatus according to an embodiment of the present invention.
Figure 22:
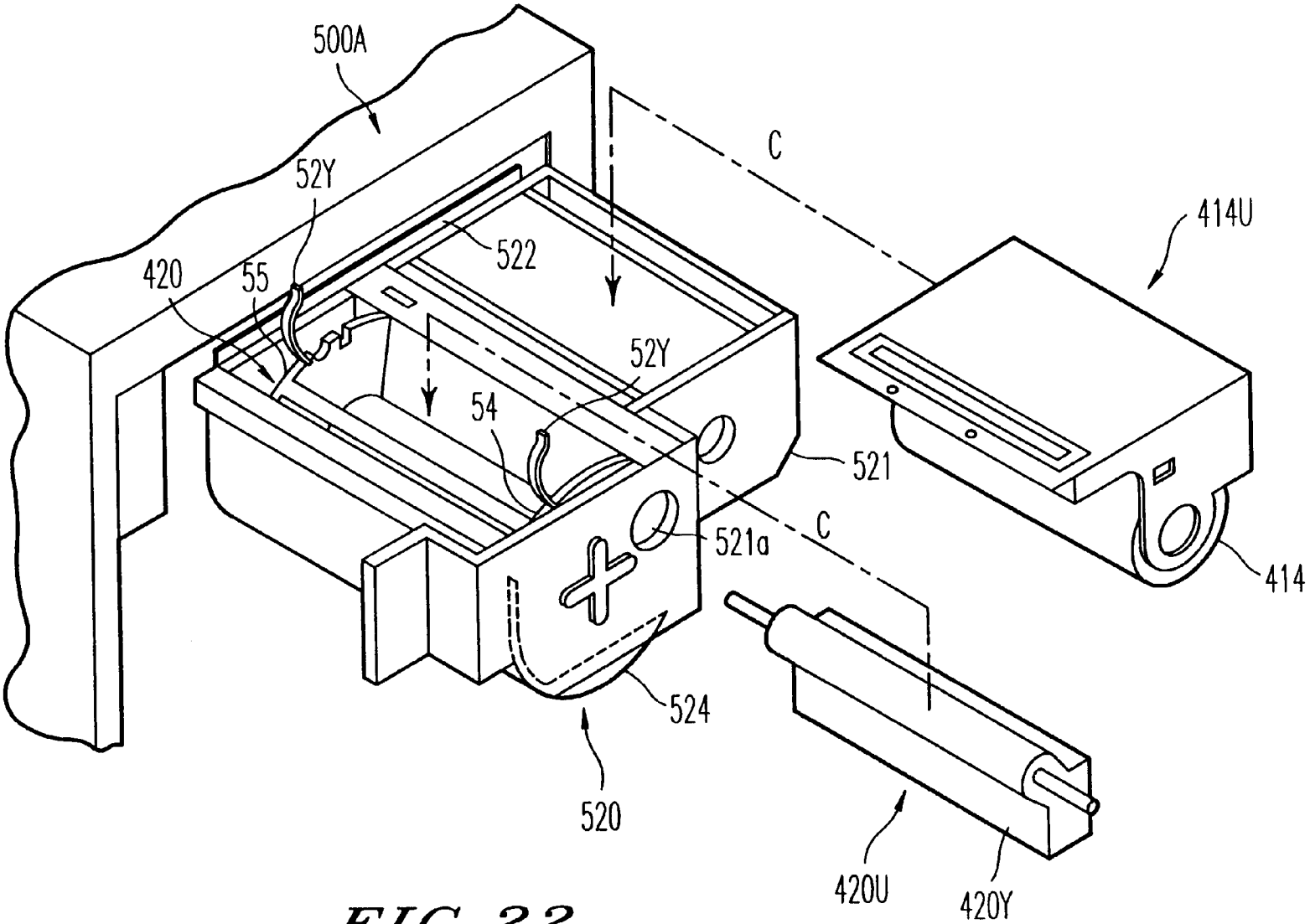
FIG. 22 is a schematic perspective diagram illustrating a constitution of a pulled-out supporter of an image forming apparatus.

Hereinbelow, a structure of a color image forming apparatus as one embodiment of the present invention is explained. An outline of the structure of the color image forming apparatus is illustrated in FIGS. 21 and 22. The image forming apparatus is structured by almost the same devices as in the printer module 400 as illustrated in FIG. 7. Accordingly, same numbers are used for corresponding devices.

The image forming apparatus 500 includes a photoconductive drum (hereinbelow referred to as a PC drum) unit 414U having PC drum 414, a revolving type developing apparatus 420, and another plurality of image processing devices disposed therearound. Such a PC drum unit 414U is mounted on a withdrawal support frame 520 connected in a state of freely sliding to a body 500A of the image forming apparatus 500, and thereby the PC drum unit 414U can be withdrawn by an operator.

Figure 23:
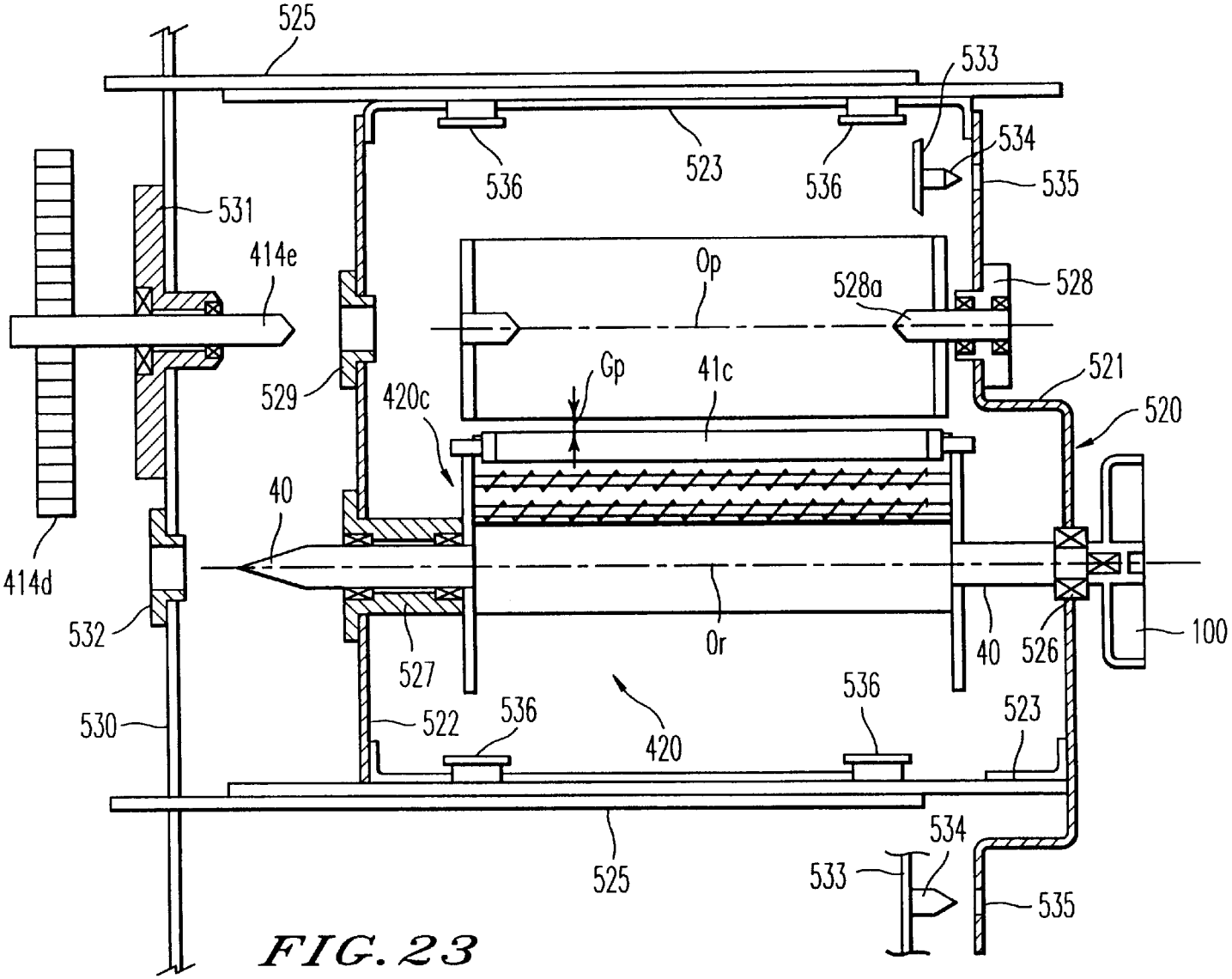
FIG. 23 is a schematic top plan view illustrating a constitution of a pulled-out supporter.

Hereinbelow, the structure of the withdrawal support frame 520 is explained in more detail referring to FIGS. 22 through 28. The frame 520 includes a front side plate 521, a rear side plate 522, and four stays 523 respectively extending in parallel at both a left and right side of the withdrawal support frame 520 as shown in FIG. 23 and above and below thereof (not shown). The withdrawal support frame 520 further includes a toner receiving plate 524 shown in FIG. 26 disposed below a portion of the frame 520 in which the revolving type developing unit 420 is attached for receiving toner spilled from the revolving type developing unit 420. Such a toner receiving plate 524 can bend so that the plate 524 is removed from the withdrawal support frame 520 when the frame 520 is withdrawn from the image forming apparatus 500. The toner receiving plate 524 is made of material, for example PET or the like, having flexibility.

Figure 26:
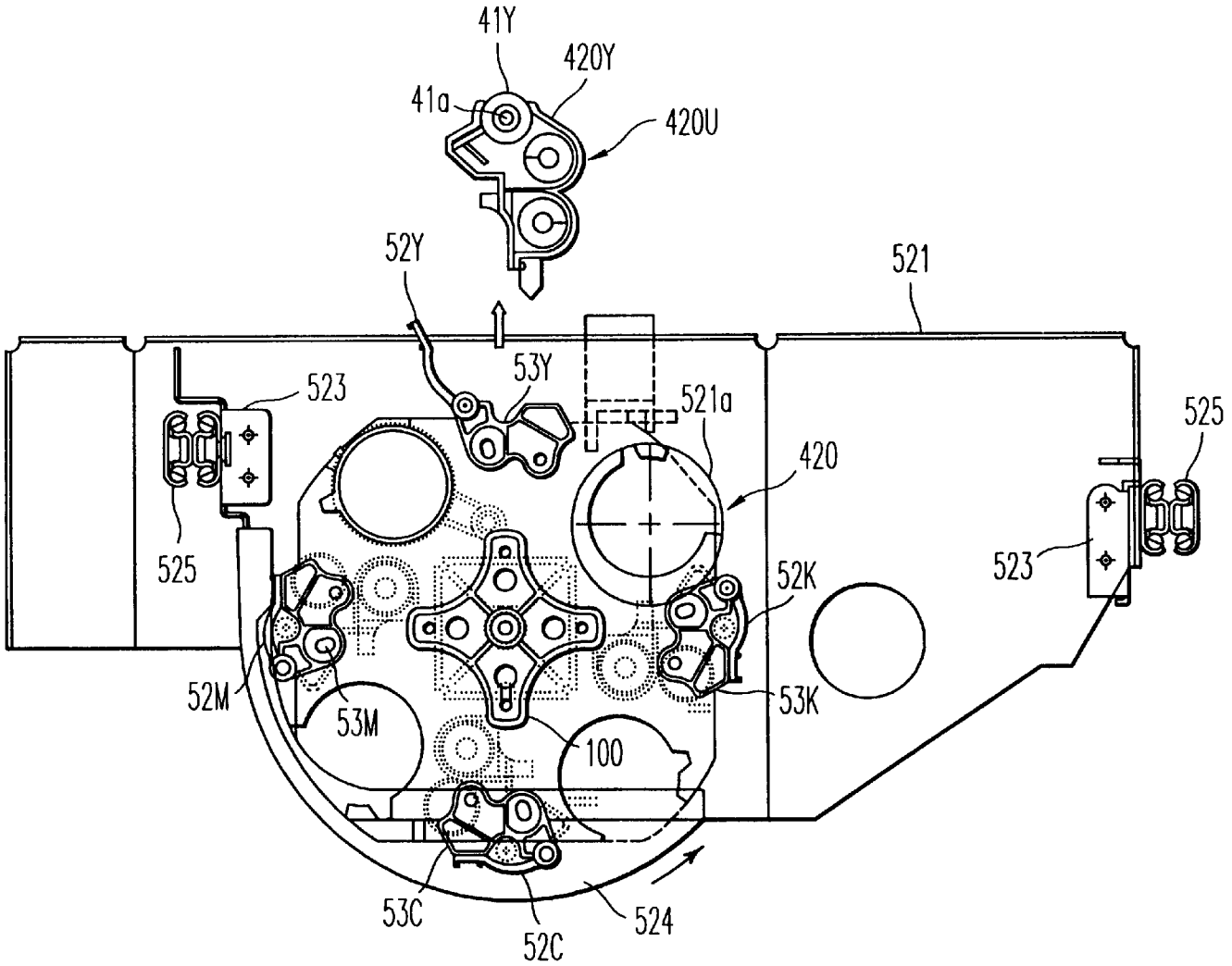
FIG. 26 is a schematic elevation illustrating a status in which a revolving type developing apparatus is mounted on a pulled-out supporter.

The withdrawal support frame 520 further includes a pair of slide rails 525 respectively mounted on each of side portions thereof as shown in FIGS. 23 and 26, and thereby, the withdrawal support frame 520 can be withdrawn from the body 500A of the image forming apparatus to a front side thereof. Such a pair of slide rails 525 has, e.g., a length of 500 mm when shortened in the body 500A, and 650 mm when extended outside of the body 500A and respectively include two pieces, for example. Accordingly, if the withdrawal support frame 520 supporting both the PC drum unit 414U and the revolving type developing apparatus 420 is withdrawn from the body 500A, a maintenance for both the PC drum unit 414U and the revolving type developing apparatus 420 and exchanging thereof are easily executed by the operator without posing a particular problem for him or her.

As shown in FIGS. 22 and 26, one of developing units 420U is at least enabled to be upwardly removed as shown by arrow C, see FIG. 22, from the revolving type developing apparatus 420 mounted on the withdrawal support frame 520. The PC unit 414U is also removed in a same manner as described above. A situation is illustrated in FIGS. 22 and 26 that a yellow developing unit 420Y having yellow toner therein is removed from the revolving type developing unit 420U including a plurality of different color developing units respectively including corresponding color toner developing devices 420C, 420M, 420Y, 420K and such toner supplying devices 45C, 45M, 45Y, 45K.

The structure of connecting portions of the withdrawal support frame 520 with the body 500A are illustrated in FIG. 23. As shown in FIG. 23, there exists a gap (hereinbelow, referred to as a developing gap Gp) between the PC drum 414 and each of the developing rollers 41C, 41M, 41Y and 41K. Such a gap Gp is precisely maintained, since an axis (Or) of a rotary shaft 40 of the revolving type developing unit 420 and an axis Op of the PC drum 414 are respectively fixed to both the front side plate 521 and the rear side plate 522 of the withdrawal support frame 520 as shown in FIG. 23.

To explain in more detail, a front of side axis 40 of the revolving type developing apparatus 420 is supported by a ball bearing 526 mounted on the front side plate 521 of the withdrawal support frame 520. A rear of side axis 40 of the revolving type developing apparatus 420 is supported by a rear ball bearing 527 mounted on the rear side plate 522 of the withdrawal support frame 520. Further, a center portion of a side plate of the PC drum 414 is supported at a front holder 528 mounted on the front side plate 521 of the withdrawal support frame 520. A center portion of a rear side plate of the PC drum 414 is supported by a drum driving shaft 414*e* mounted on a rear side drum holder 531 which penetrates a sliding bearing 529 mounted on the rear side plate 522 of the unit supporter 520 to enter within the withdrawal support frame 520 area when installed in the body 500A.

Thus, the revolving type developing apparatus 420 can be rigidly supported even if withdrawn from the body 500A as rigid as directly supported by the body 500A as employed in a conventional color image forming apparatus. Further, such a withdrawal support frame 520 can be assembled as a simple unit, thereby improving an assembling process thereof.

The withdrawal support frame 520 can be positioned at a predetermined position in the body 500A when the above described drum driving shaft 414*e* supports the PC drum 414 at the center of the rear side plate thereof and the above described rotary shaft 40 is inserted into the sliding bearing 532 and a reference pin 534 mounted on a front plate 533 of the body 500A is inserted into a reference hole 535 formed on the front side plate 521 mounted on the withdrawal support frame 520. Thus, a precise positional relation between the PC drum 414 and the body 500A can be maintained.

Figure 24A:
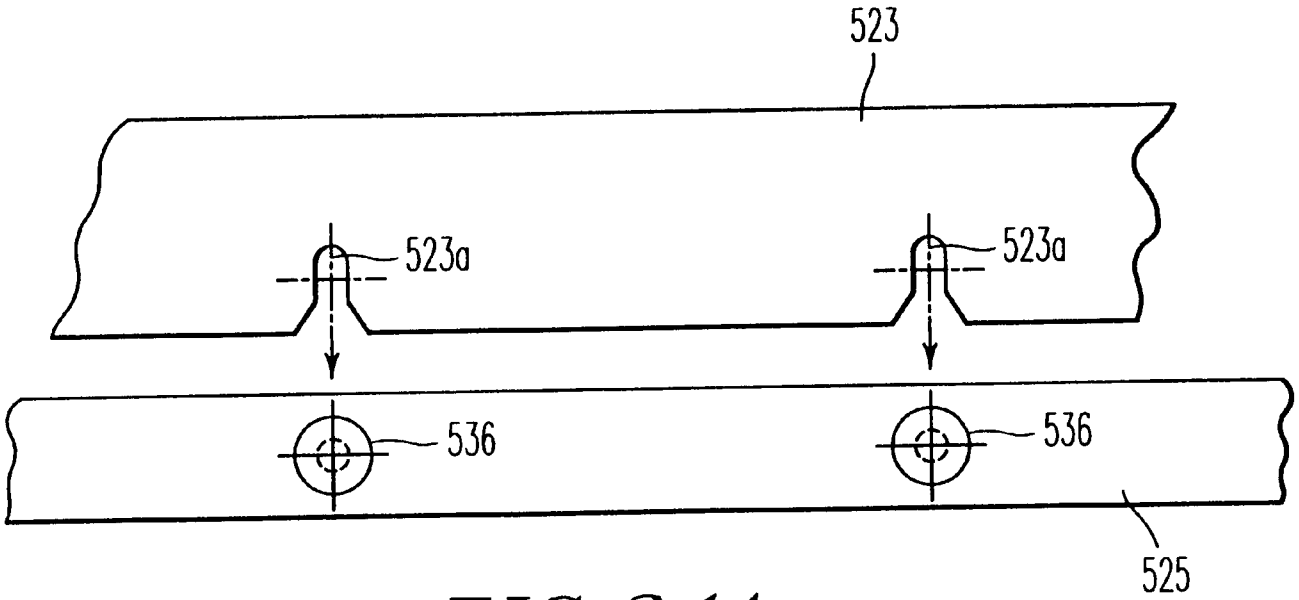
FIG. 24 is a pivot portion side view illustrating a structure in which a stay member of a pulled-out supporter is installed into a slide rail.
Figure 24B:
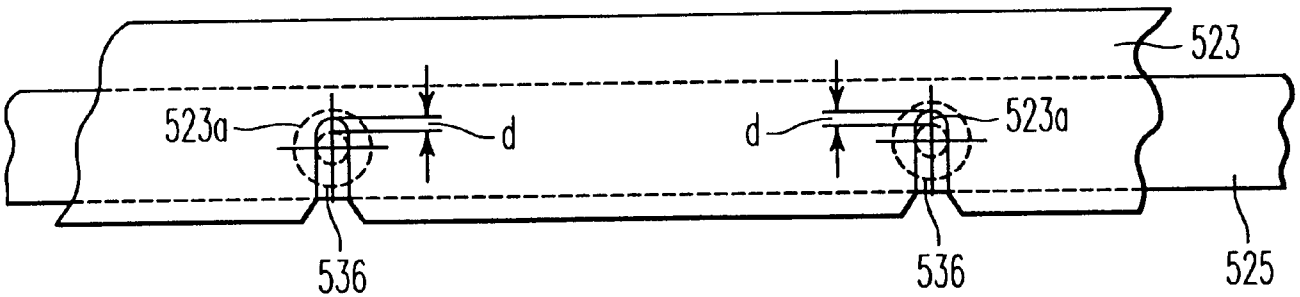

As shown in FIGS. 23, 24(*a*) and 24(*b*), one of the slide rails 525 is firmly mounted on the body 500A and mounting a plurality of pin state bosses 536 extruding therefrom disposed at a predetermined interval of distances. The above described stay 523 includes a plurality of U shaped notches 523*a* thereon at predetermined intervals to allow insertion of corresponding bosses of the plurality of pin state bosses 536. Thus, the withdrawal support frame 520 is firmly supported in the body 500A by one of the slide rails 525 firmly mounted on the body 500A and can be easily dismounted from the body 500A at an outside thereof, due to using the pin state bosses and U shaped notches 523*a*.

As shown in FIG. 24(*b*), a small gap (d) is formed between the above described pin state boss 536 and the notch 523*a* when the pin state boss 536 is inserted into the notch 523*a*. Thus, any interference caused between the above described drum driving shaft 414*e* and the sliding bearing 529, the rotary shaft 40 and the sliding bearing 532, and the reference pin 534 and the reference hole 535, when the withdrawal support frame 520 is set into the body 500A can be to avoided. Accordingly, the of the withdrawal support frame 520 is smoothly set into the body 500A.

Figure 25:
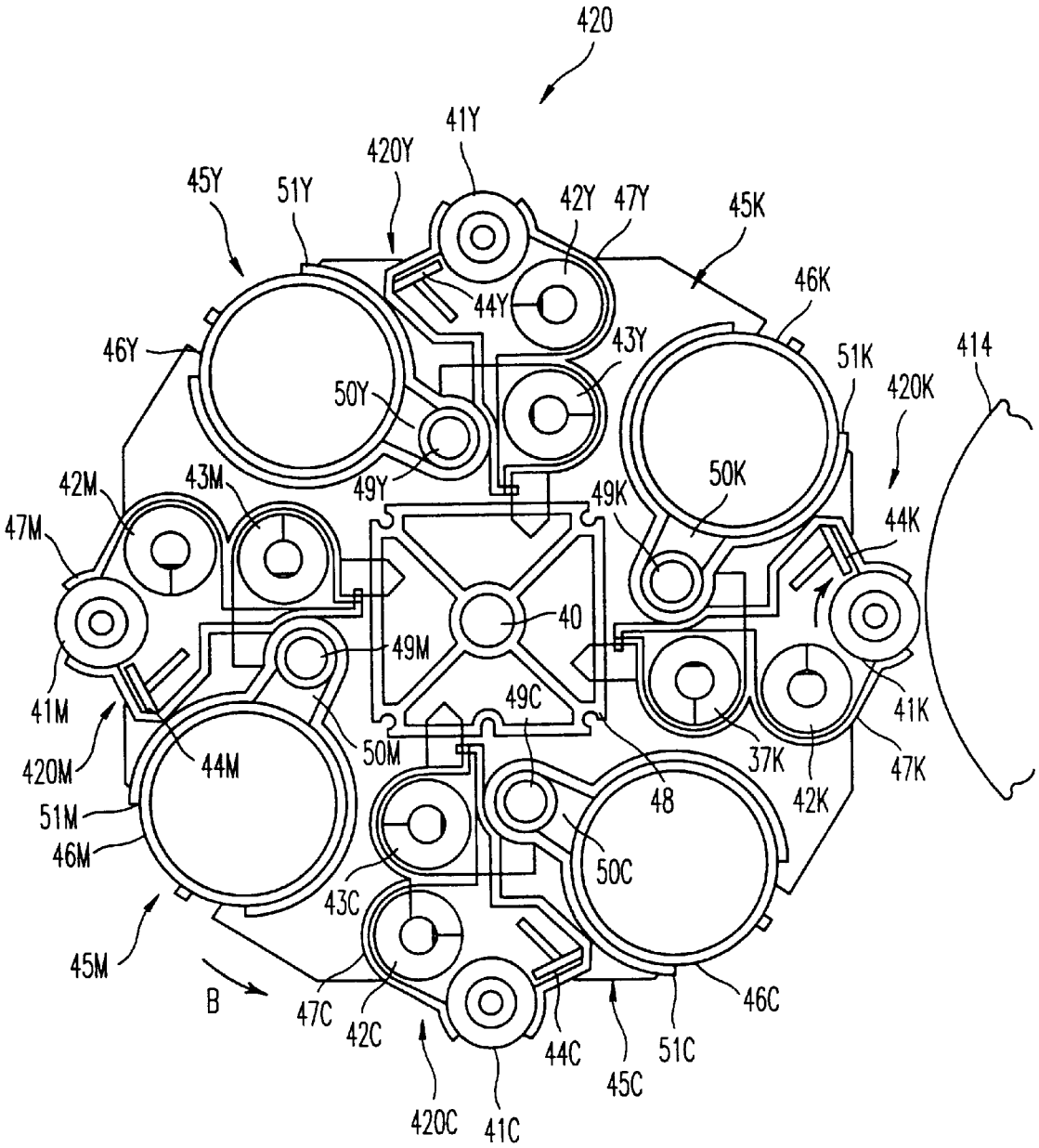
FIG. 25 is a schematic constitutional diagram illustrating a constitution of a revolving type developing apparatus of an image forming apparatus of the present invention.

Hereinbelow, the structure of the revolving type developing apparatus is explained in detail. An outline of the structure of the revolving type developing apparatus 420 is illustrated in FIG. 25. Such a revolving type developing apparatus 420 includes an outer casing, an opening facing the PC drum 414, four different mono color developing devices 420K, 420Y, 420M, 420C having almost a same shape respectively disposed on a circle around an axis of the device 420, and four different mono color toner supplying devices 45K, 45Y, 45M, 45C respectively supplying toner contained therein to corresponding ones of the four different mono color developing devices, as shown in FIG. 21. As shown in FIG. 25, a black developing device 420K storing both black toner and carrier faces the PC drum 414 through the opening, and developing devices for a yellow image, a magenta image, and a cyan image are respectively disposed around the axis of the revolving type developing apparatus 420 clockwise in the predetermined order.

Since each of the internal structures of the above described four mono color developing devices 420K, 420Y, 420M and 420C is the same to each other, the internal structure of the black developing device 420K facing the PC drum 414 is typically explained and others are not explained. Instead, each of letters Y, M and C respectively indicating yellow, magenta and cyan are put to the corresponding developing devices and portions thereof.

The above described black developing device 420K includes a developing roller 41K, a developing case 47K, a pair of first and second stirring screws 42K and 43K for respectively stirring two component developer including black toner and carrier beads contained in the developing case 47K. The black developing device 420K further includes a developing doctor blade 44K as a developer thickness adjusting member for adjusting a thickness of the developer carried on a periphery of the developing roller 41K.

As shown in FIG. 25, each of the developing devices of the developing units 420U is detachably mounted on the revolving type developing apparatus 420 and is positioned at a predetermined position of a unit supporting member 48 united to a rotary axis 40 of the revolving type developing apparatus 420. Further, each of toner supplying devices 45K, 45Y, 45M and 45C of the developing units 420U is united to the unit supporting member 48, thereby rotating with the unit supporting member 48.

The above described toner supplying devices 45K, 45Y, 45M and 45C respectively include corresponding ones of toner supplying screws 49K, 49Y, 49M and 49C, one of toner supplying cases 50K, 50Y, 50M and 50C, and one of toner cartridge guides 51K, 51Y, 51M and 51C.

Each of the toner cartridges 46K, 46Y, 46M and 46C respectively stores different color toner therein and can be withdrawn from the revolving type developing apparatus 420 through a hole 521*a* formed on the front plate 521 of the unit supporter 520 to the front side of the body 200 by guiding with each one of the corresponding toner cartridge guides 51K, 51Y, 51M and 51C as shown in FIGS. 22 and 26. To the contrary, if each of the toner cartridges 46K, 46Y, 46M and 46C respectively is inserted to a predetermined position in the revolving type developing apparatus 420 along with the corresponding toner cartridge guides 51K, 51Y, 51M and 51C, toner stored in each of the toner cartridges is transferred into a corresponding one of the toner supplying cases 50K, 50Y, 50M and 50C by a predetermined amount. The toner thus transferred is further transferred by a corresponding one of the toner supplying screws 49K, 49Y, 49*m* and 49C into a front portion of a corresponding one of second screws 43K, 43Y, 43M and 43C disposed in a corresponding one of the developing cases 47K, 47Y, 47M and 47C when rotated by a unique motor (not shown). Such transportation of the toner is executed only in the developing device which faces the PC drum 414, for example the black developing device 420K as shown in FIG. 25.

The black toner transferred into the portion beside the second screw 43K of the black developing device is stirred and is further transferred by the second screw 43K into a rear portion of the black developing case 47K, thereby dispersing in the black developing case 47K. Such black toner is handed to the first stirring screw 42K at the rear portion of the black developing case 47K and is then transferred by the first stirring screw 42K when rotated to the front portion thereof to hand the toner to the second stirring screw 43K again at the front side thereof.

Some of the toner thus circulated in the developing case 47K is picked up by the developing roller 41K during circulation therein and is carried on a periphery thereof rotating in a direction as illustrated by an arrow shown in FIG. 25. A thickness of such toner is regulated by the developing doctor blade 44*k* to form a thin layer thereof and is then fed to a developing station, and thereby a latent image formed on the PC drum 414 is developed.

Each of the doctor blades 44K, 44Y, 44M and 44C is respectively composed of a base metal plate having non-magnetic material and a magnetic plate connected to a leading edge of the base metal plate. Such a doctor blade 44K grounds a magnetic force which is to be generated by a magnet installed in the developing roller when facing the doctor blade 44K Accordingly, the developer quickly starts developing, since a conflicting area in which each of developers conflicts is increased.

As shown in FIG. 26, each of the developing devices 420K, 420Y, 420M and 420C of corresponding ones of developing units 420U is held by both a corresponding one of supporting holders 52K, 52Y, 52M and 52C and position adjusting holders 53K, 53Y, 53M and 53C which are respectively mounted on both the front and rear side plates 54, 55 of the is revolving type developing apparatus 420 as shown in FIG. 22. Each of axis 41*a* of the developing rollers 41K, 41Y, 41M and 41C is supported by the supporting holder 52Y and the position adjusting holder 53Y to keep a predetermined positional relation between the unit supporting plate 48 and the shaft 41*a*. Such developing devices are respectively enabled to be removed from the revolving type developing apparatus 420.

Each of the position adjusting holders 53K, 53Y, 53M and 53C is pivotally mounted on both the front and rear side plates 54, 55 around a supporting point 53*a* and can swing in a direction as illustrated by an arrow as shown in FIGS.

27 and 28. Thus, the axis of each of the developing rollers 41K, 41Y, 41M and 41C varies it position when a corresponding one of the position adjusting holders is swung in a predetermined direction, and accordingly, a distance between the developing roller and a periphery of the PC drum 414, namely a gap (Gp), is also varied.

Figure 27:
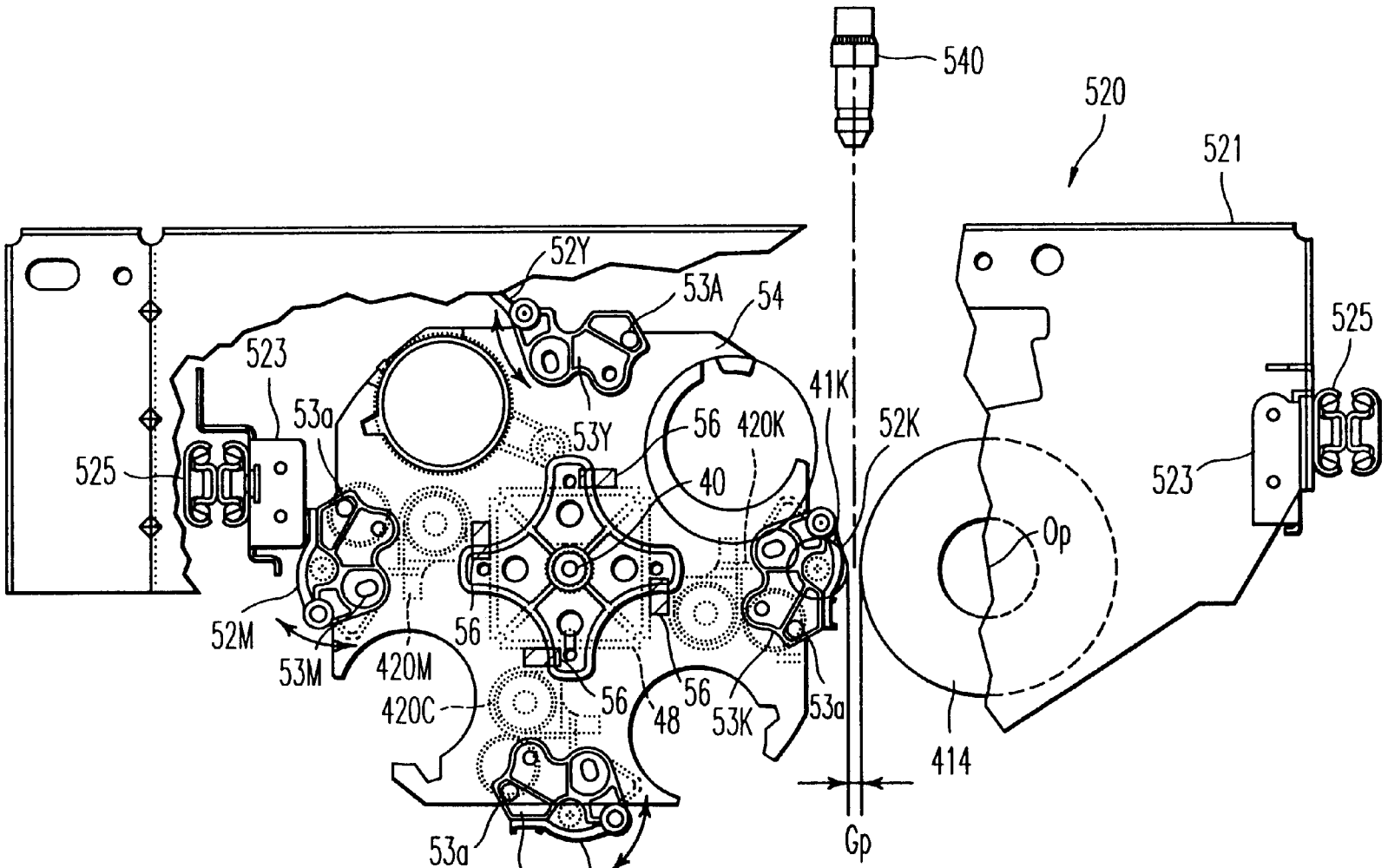
FIG. 27 is an explanatory diagram for explaining a constitution of a developing unit mounted portion of a revolving type developing apparatus.
Figure 28:
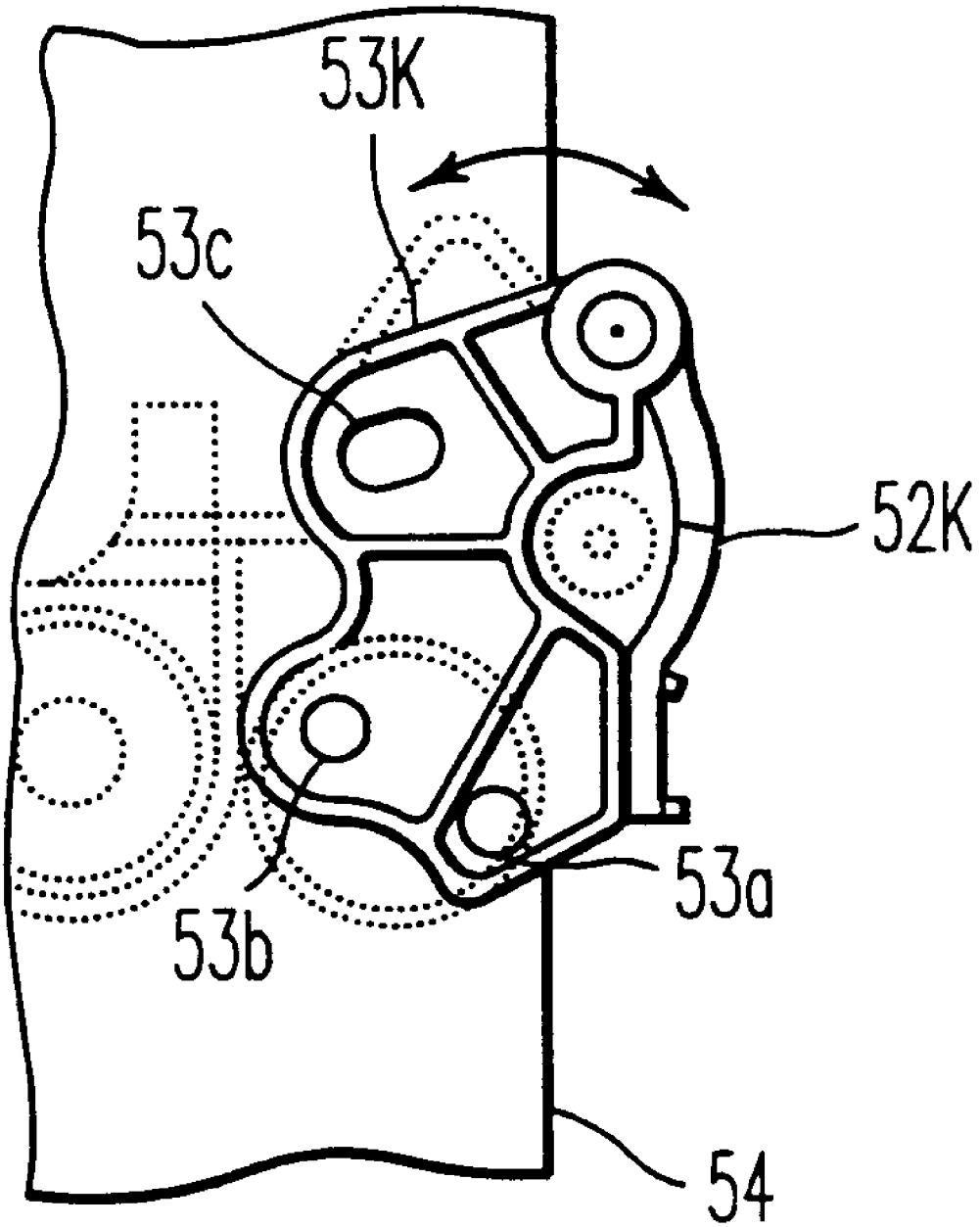
FIG. 28 is a pivot portion front view illustrating a constitution of a developing unit mounted portion.

The above described adjusting of the gap (Gp) is executed as described below. As shown in FIG. 27, a CCD camera 540 is disposed above the unit supporter 520. The CCD camera 540 watches a gap (Gp) between the PC drum 414 and the developing roller 41K facing the PC drum 414 and takes an image thereof. The image is converted into digital information to measure a distance of the gap Gp.

A developing gap controller 541 is provided in the revolving type developing apparatus 420. Further, an oil pressure applying device 542 or the like is also provided therein. The developing gap controller 541 controls the oil pressure applying device to swing the position adjusting holder 53K in a predetermined direction by using a pressure applying head 542*a*. Thus, the axis of the developing roller 54K is automatically moved to change position thereof. Thus, the gap (Gp) is automatically adjusted. The developing gap controller 541 controls the oil pressure applying device 542 to stop swinging of the position adjusting holder 53K when the gap measured by watching and taking a picture thereof by the CCD camera 540 reaches the predetermined distance.

After thus controlling the gap (Gp), the position adjusting holder 53K is fixed to both the front and rear plates 54, 55 by screwing with screws (not shown), through a plurality of setting holes 53*b*, 53*c*. The same adjusting control is executed for remaining developing devices 420, and thereby each of the developing gaps (Gp) of the revolving type developing apparatus can be kept at a predetermined precise distance.

Figure 29:
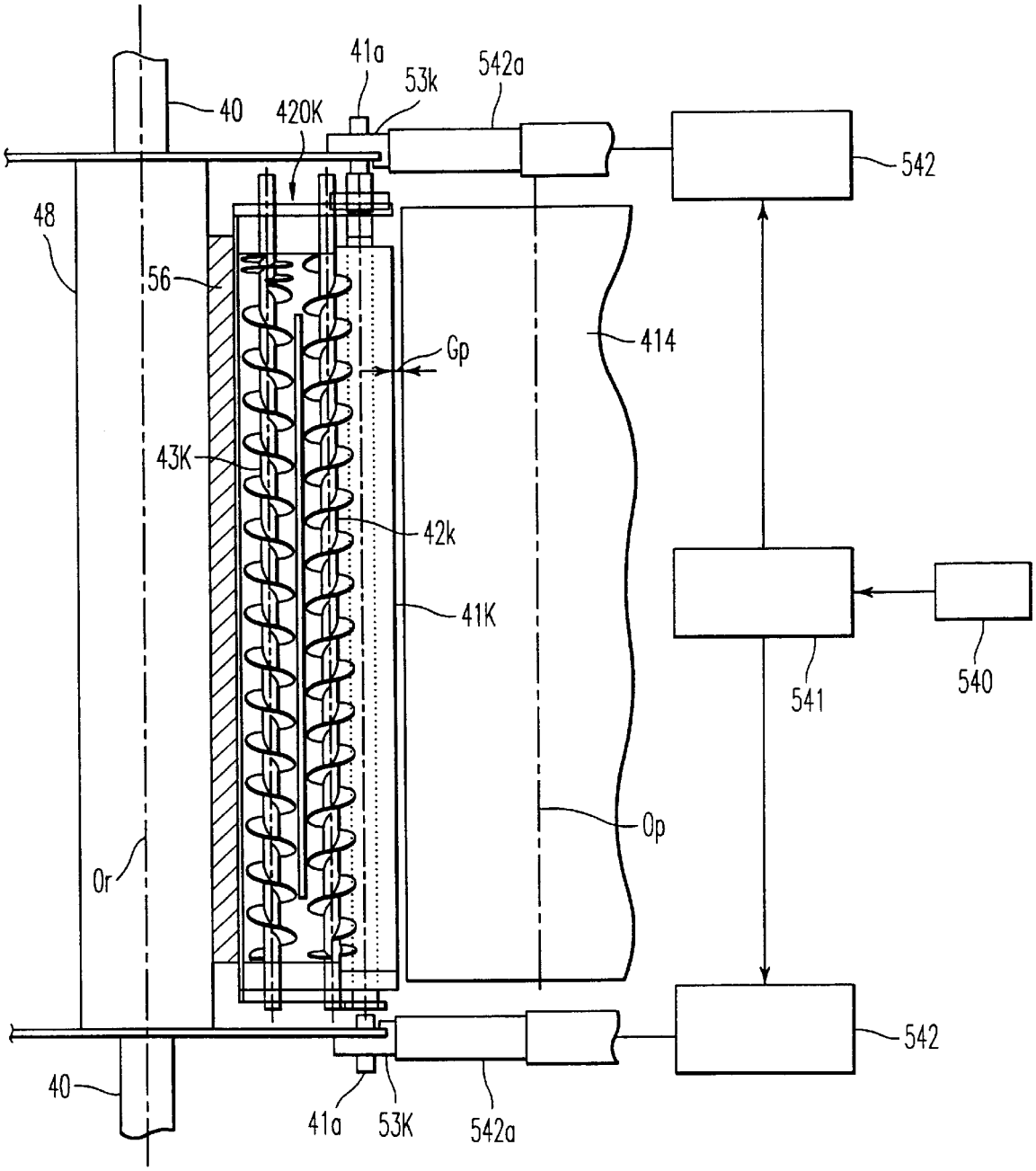
FIG. 29 is a schematic plan view for explaining an adjusting method of a development gap of a developing unit.

As shown in FIGS. 27 and 29, an elastic material, for example, a rubber, a plate spring or the like, is installed in a space between the unit supporting member 48 and each of the developing devices 420K, 420Y, 420M and 420C. Each of the developing devices 420K, 420Y, 420M and 420C accordingly is pushed by the elastic material from an inside of the revolving type developing apparatus toward an outside thereof. Accordingly, the axis of each of the developing rollers 41K, 41Y, 41M and 41C is biased toward the periphery of the PC drum 414. In such a device, the above described gap adjusting control using the developing gap adjusting device 542 is enabled to be simplified, since the pressing head 542*a* thereof is required only to swing in a direction in which the above described elastic material is shrunk.

Further, the above described developing gap adjusting control is executed when a central axis of the revolving type developing apparatus, a rotational center of the developing roller 41K, and a rotational center of the PC drum 414 are aligned on a horizontal plane. Thus, a simple and highly precise developing gap adjusting control is realized.

Models having a same shape and scale to that of the above described developing roller and PC drum 414 can be utilized for measuring the gap (Gp) and adjusting the above described gap (Gp) to avoid damage or pollution thereof which can be caused when the developing gap adjusting is mistakenly operated.

Hereinbelow, a developing bias applying method for a revolving type developing apparatus 420 is explained. A developing bias is applied by a developing bias applying device as shown in FIG. 30 through FIG. 32 when a latent image formed on the periphery of the PC drum 414 is to be developed at a developing station.

Figure 30:
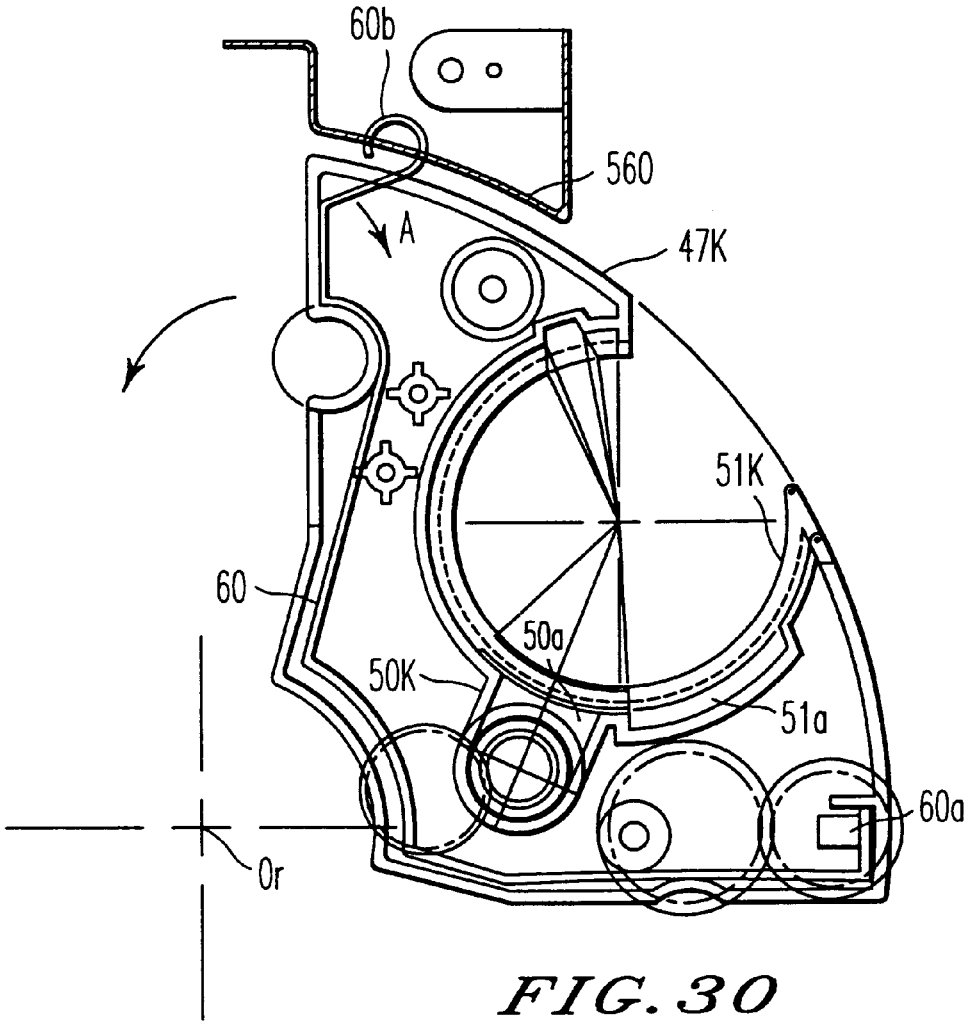
FIG. 30 is a constitutional diagram illustrating a constitution of a development bias applying mechanism of a developing unit.

As shown in FIG. 30, a developing bias terminal 60 is disposed at an inner side of the developing case 47K which faces the front side plate 521 of the unit supporter 520. Such a developing bias terminal 60 is composed of a plate spring made of a dielectric substance and is inserted along with an inner wall of the developing case 47K against a resilient force thereof. The developing bias terminal 60 inserted therein is fixed to the developing case 47K by a screw or the like.

Figure 31:
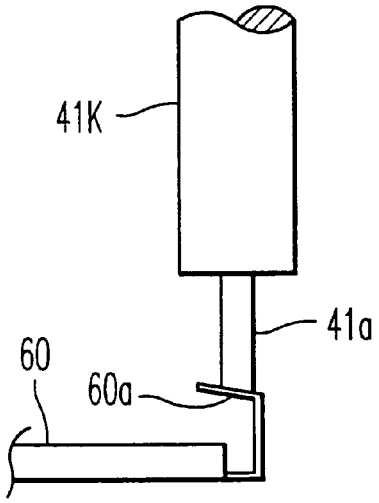
FIG. 31 is a schematic constitutional diagram illustrating a constitution of a developing roller section of a development bias applying mechanism.

An edge of the developing bias terminal 60 is bent and such a bent portion thereof (hereinbelow referred to as a developer side terminal) contacts a side edge of the supporting shaft 41*a* of the developing roller 41K of the black developing device 420K as shown in FIG. 31. Another edge 60*b* of the developing bias terminal 60 (hereinbelow referred to as a body side terminal) extrudes from an outer circumferential surface of the revolving type developing apparatus 420. Such a body side terminal 60*b* has a curled edge portion as shown in FIG. 30 for making smooth contact with a body side developing bias terminal 560 explained below.

Figure 32:
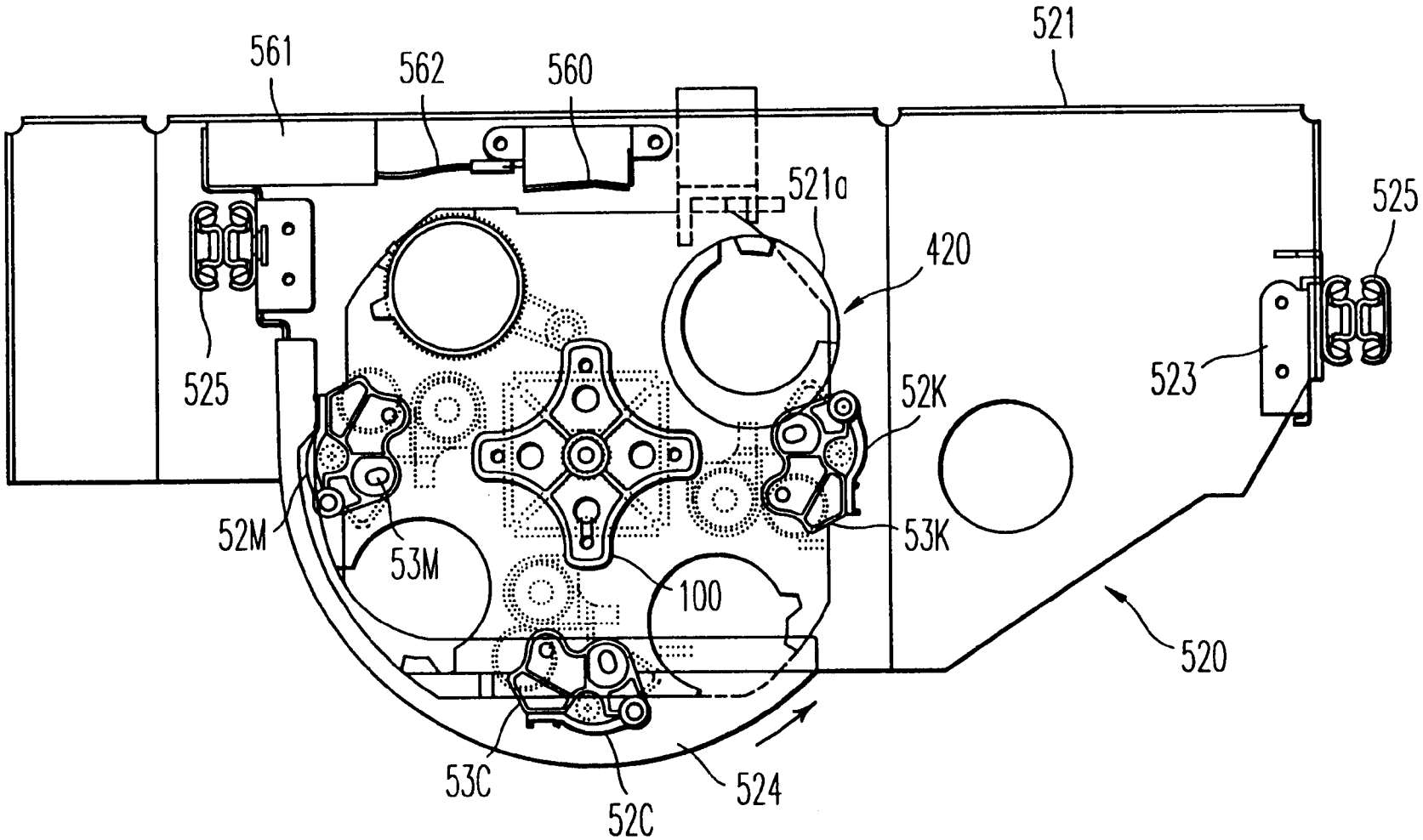
FIG. 32 is a constitutional diagram illustrating a constitution of a pulled-out supporter side of a development bias applying mechanism.

The body side developing bias terminal 560 is disposed on an upper portion of the front side plate 522 of the unit supporter 520 as shown in FIG. 32 to interfere with an orbit of the body side terminal 60*b*. Such a developing bias terminal 560 is disposed so that the body side terminal 60*a* contacts the side edge of the supporting shaft 41*a* of the developing roller 41K when the body side terminal 60*b* contacts the body side developing bias terminal 560.

As shown in FIG. 32, a developing bias power pack 561 is disposed on an upper portion of the front side plate 521 of the unit supporter 520 to adjoin the body side developing bias terminal 560. Such a body side developing bias terminal 560 is connected by the developing bias power pack 561 with a harness 562.

Accordingly, when a predetermined developing device, for example a black developing device 41K, is brought to the developing station, namely, the body side terminal 60*a* is elastically pressured and contacts the body side developing terminal 560. A predetermined developing bias voltage is then applied to a developing roller facing the PC drum 414 by the developing bias power pack 561 through the harness 562, the body side developing bias terminal 560, and the developer side bias terminal 60.

Hereinbelow, the structure of the toner supplying device is explained. Each of the toner supplying devices 45C, 45M, 45Y and 45K respectively disposed in each of the developing units 420U of the revolving type developing apparatus 420 is the same in structure to each other. Therefore, a black toner supplying device 45K disposed in the black developing device 420K for supplying black toner is only explained as a typical model thereof.

Figure 33:
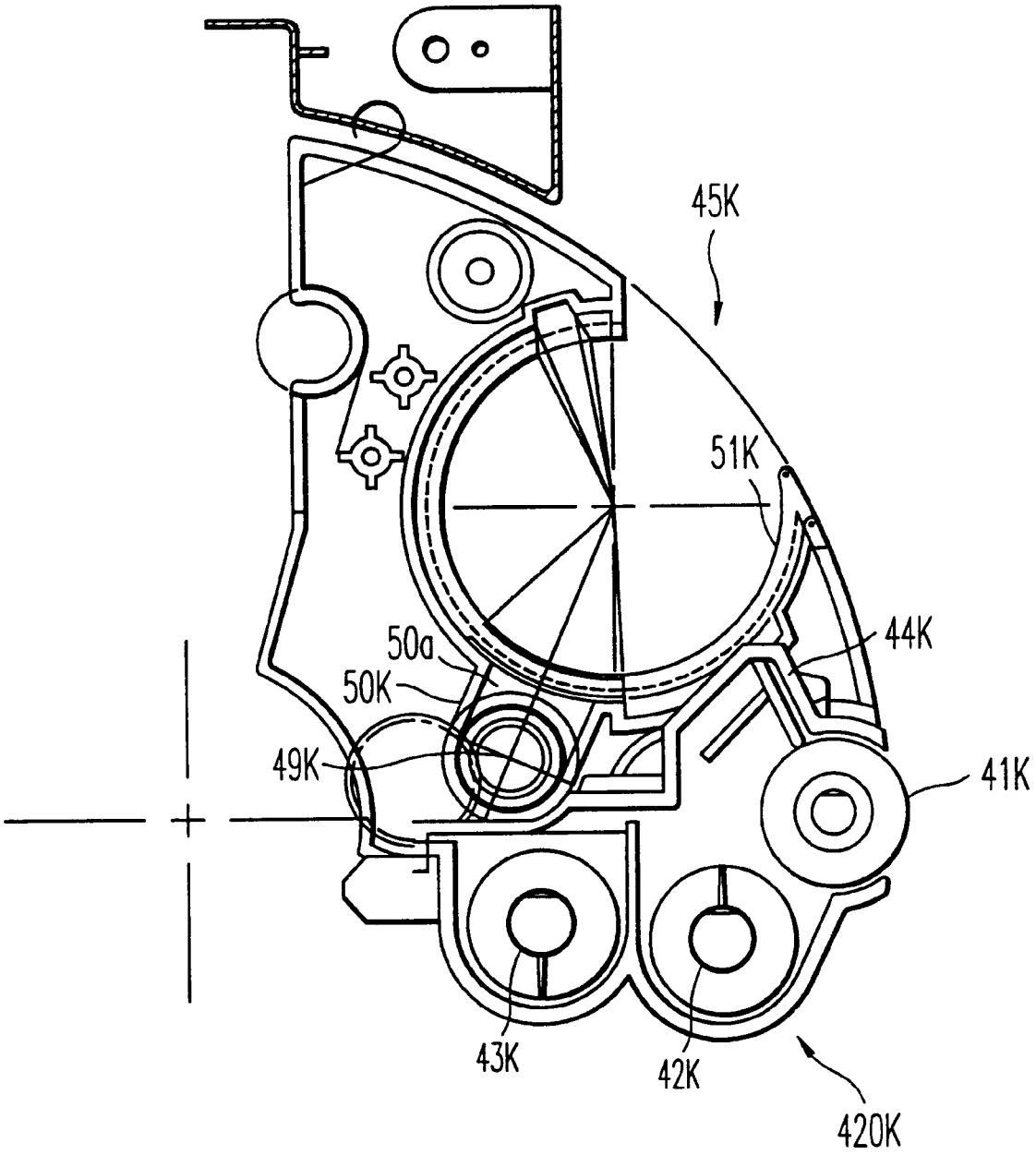
FIG. 33 is a constitutional diagram for explaining a constitution of a toner supplying apparatus of a developing unit.
Figure 34A:
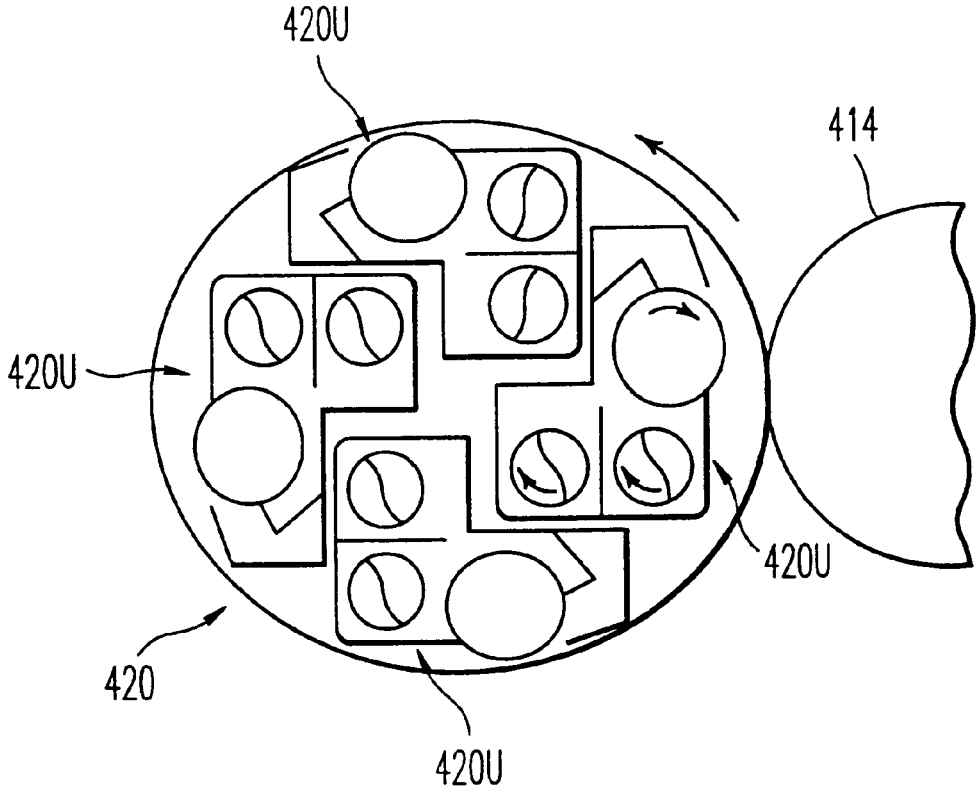
FIG. 34(*a*) is a schematic diagram of a revolving type developing apparatus for explaining a toner flow of a toner supplying apparatus of the present invention.
Figure 34B:
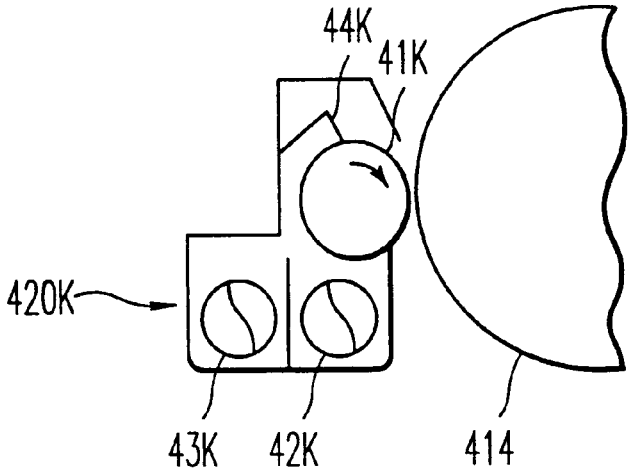
Figure 37A:
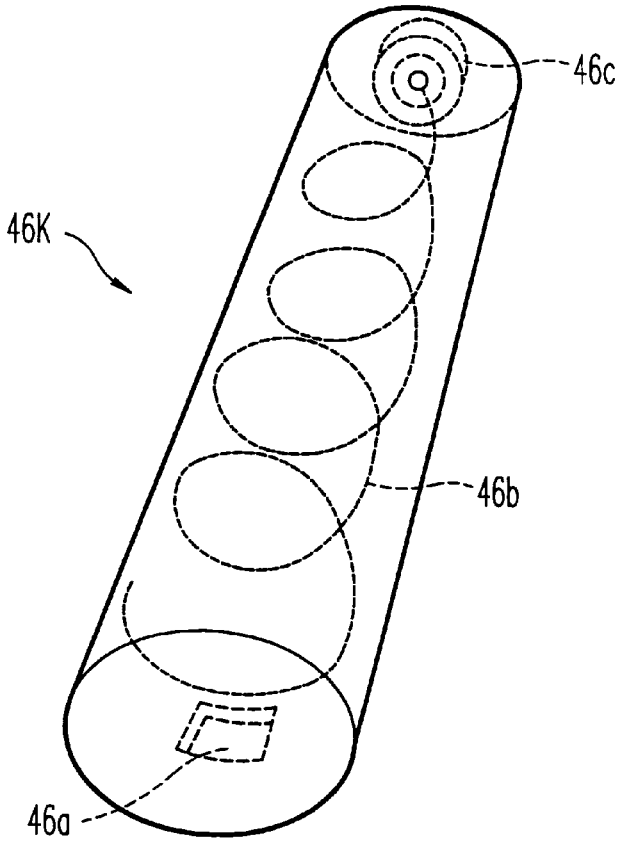
FIG. 37(*a*) is a schematic perspective diagram of a toner cartridge mounted on a toner supplying apparatus.
Figure 37B:
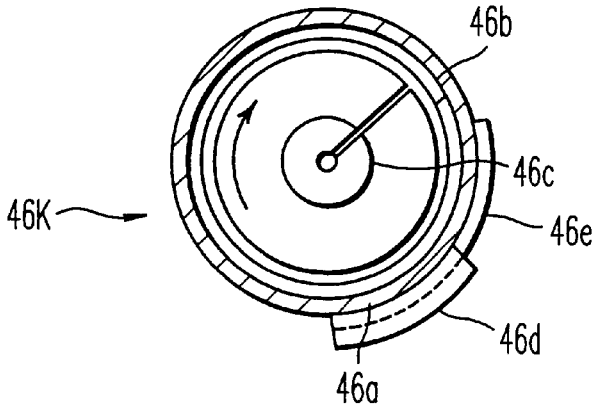

As shown in FIG. 33, the black toner supplying device 45K includes a toner supplying screw 49K, a toner supplying case 50*k*, and a toner cartridge guide 51K. A toner cartridge 46K explained later in detail is inserted into a predetermined position of the developing unit 420 through the opening 521*a* as shown in FIGS. 22 and 26 of the front side plate 521 along with the toner cartridge guide 51K shown in FIG. 33, when the black developing device 420K of the developing unit is brought to the developing station. A toner supplying hole 46*a* formed on the toner cartridge 46K as shown in FIG. 37(*a*) faces the toner receiving hole 50*a* formed on a front side portion of the toner supplying case 50K as shown in FIG. 33. Then, an agitator 46*b* shown in FIG. 37 rotates in a predetermined direction to supply a predetermined amount of the black toner stored in the toner cartridge 46K to the toner supplying case 50K through the toner supplying hole 46*a*.

Figure 35:
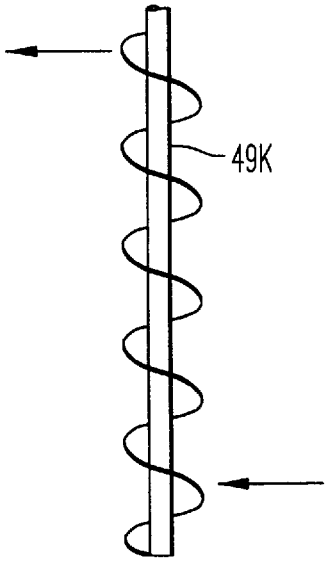
FIG. 35 is a schematic top plan view illustrating a pivot portion of a toner supplying screw of a toner supplying apparatus.
Figure 36:
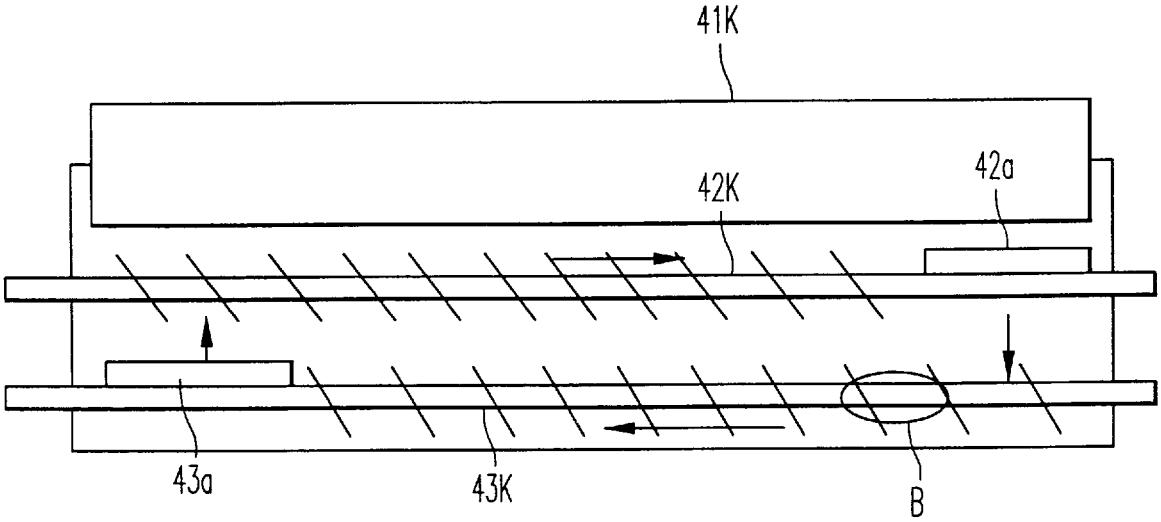
FIG. 36 is a schematic top plan view of a developing unit for explaining toner flow of a toner supplying apparatus.

As shown in FIG. 35, the black toner supplied to the toner supplying case 50K is further transferred toward a toner supplying position B shown in FIG. 36 where the toner is to be transferred to the developing device 45K as shown in FIG. 33 from a position where the black toner is received from the toner cartridge 46K. Such transportation of the black toner is executed by driving the toner supplying screw 49K shown in FIGS. 35 and 36 driven by a toner supplying screw driving motor (not shown). Thus, the black toner is gradually transferred to a portion beside a second stirring screw 43K disposed in the developing device 420K as shown in FIGS. 25 and 36.

The black toner transferred to the toner supplying position B is finally supplied into a rear portion of the developing case 47K by a rotation of the second screw 43K which is activated when a process control signal is input thereto. Thereby, the black toner is transferred into the developing case 47K in a state of being stirred and accordingly disperses therein.

As shown in FIG. 36, the black toner is delivered to the first stirring screw 42K through a slot at a rear side portion (left side in FIG. 36) of the developing case 47K and is further transferred by a rotation thereof as being stirred toward a front side portion (right side in FIG. 32) of the developing case 47K. A pair of fins 42*a* and 43*a* are respectively mounted at each end of the screws 42K and 43K. The fin 42*a* delivers the black toner to the second stirring screw 43K when rotating as shown in FIG. 36. The fin 43*a* also delivers the black toner to the first stirring screw 42K when rotating as shown in FIG. 36.

As shown in FIG. 33, during such circulation of the black toner in the black developing case 47K, some of the toner is picked up by the developing roller 41K to be carried thereon. A thickness of the developer carried thereon is regulated by the doctor blade 44K to have a thin layer and the developer develops a latent image formed on the PC drum 414 when brought into the developing station.

Hereinbelow, the structure of the toner cartridge is explained. Since each of the toner cartridges 46C, 46M, 46Y and 46K is the same in the structure, only the structure of a black toner cartridge 46K of the black toner supplying device 45K is explained as a typical model thereof referring to FIGS. 37 and 38.

As shown in FIGS. 37(*a*) and 37(*b*), such a toner cartridge 46K includes the above described agitator 46*b* therein for transferring the toner in the toner cartridge 46K through the toner supplying hole 46*a*, a coupling 46*c* mounted on a side of the agitator 46*b* for transferring a rotational force thereto, a shutter 46*d* for opening and closing the toner supplying hole 46*a*, and a shutter guide rail 46*e* for guiding the shutter 46*c* along with an outer circumferential surface of the body of the toner cartridge 46K.

A shutter receiving recess 51*a* for receiving the shutter 46*d* is formed at the inner surface of the toner cartridge guide 51K as shown in FIG. 30, and the toner cartridge is inserted along with the toner cartridge guide 51K in a state that the shutter 46*d* is inserted in the shutter receiving recess 51*a*. Thus, the shutter 46*d* is opened when the toner cartridge 46K is rotated in a predetermined angle since the shutter guide rail 46*e* is relatively moved to open the toner supplying hole 46*a* so that the toner supplying hole 46*a* faces the toner receiving hole 50*a*. Then, if the agitator 46*d* is rotated, a predetermined amount of toner stored therein is supplied to the toner supplying case 50K.

If the toner cartridge 46K is to be removed from the toner supplying device 45K, an opposite procedure is executed so that the toner supplying hole 46*a* is shut by the shutter 46*d* and the toner cartridge 46K is removed along with the toner cartridge guide 51K. A safety stopper (not shown) for enabling the toner cartridge 51K to be removed only after the shutter 46*d* is closed is employed.

Figure 38:
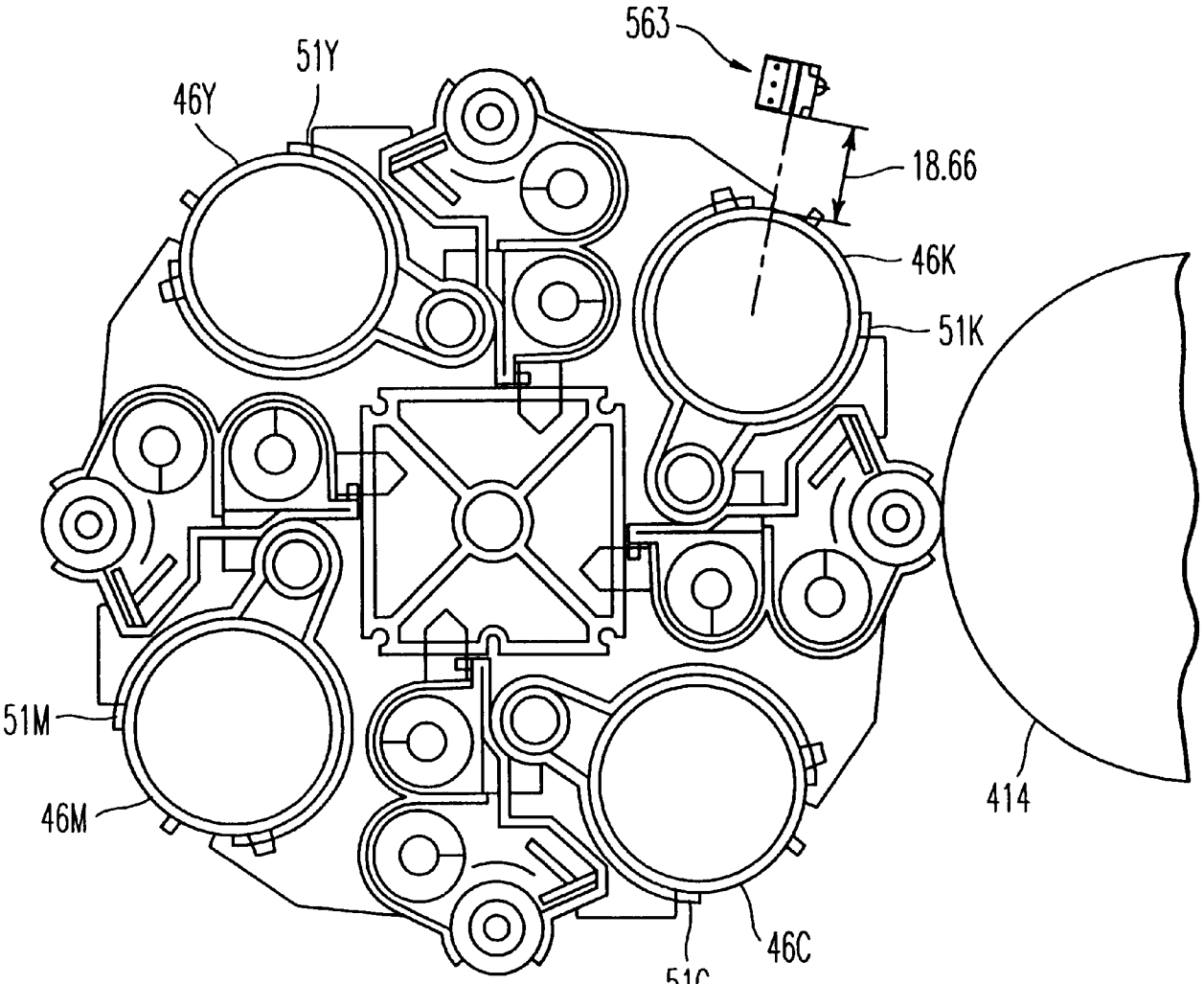
FIG. 38 is a schematic diagram of a revolving type developing apparatus for explaining a detection of a presence or absence of a toner cartridge.

As shown in FIG. 38, a toner cartridge position sensor 563 is employed in the body 500A for detecting whether the toner cartridge 46K is properly set at a predetermined position in the toner cartridge guide 51K. The color image forming apparatus is controlled not to start operation thereof when the toner cartridge position sensor 563 indicates that the toner cartridge 46K is not properly set.

Hereinbelow, a transmission of each of the developing units 420U of the revolving type developing apparatus 420 is explained. Since each of the developing units 420U is driven by a common driving source in a same manner, only a transmission for the black developing unit 420K is explained referring to FIG. 39.

Figure 39:
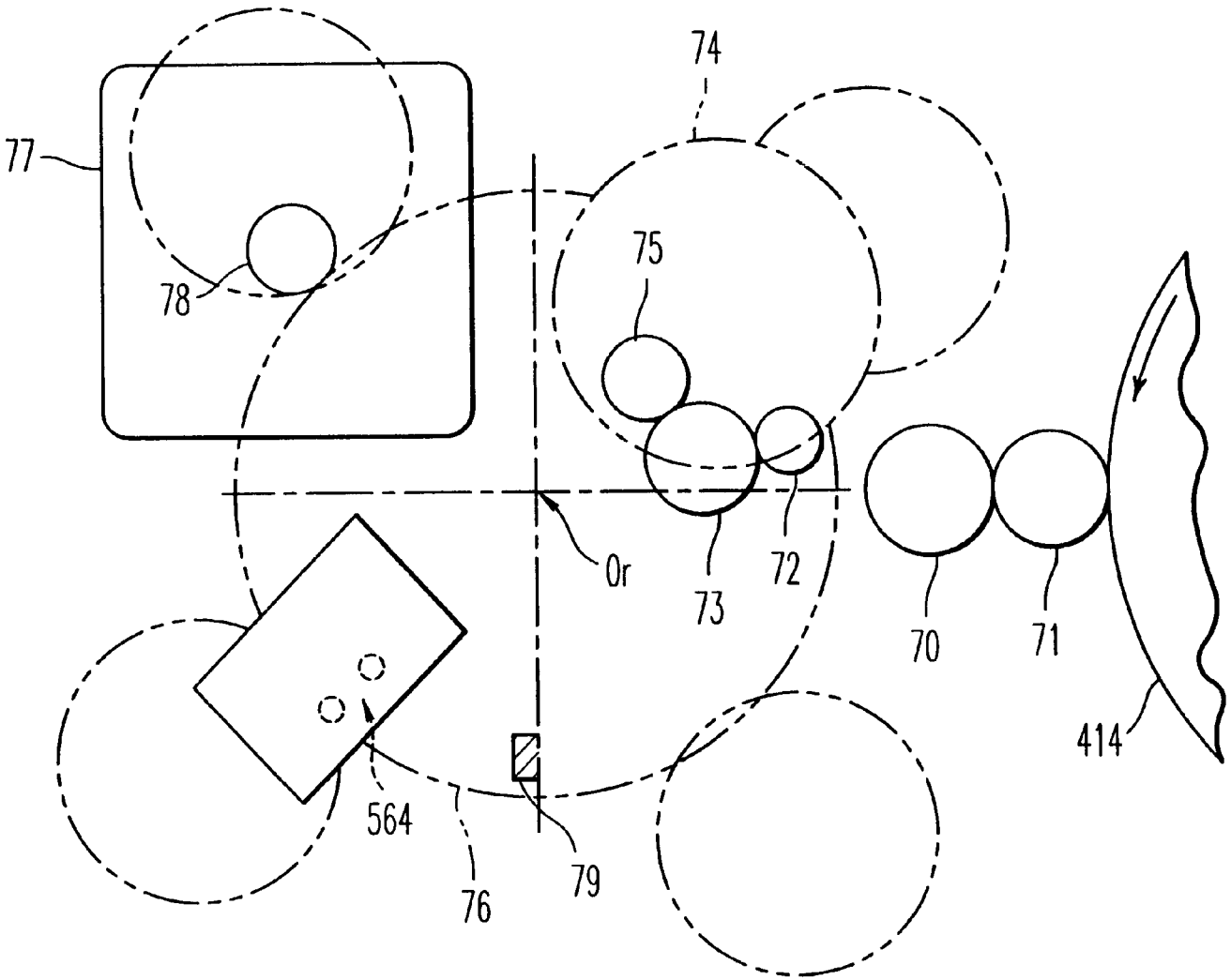
FIG. 39 is a schematic diagram illustrating a constitution of a driving system of a revolving type developing apparatus.

As shown in FIG. 39, a rotational force is transmitted to a developing device driving input gear 70 via a clutch (not shown) from the driving source disposed in the body. The developing device driving input gear 70 meshes with a developing sleeve gear 71 disposed in the developing device 420K when the developing device 420K faces the PC drum 414 and is stopped. A developing sleeve of the developing roller 41K and the first and second screws 42K, 43K are respectively driven when the developing sleeve gear 71 is driven.

The toner supplying screw 49K is driven when the developing device 420K faces the PC drum 414 and is then stopped and a toner supplying idle gear 73 meshes with a toner supplying screw gear 72 mounting the toner supplying screw 49K thereon. Such a toner supplying idle gear 73 is driven by a toner supplying motor gear 75 fixedly mounted on an output axis of a toner supplying motor (not shown) disposed in the revolving type developing apparatus.

A stepping motor as a revolving motor 77 for revolving the above described developing units 420U and a revolving motor gear 78 fixed to an output axis of the revolving motor 77 are mounted on the body 500A. A revolving gear 76 is mounted on the axis 40 of the revolving type developing units 420U when set in the unit supporter 520 and meshes with the revolving motor gear 78 when the unit supporter 520 is set to a predetermined operational position in the body 500A. Thus, if the revolving motor 77 rotates, the developing unit 420U is rotated toward the developing station.

The developing unit 420U is controlled to stop at a predetermined position by using a home position detector 564 and a detection mark 79 put on a predetermined portion of the revolving gear 76. Namely, the developing units 420U is controlled to stop when rotated by an angle of 45° after the detection mark 79 is detected by the home position detector 564, for example. The above described angle of 45° is obtained by counting predetermined pulses generated by the revolving motor 77.

Figure 40:
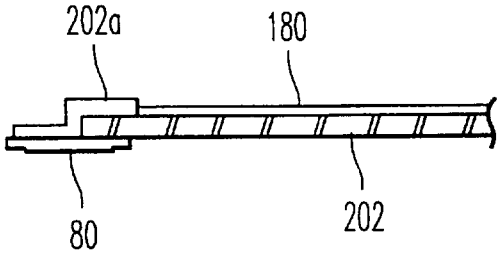
FIG. 40 is a schematic diagram illustrating a position of a P sensor pattern of an image forming apparatus.
Figure 41:
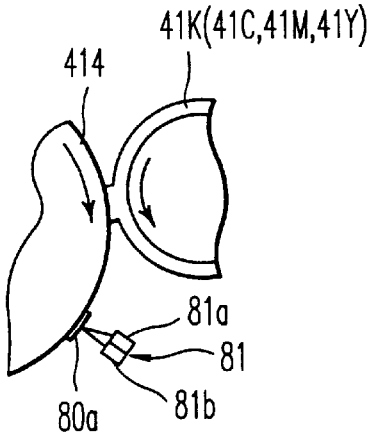
FIG. 41 is a explanatory diagram for explaining a toner density detecting method of an image forming apparatus of the present invention.

Hereinbelow, a process control of the above described embodiment is explained. First, a method for a toner density control is explained. A photo-sensor (hereinbelow referred to as a P sensor) is selectively used among a variety of sensors in the embodiment. Density is detected by the P sensor in a manner as described below. As shown in FIG. 40, a P sensor pattern 80 is located below a side scale 202*a* mounted on an edge portion of a platen glass 202 which is used for aligning a document 180 set thereon. As shown in FIG. 41, a latent image and a corresponding toner image 80*a* for a P sensor 81 are formed on the PC drum 414 by using an electrophotographic process. A density of image 80*a* is detected by P sensor 81 disposed adjacent to the PC drum 414 which includes a photo transistor 81*a* and a luminescence diode 81*b*.

Figure 42A:
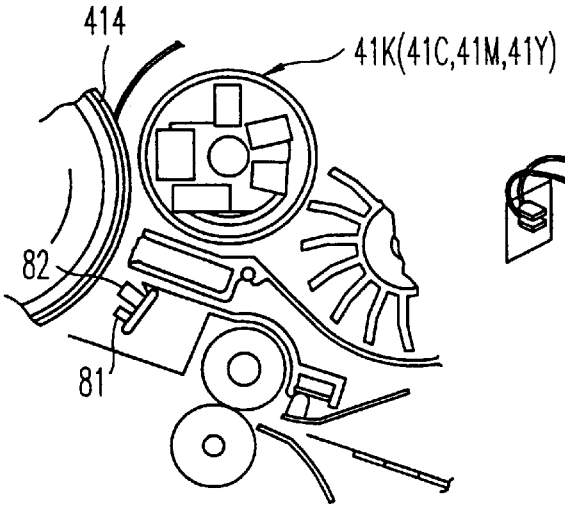
FIG. 42(*a*) is a schematic side view illustrating an arrangement position of a P sensor in a toner density detecting method.
Figure 42B:
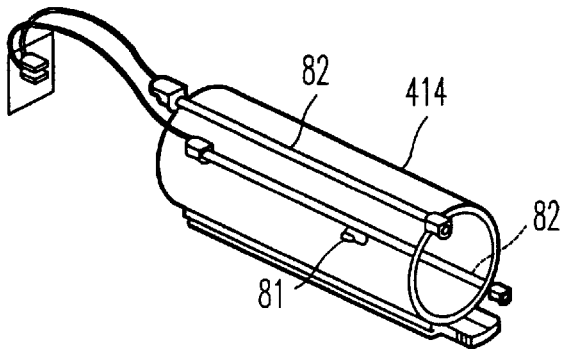

As understood from FIGS. 40 and 41, the P sensor pattern toner image 80*a* is formed on a portion of the periphery of the PC drum 414 slightly upstream of a toner image of the document to be formed thereon, and thereby the P sensor toner pattern 86 does not appear on the toner image. Such a P sensor pattern toner image 80*a* is controlled by a controller to be formed, e.g., once per 10 copying operations. Further, after density is detected, the P sensor toner image pattern 80*a* is generally eliminated by an eraser 82 as shown in FIGS. 42(*a*) and 42(*b*).

Figure 51:
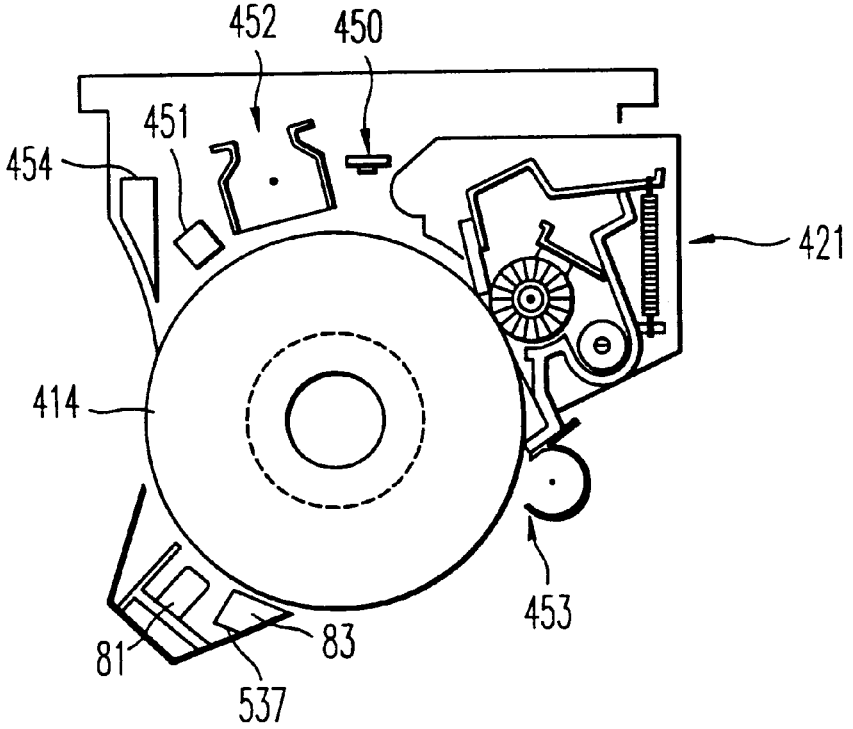
FIG. 51 is a constitutional diagram of an equipment arranged around a photoconductive drum of a photosensitive unit.
Figure 52:
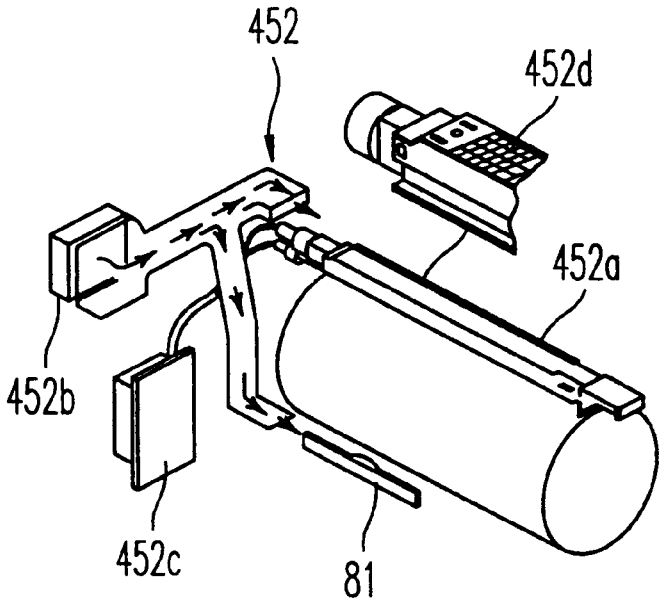
FIG. 52 is a schematic perspective view illustrating a constitution of a charging unit arranged around a photoconductive drum.

A PTL lamp as a pre-transfer charge eliminating device 83 is employed as shown in FIG. 51. An LED is used as a PTL lamp and irradiates a light beam to the periphery of the PC drum 414 so that an electrostatic attraction force for the toner in the toner image to the PC drum 414 is decreased. Thus, retransfer of the toner image onto the periphery of the PC drum 414 is avoided, since almost all of the toner image formed on the PC drum 414 is transferred onto the copy-sheet. A positional relation between the above described devices is illustrated in FIG. 42.

Figures 43A, 43B:
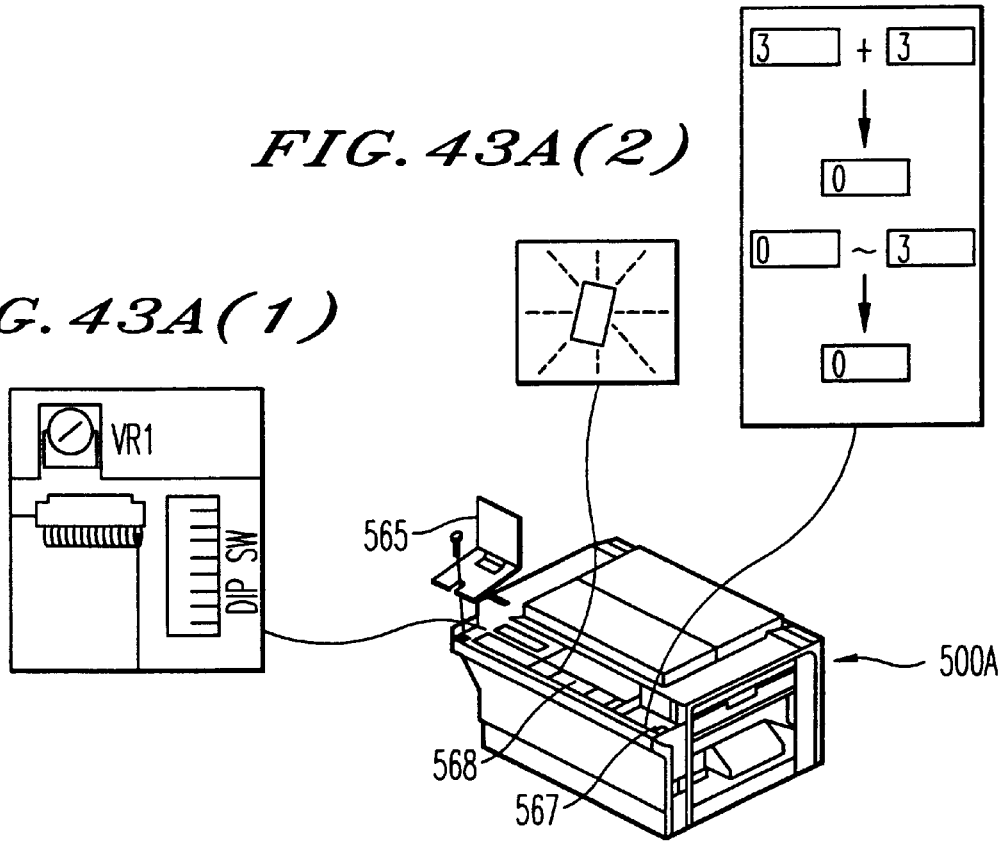
FIG. 43(*a*) is an explanatory diagram for explaining a bias setting procedure for forming an image in a P sensor pattern with black toner.

A developing bias applying control is executed as described below. If black toner is used, a P sensor voltage, for example, 500V is applied only when the P sensor pattern is formed, and a voltage of 260V is constantly applied for another surface thereof. Such voltages are changed as described below. Firstly, as shown in FIG. 43(*a*), a dip switch (DIP SW) is provided on an outer case of the body 500A and is accessible when a dip switch cover 565 is opened. A dip switch is turned on by an operator. Secondly, a key for setting a P sensor mode is provided on an operation panel 567 of the body 500A. A plurality of numbers, e.g., 3 and 3, and an enter key, e.g., #, are input by an operator to set the P sensor mode. Thirdly, a magnification display 568 is provided beside the operation panel 567 and a bias voltage presently set is displayed therein. Fourthly, a new desired bias voltage is set with ten keys disposed in the operation portion 567 referring to a table as shown in FIG. 43(*b*). As an example, a plurality of numbers 0, 1, 2 and 3 shown in each of columns and an enter key 4 are input thereinto.

Figures 44A, 44B:
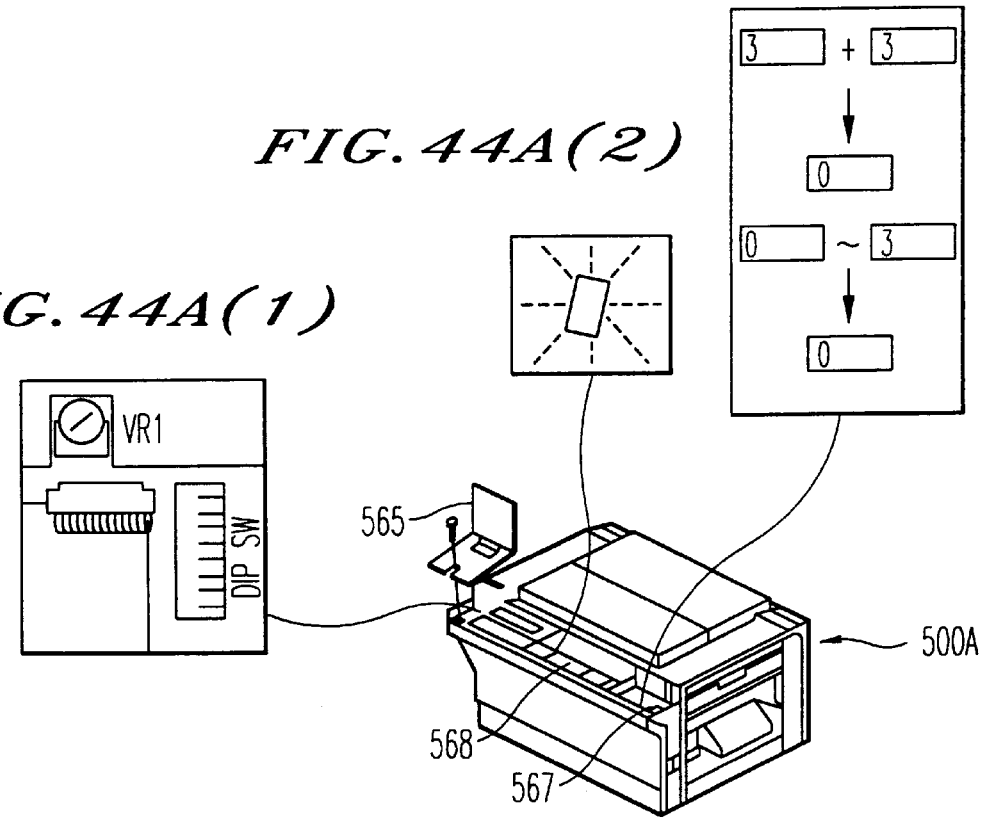
FIG. 44(*a*) is an explanatory diagram for explaining a bias setting procedure for forming an image in a P sensor pattern with color toner.

If color toner is used, a bias changing control is executed by a procedure as described below. Firstly, a dip switch (DIP SW) is turned on in a manner as described above. Secondly, the P sensor mode is set by inputting a plurality of numbers, e.g., 7 and 5, and an enter key, e.g., #, through the ten keys. Thirdly, a bias voltage presently set is displayed on the magnification display 568. Fourthly, a new desired bias voltage is set with ten keys referring to a table as shown in FIG. 44(*b*). Namely, a plurality of numbers 0, 1, 2 in each of columns of and an enter key # is set thereinto.

The density is detected by detecting a change in a plurality of densities of the P sensor toner pattern 80*a* which is periodically detected by the P sensor 81, since it corresponds to that of the toner density. As described above, density detection for the P sensor pattern 80*a* is executed at a time when a main switch is turned on and when every ten copying operations have been completed. In such a detection, if the P sensor 81 detects that the density of the p sensor pattern 80*a* is thinner than a predetermined range, a toner supplying solenoid (not shown) for supplying new toner is activated once by one copying operation until a tenth copying operation is completed, and thereby toner is transferred into a corresponding developing device.

Figure 45A:
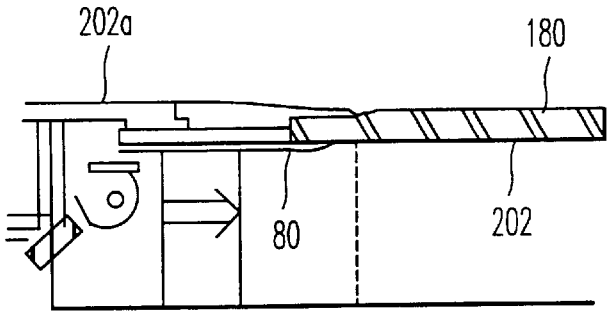
FIG. 45(*a*) is an explanatory diagram of an operation timing in forming an image with a P sensor pattern.
Figure 45B:
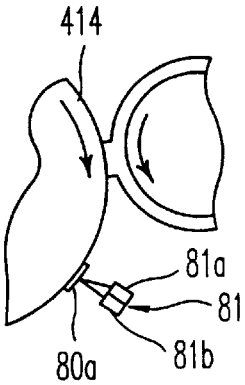
Figure 45C:
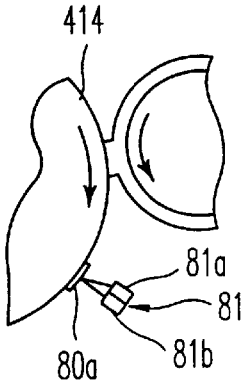
Figure 46:
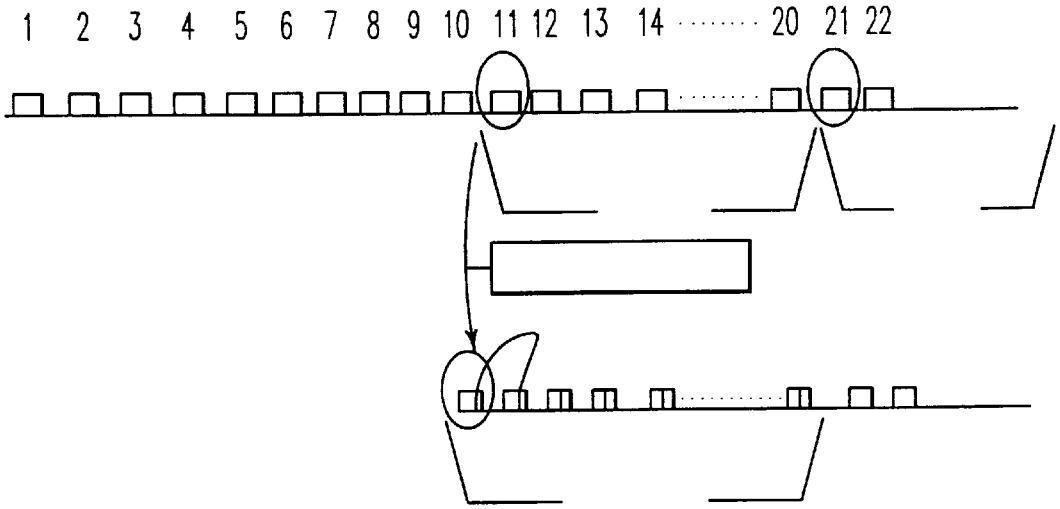
FIG. 46 is a timing chart illustrating a detecting timing of a P sensor and a toner supplying timing.
Figure 47:
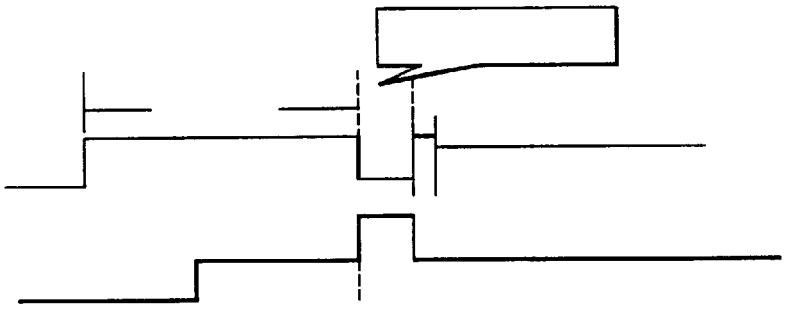
FIG. 47 is a timing chart illustrating an image formation timing of a P sensor pattern.

As shown in FIGS. 45 and 47, before density of the P sensor pattern 80*a* is detected, the P sensor pattern 80*a* is formed by setting codes "an all area ON", "a P sensor pattern erase" and "an all area ON" at a portion upstream of the toner image of a document to be formed on the periphery of the PC drum 414. The code "an all area ON" indicates that all surfaces of the PC drum are erased. The code "a P sensor pattern erase" indicates that a latent image of the P sensor pattern 80 is formed thereon. When developing, a bias voltage of, e.g., 470V is applied when the P sensor pattern 80*a* is developed by the black developing device 420K, and that of, e.g., 590V is applied when developed by color toners. Further, When density thereof is detected, the luminescent diode 81 is activated to irradiate a beam to the P sensor pattern 80*a* and at a same time the photo transistor 81*a* receives a reflected light from the P sensor pattern 80*a*, when the P sensor pattern 80*a* comes to a density detecting portion where the P sensor 81 is located.

The P sensor also detects density of the periphery of the PC drum 414 after the P sensor pattern 80*a* has passed through the density detecting position and after the periphery of the PC drum 414 is erased. Then, the P sensor generates a density signal VSG. Such a density is generally almost constant. To the contrary, a density signal VSP is obtained by detecting the P sensor pattern 80*a* as described above. The above density detection is executed by comparing each of outputs of VSG and VSP. Further, as described above, a bias voltage of 500V is applied during developing thereof for developing the P sensor pattern 80*a* to avoid influence of a notch of the P sensor pattern 80*a*. A toner supplying signal is generated, if a formula of "VSP−(⅛VSP) >0" is established.

Figure 48A:
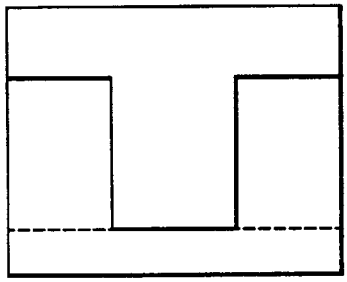
FIG. 48(*a*) is a diagram illustrating an output signal of a P sensor issued when a toner density is appropriate.
Figure 48B:
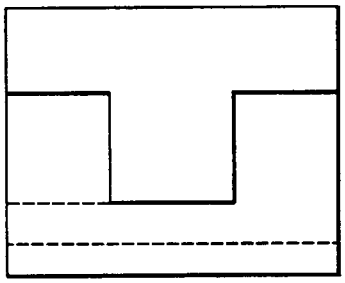
Figure 48C:
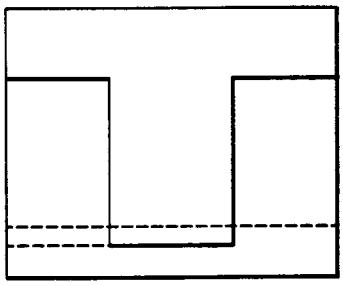

In the above described condition, as shown in FIG. 48(*a*), an output voltage VSP for the P sensor pattern indicates 0.5V, when a density of the toner of the developer is within a predetermined proper range, which corresponds to an output voltage VSG of 4V as a standard voltage.

When a density of the toner of the developer becomes relatively thinner, density of the P sensor pattern 80*a* accordingly becomes thinner. In such a case, since an output voltage VSP of the P sensor become larger as shown in FIG. 48(*b*), some amount of toner is newly supplied until the next P sensor pattern detection is executed. Further, if the above described P sensor output VSP ranges from 0.4V to 0.6V, toner is supplied at a half ration of a predetermined toner supplying ratio for the P mode. If the above described P sensor output VSP ranges from 0.6V to 0.75V, toner is supplied in the predetermined toner supplying ratio for the P mode. If the toner is excessively supplied, since an amount of toner stored in the developer becomes larger, the P sensor output voltage VSP becomes lower as shown in FIG. 48(*c*), and thereby toner supplying is stopped.

Hereinbelow, methods for a toner end detection and toner recovery are respectively explained. The above described P sensor is used for detecting the toner end detection. Namely, if the P sensor output voltage VSG continuously keeps a predetermined lower range, the controller regards that the toner to be required in a developing process does not exist in the toner cartridge and a toner end signal is output. The used toner cartridge is discarded and a new toner cartridge is furnished into the image forming apparatus. In such a case, if a copy operation is requested by an operator just after that, since density of the developer is still lower than the predetermined range, a toner end signal is output.

Then, a toner recovery mode is automatically set and toner is then continuously supplied from the toner supplying device to the developing device to increase density of the developer to a predetermined range for a predetermined time interval after the toner cartridge is exchanged. Whether such a toner recovery mode is executed is judged by checking the above described P sensor output voltage VSP. In addition, whether the used toner cartridge is exchanged to a new one is also judged in a same manner as described above by checking the density.

Figure 49:
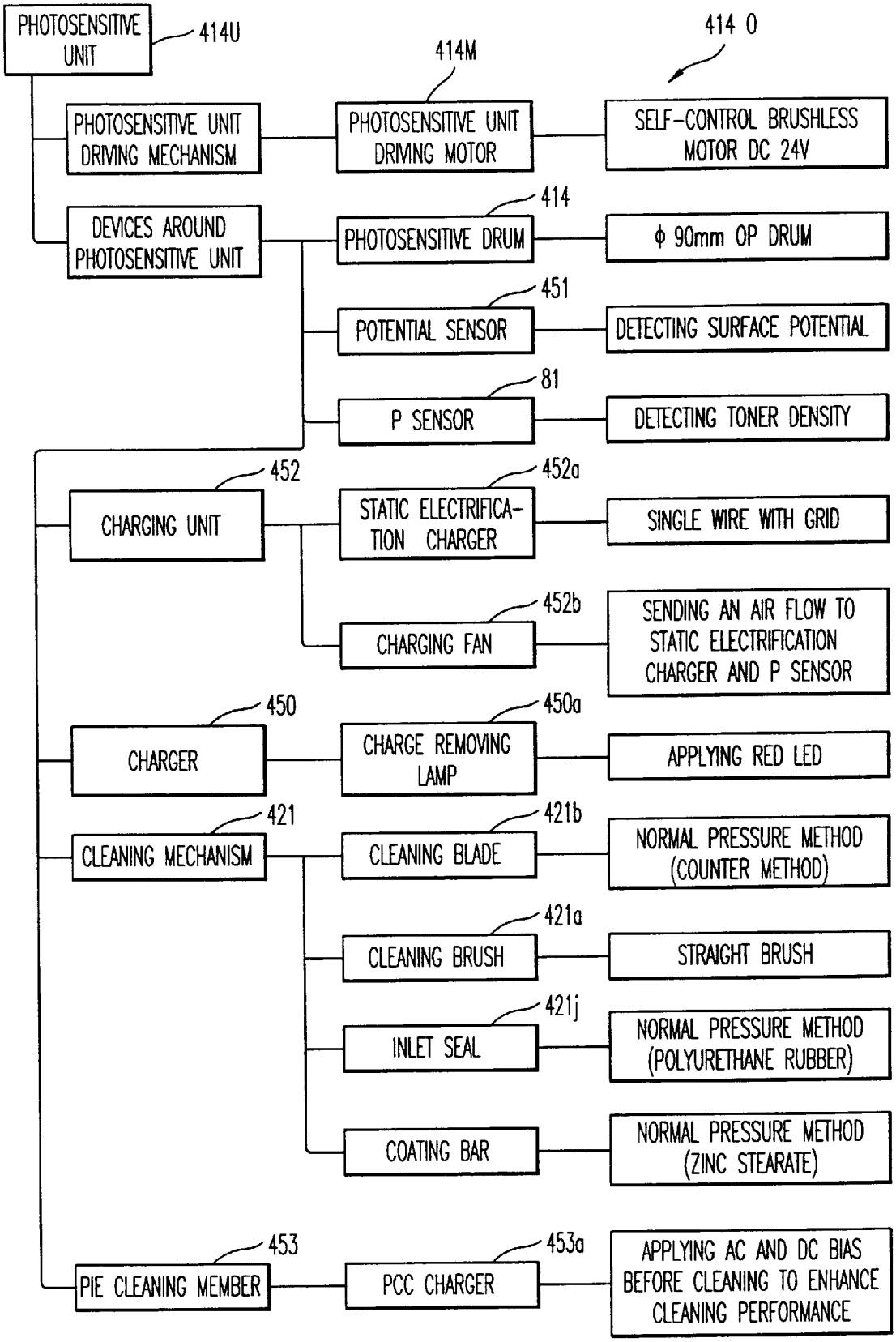
FIG. 49 is a block diagram illustrating a constitution of a photosensitive unit in an image forming apparatus of the present invention.

Hereinbelow, the structure of a PC drum unit 414U of the image forming apparatus is explained. A block chart showing the structure of the PC drum unit 414*u* is shown in FIG. 49. As shown in FIG. 49, the PC drum unit 414U is roughly categorized into two, namely a PC drum unit driving mechanism and peripheral devices disposed around the PC drum 414.

Figure 50:
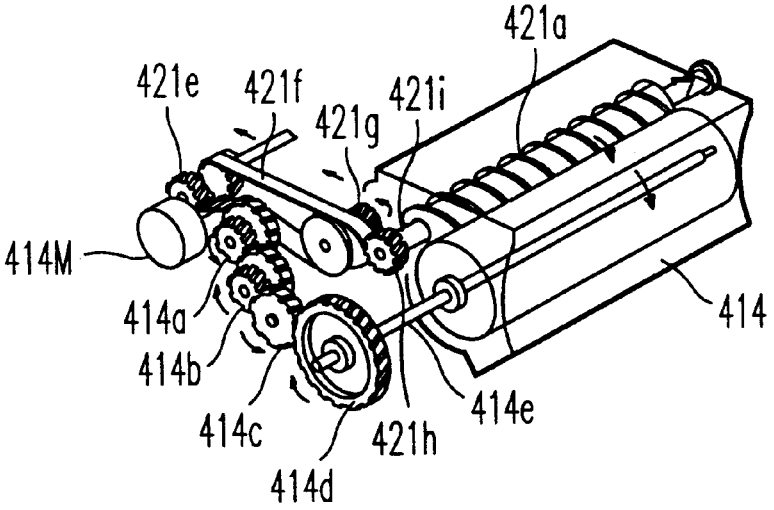
FIG. 50 is a schematic perspective view illustrating a driving mechanism of a photosensitive unit.

As shown in FIG. 50, the PC drum unit driving mechanism includes a PC drum driving motor 414M and a plurality of drum driving gears 414*a*, 414*b*, 414*c* and 414*d* for cooperatively transferring a rotational force caused by the PC drum driving motor 414M to a PC drum driving axis 414*e*, as shown in FIG. 23. The driving force of the PC drum driving motor 414M is also transferred to a driving axis 421*i* of a cleaning brush 421*a* through a belt driving gear, a timing belt 421*f*, brush driving gears 421*g*, 421*f* and so on which are respectively explained later in detail.

The PC drum driving motor 414M can be composed of a brushless motor for which an rpm thereof is controlled by an rpm control circuit in a manner of a self control. The PC drum 414 includes a fly wheel mounted on the drum driving axis 414*e* for avoiding unevenness of rotation of the PC drum 414. The drum driving gear can be used as such a fly wheel.

The PC drum driving mechanism rotates in a reverse direction after a copying operation job is finished by about 0.7 mm during 0.06 sec to remove developer remaining on a periphery of the PC drum 414 at a contact portion between an edge of a cleaning blade 421*b* explained later in detail and the periphery of the PC drum 414.

As shown in FIGS. 49 and 51, the PC drum peripheral devices include the PC drum 414, a voltage sensor 451, the P sensor 81, a charging member 450, a cleaning mechanism 421, a pre-cleaning charging member 453, and a toner absorbing duct 454 for absorbing toner scattered around the developing station.

The PC drum 414 is composed of an OPC drum having a diameter of, e.g., 90 mm. The voltage sensor 451 is disposed downstream of the charging unit 452 for sensing voltage of the periphery of the PC drum 414. The P sensor 81 is disposed in a stay 537 of the unit supporter 520 which functions as a wind transfer duct for avoiding contamination of the P sensor 81 and sensing density of the P pattern 80*a*.

The charging unit 452 includes a charger 452*a* and charger fan 452*b*. If a peripheral speed of the PC drum 414 is 105 mm/sec, namely slow enough, a single scorotron charger is used as the charger 452*a*. A high voltage electrical power source 452*c*, referred to as a power pack, is employed and an output voltage thereof is set at, e.g., −5 kv. The charger unit 452*a* includes a grid 452*d* having a honeycomb structure for regulating a peripheral voltage of the PC drum 414 at, e.g., −670v as a standard range thereof. A grid bias is applied and is controlled by a controller (not shown) to keep the peripheral voltage of the PC drum 414 within a predetermined range. The charger fan 452*b* sends air to the charger 452*a* to suppress unevenness of charge to be put on the periphery of the PC drum 414. The air is further transported to the P sensor 81 through the stay 537 as shown in FIG. 51 serving the air transportation duct 452*d* to suppress the contamination of the P sensor by toner.

Figure 53:
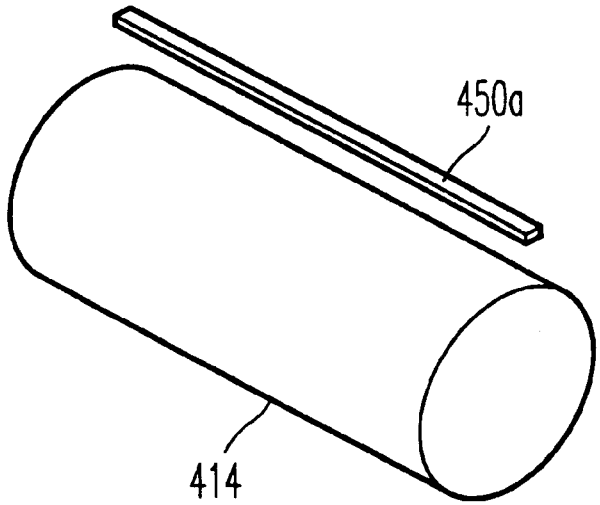
FIG. 53 is a schematic perspective view illustrating a constitution of a charging element arranged around a photoconductive drum.
Figure 54:
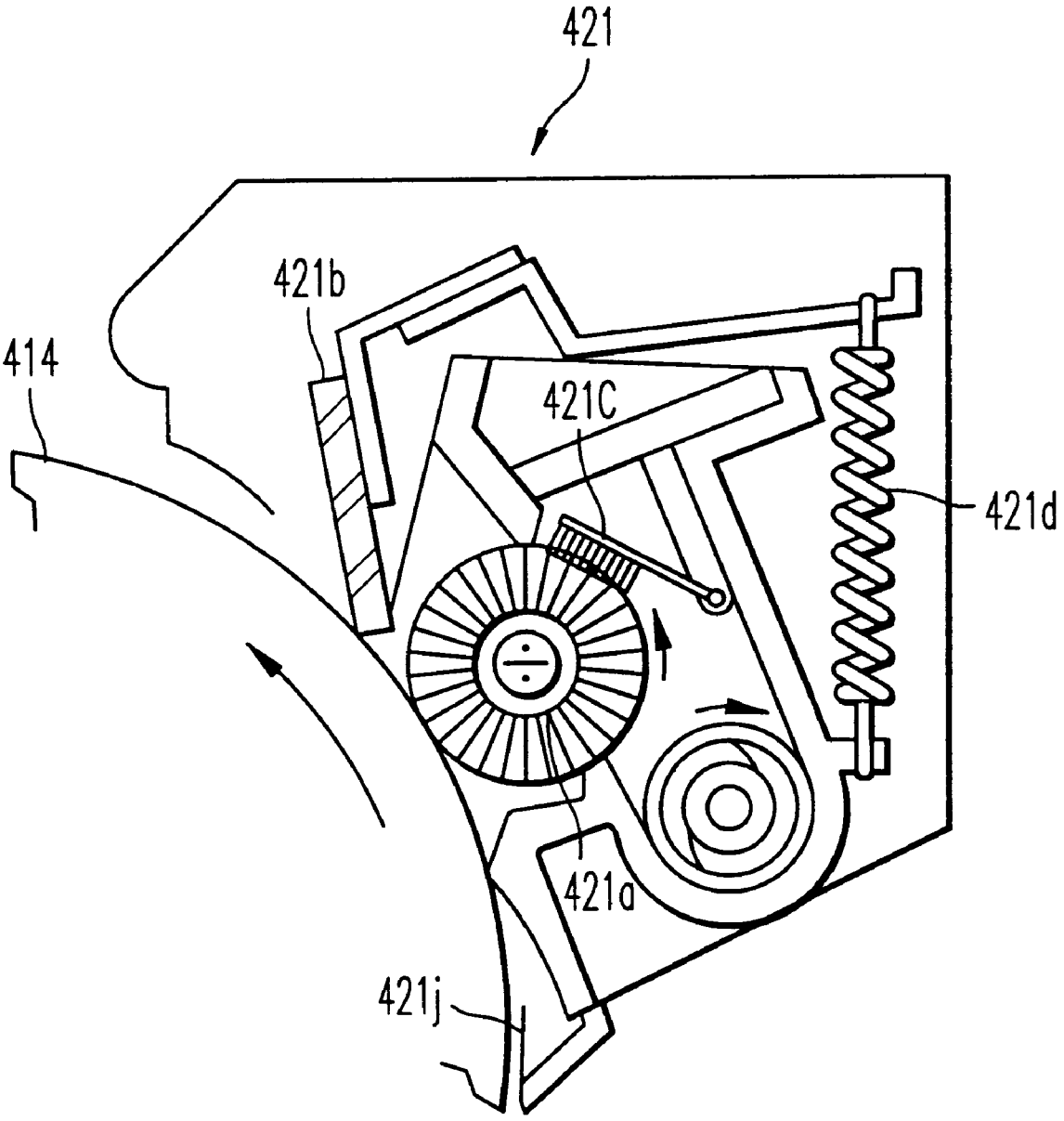
FIG. 54 is a schematic constitutional diagram illustrating a constitution of a cleaning mechanism arranged around a photo-conductive drum.

The charger 450 includes a charge eliminating lamp 450*a* as shown in FIGS. 51 and 53 for removing a charge from the PC drum 414. A LED can be used for the charge eliminating lamp 450*a* for optically removing the charge. When the charge on the OPC drum 414 is to be removed, a charge start key (not shown) is turned on to rotate the PC drum 414, and the charge eliminating lamp 450*a* is turned on to irradiate a light beam toward the periphery of the PC drum 414. Thus, the charge on the PC drum 414 is optically eliminated therefrom. For avoiding an optical fatigue of the PC drum 414, a red beam generating member can be used for the charge eliminating lamp 450*a*.

The cleaning mechanism 421 is disposed upstream of the charger 450 for removing residual toner on the PC drum 414. The cleaning mechanism 421 includes a cleaning brush 421*a* and a cleaning blade 421*b* for cooperatively scraping the toner off the PC drum 414. A straight state brush can be employed for the cleaning brush 421 and a coating bar can contact thereto as biased by a biasing spring to apply stearic alcohol acid thereto. Such a stearic alcohol acid improves a cleaning ability of the cleaning brush 421 and sharpness of a toner image to be formed on the PC drum 414.

An edge of the cleaning blade 421*b* contacts with the PC drum 414 in an opposite direction to a rotational direction of the PC drum 414. Such a cleaning blade 421*b* is biased by a blade biasing spring 421*d* suspended between a case of the cleaning mechanism 421 and a supporting bracket of the cleaning blade 421*d*. The bias can be removed by a bias removing is member (not shown) when the image forming apparatus is shipped, for example. An entrance seal 421*j* is disposed at an edge portion of an opening of the case of the cleaning member 421 for sealing the opening to avoid influence of the toner scattering to be occurred therefrom.

The pre-cleaning member 453 includes a pre-cleaning charger (PCC) 453*a* disposed upstream of the cleaning mechanism 421 for applying a bias voltage including both an AC and +DC onto the periphery of the PC drum 414 for increasing a cleaning ability of the cleaning mechanism 421.

The above described PC drum peripheral members are united so as to form a unit of a PC drum unit 414U and is upwardly removable from the withdrawal support member 520 as shown in FIG. 22.

Figure 55:
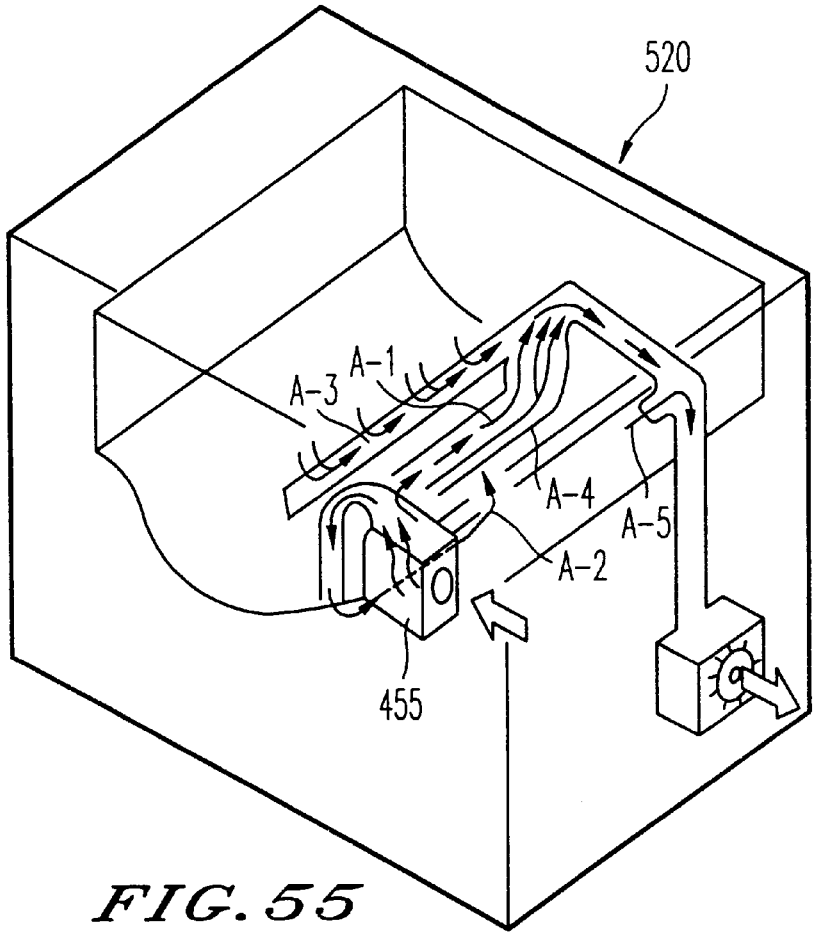
FIG. 55 is a schematic perspective view illustrating a flow of air in a pulled-out supporter.
Figure 56:
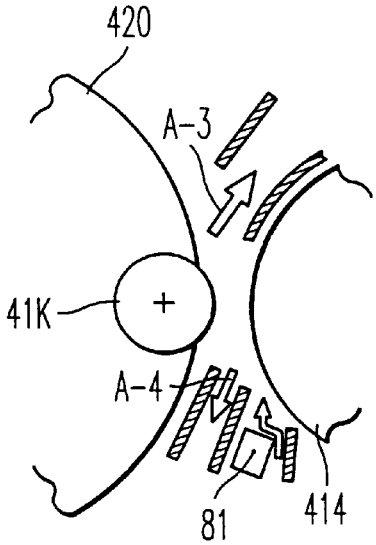
FIG. 56 is a schematic diagram illustrating a flow of air in a developing station between a developing roller and a photo-conductive drum.
Figure 57:
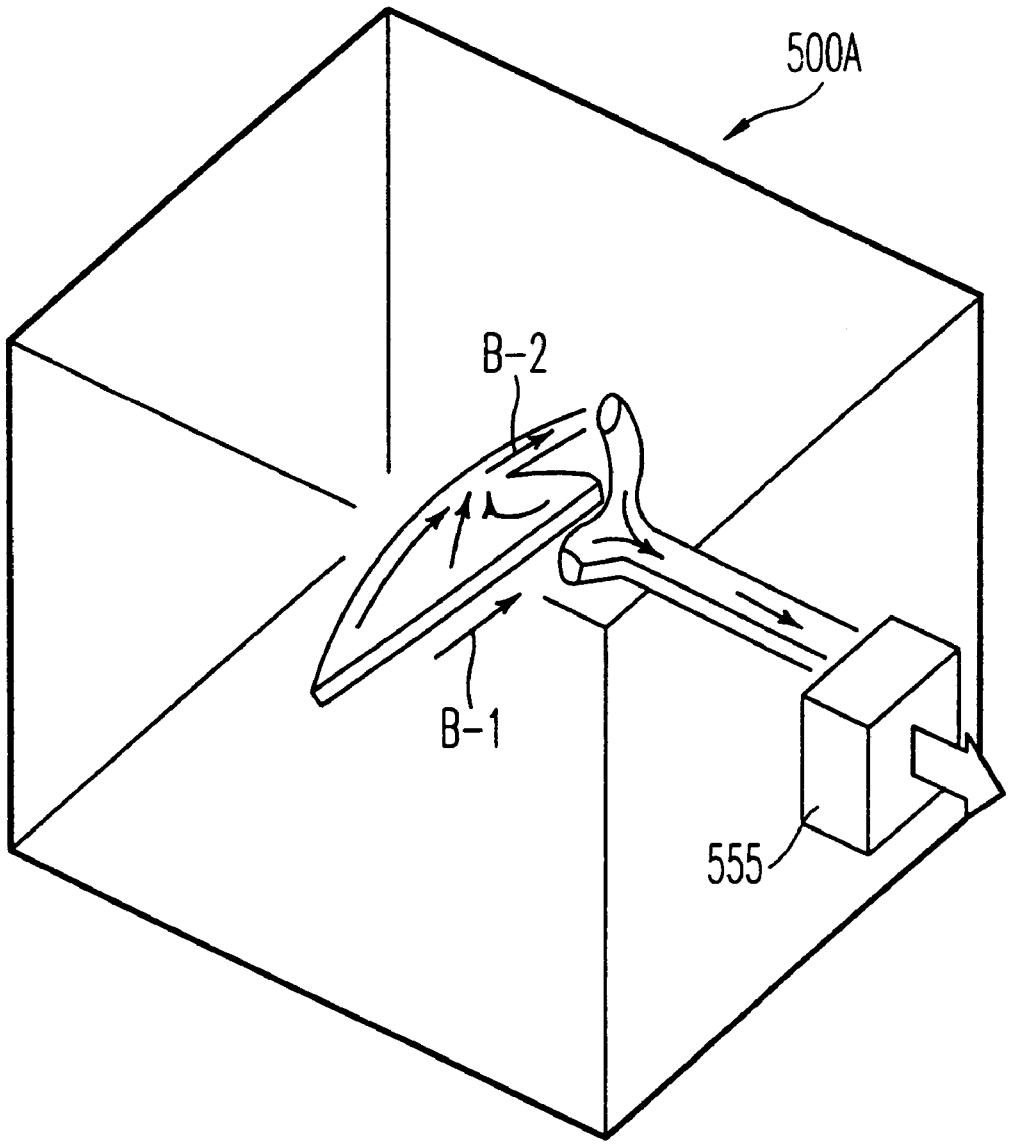
FIG. 57 is a schematic perspective view illustrating a flow of air in a body of an image forming apparatus of the present invention.

Air streams can also be provided in the image forming apparatus. For example, a pair of air streams are formed respectively through the withdrawal support member 520 and the body of the image forming apparatus as respectively shown in FIGS. 55 and 57. As shown in FIG. 55, the air stream flowing through the withdrawal support member 520 includes a stream A-1 flowing from a front side of the charger 452*a* to a rear side thereof, a stream A-2 flowing from the P sensor 81, absorbing streams A-3, A-4 as shown in FIG. 56 for respectively absorbing dispersed toner from the developing station, and an absorbing stream A-5 flowing from the pre-cleaning charger 453*a*. The above described streams are united by a first ejecting duct mounted on a rear portion of the withdrawal member 520 and is then ejected to an outside of the body 500A through a second ejecting duct mounted on the rear side plate of the body 500A. Such a second ejecting duct is connected with the first ejecting duct.

Further, a stream B-1 is provided for absorbing both dispersed toner from a cleaning station of an intermediate transfer belt 415 and lubricating material coated thereon.

Further, an air steam B-2 is also provided for absorbing ozone produced at both the pre-cleaning charge portion and a second transfer station where the toner image is transferred onto the copysheet.

An air which flows through the image processing member disposed around the PC drum 414 is absorbed by an ejecting fan 555 mounted on a rear portion of the body 500A. An air blowing fan 455 is mounted on a front portion of the unit supporter 520. Such an air blowing fan 455 blows air against the P sensor 81.

As illustrated in FIG. 22, the above described revolving type developing apparatus 420 and a PC drum unit 414U including a plurality of processing members around the PC drum 414 are mounted on the withdrawal support member 520. Such a withdrawal support member 520 is removable from the body of the image forming apparatus.

If the above described sliding member 255 which includes the fixed rails fixed to the body 500A and the sliding rails respectively slidably connected with each of the fixed rails for supporting and sliding the unit supporter 520 has a length of 500 mm when installed in the body 500A and 650 mm when expanded, if an operator withdraws the withdrawing support member 520 from the body 500A, he or she can maintain the processing members and/or the PC drum 414 at a front position without taking a burdensome posture and can withdraw and install there save in a same condition thereto. Further, in a state that the unit supporter 520 is withdrawn from the body 500A, more than one of the developing units 420U of the revolving type developing apparatus 420 and the PC drum unit 414U are respectively enabled to be removed upwardly as illustrated by an arrow C shown in FIG. 22 from the unit supporter 520. Accordingly, the operator can maintain both units and selectively remove each of those units therefrom in a state of standing beside the withdrawal-supporting unit 520.

Further, as described earlier referring to FIG. 23, the developing gaps (Gp) which are formed between each of the developing rollers of different mono color developing units and the PC drum 414 when one of the different mono color developing units faces the PC drum 414 is related to a distance between the expanding center line (Or) of the rotary shaft 40 of the revolving type developing apparatus and the expanding center line (Op) of the rotary shaft 40. Accordingly, since the distance between the expanding center line (Or) and the expanding center line (Op) is determined by both the front and rear side plates 521 and 522 of the unit supporter 520, each of the gaps (Gp) are respectively enabled to be adjusted on the unit supporter 520.

To explain the gap more in detail, the front side portion of the rotary shaft 40 of the revolving type developing unit 420 is supported by the ball bearing 526 mounted on the front side plate 521 of the unit supporter 520 and the rear side portion thereof is supported by the bearing member 527 mounted on the rear side plate 522. Further, the front side portion of the center of the PC drum 414 is supported by a holding axis 528*a* mounted on the front side holder 528 of the withdrawal supporting unit 520 and the rear side center portion thereof is supported by a drum driving shaft 414*e* mounted on the rear side holder 531 which enters into the unit supporter 520 when the same is set at a predetermined position in the body 500A. Thus, the PC drum 414 is mounted in a state that the same freely rotates around the axis thereof.

Thus, the revolving type developing apparatus generally having a heavy weight is enabled to be strongly supported during withdrawing thereof as if the apparatus is directly supported by the body 500A. Further, since the unit supporter 520 is enabled to be assembled as a unit, assembling thereof is highly improved.

In addition to the above, since the reference pin 534 mounted on the front side plate 521 of the withdrawal supporting unit member 520 is inserted into the reference hole 535 when the unit supporter 520 is set to the body 500A, both positional relations between the PC drum unit 414U, and the revolving type developing apparatus 420 and the PC drum unit 414U and the body 500A are respectively kept precisely.

Further, as described earlier referring to FIGS. 23, 24(*a*) and 24(*b*), the boss 536 mounted on the slide rail 525 fixed to the body 500A is inserted into the recess 523*a* formed on the stay 523 of the unit supporter 520 when the unit supporter 520 is set thereto. Namely, the same is supported without using a fixing member, and thus the unit supporter 520 is enabled to be easily upwardly removed from the body 500A to the outside of the body 500A when withdrawn.

Since the gap (d) is made between the recess 523*a* and the boss 536 when the unit supporter 520 is set to the body 500*a* as shown in FIG. 24(*b*), positioning of the unit supporter 520 at the predetermined position in the body 500A is made without needless interference therebetween. Thus, the drum driving shaft 414*e,* the rear side portion of the rotary axis 40 and the reference pin 534 are smoothly inserted into the sliding ball bearing 529, the sliding ball bearing 532, and the reference hole 535 respectively.

Figure 58:
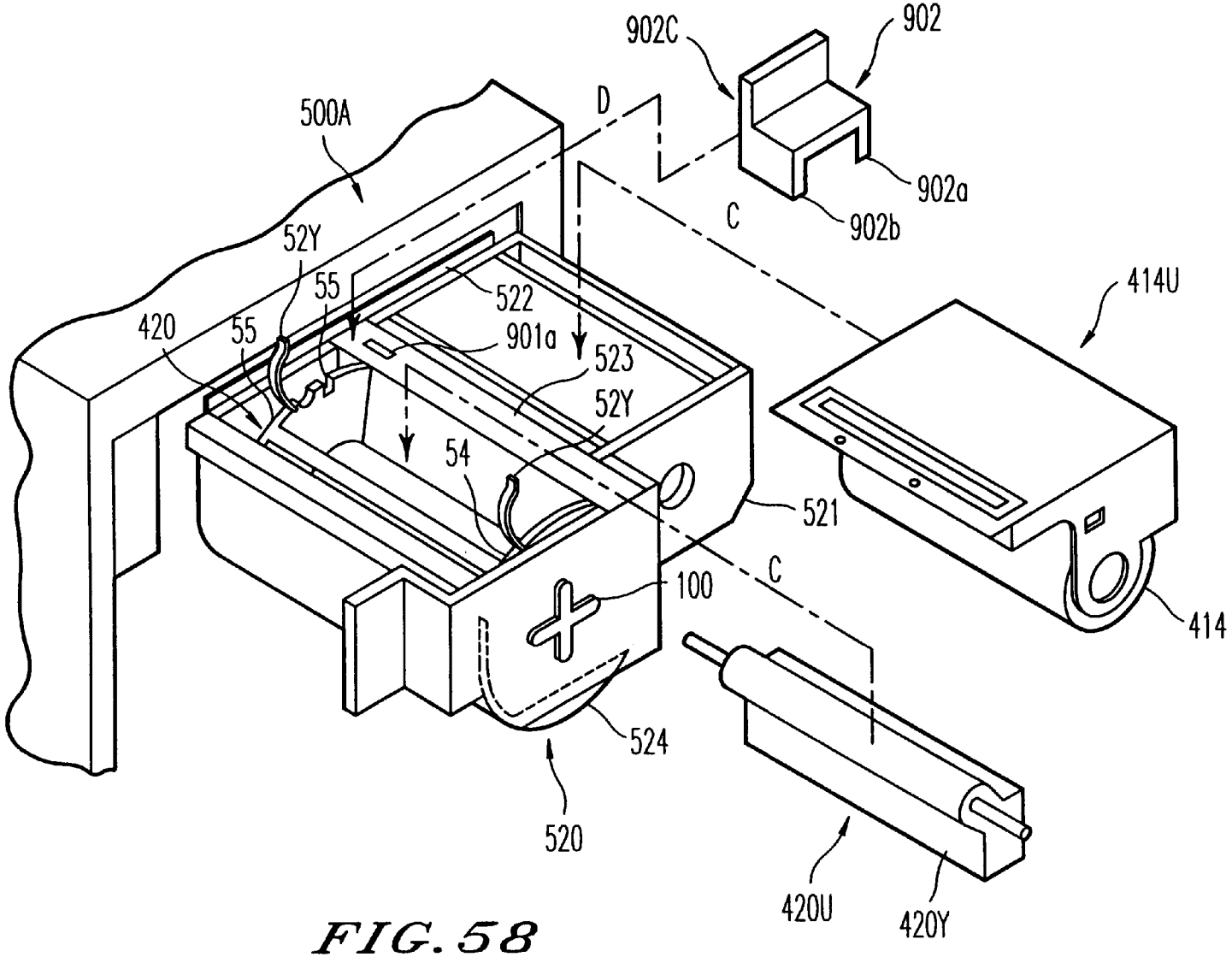
FIG. 58 is a perspective view of a pulled-out supporter of a printer.
Figure 59:
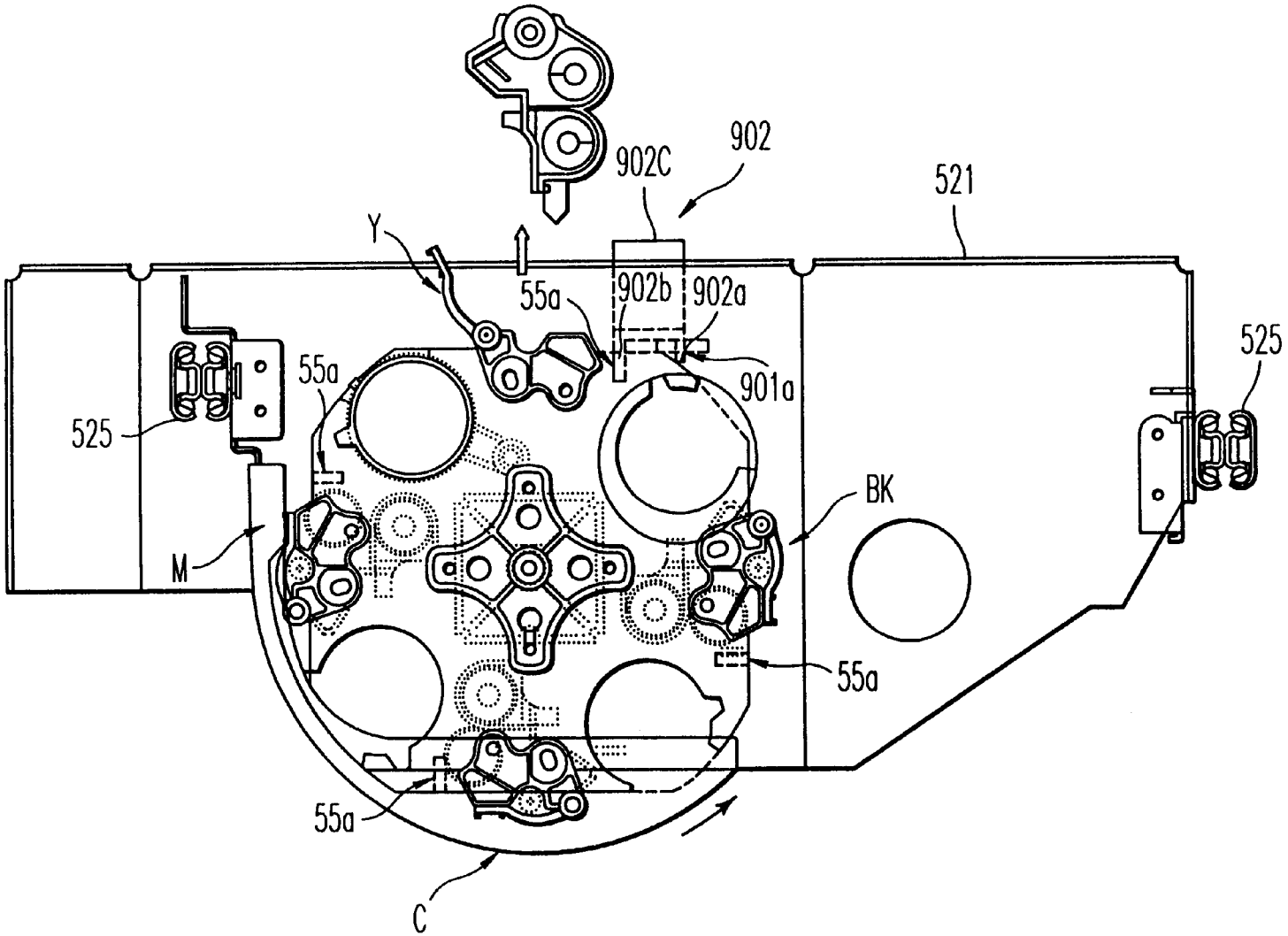
FIG. 59 is a front view of a pulled-out supporter.

Hereinbelow, a slightly modified embodiment is explained referring to FIGS. 58 and 59. As shown in FIG. 59, only a black toner bottle 48K for supplying black toner to a black developing device is illustrated as a typical model of the embodiment, and accordingly, other color toner bottles are not illustrated therein. As described earlier, when the unit supporter 520 is withdrawn to an outside of the body 500A, one or more developing units are exposed from the body 500A. As shown in FIG. 59, a stopper member 902 is provided for stopping rotation of the revolving type developing apparatus 420 when the unit supporter 520 is withdrawn. The structure of such a stopper member 902 is explained below in detail. It is preferable for an operator to maintain both the developing units 420U and the PC drum 414 such that the revolving type developing apparatus 420 is inhibited to rotate at a position where one of four developing devices faces the PC drum 414, for example, so that the operator can remove each of the developing units upwardly or toward the right and left The stopper member 902 is formed as described below. As shown in FIG. 58, one of the stays 523 disposed almost at a center and an upper portion of the unit supporter 520 includes a stopper opening 901*a* at a rear side potion thereof. The rear side plate 55 of the revolving type developing apparatus 420 includes four stopper recesses 55*a* corresponding to each of the developing devices respectively formed on a circumferential circle at an edge portion of the rear side plate 55. Further, a joint member 902 having two connecting portions 902*a* and 902*b* is provided. When the revolving type developing apparatus 520 is inhibited to rotate, the operator inserts each of the connecting portions of the joint member 902 into the stopper opening 901*a* and stopper recesses 55*a* correspondingly. Thus, the revolving type developing apparatus 420 is connected with the stay 523, and is accordingly inhibited for rotating. As a result, maintaining of the above-described units or devices is easily performed.

The above described unit supporter 520 is also inhibited to slide into the body 500A when withdrawn to the outside of the body 500A. Namely, as shown in FIG. 58, the above described joint member 902 further includes a protruding portion 902*c* protruding therefrom which has a predetermined height higher than that of an opening formed on a front side plate of the body 500A which allows insertion of the unit supporter 520, when set. Accordingly, when the joint member 902 is set both in the recess 55*a* and the opening 901*a,* the protruding portion 902*c* protrudes upwardly, and when the unit supporter 520 is to be installed into the body 500A, the protruding portion 902*c* collides with the front side plate 501 of the body 500A. Accordingly, sliding of the unit supporter 520 into the body 500A is inhibited, and thereby maintaining of the units or devices is improved.

Figure 60A:
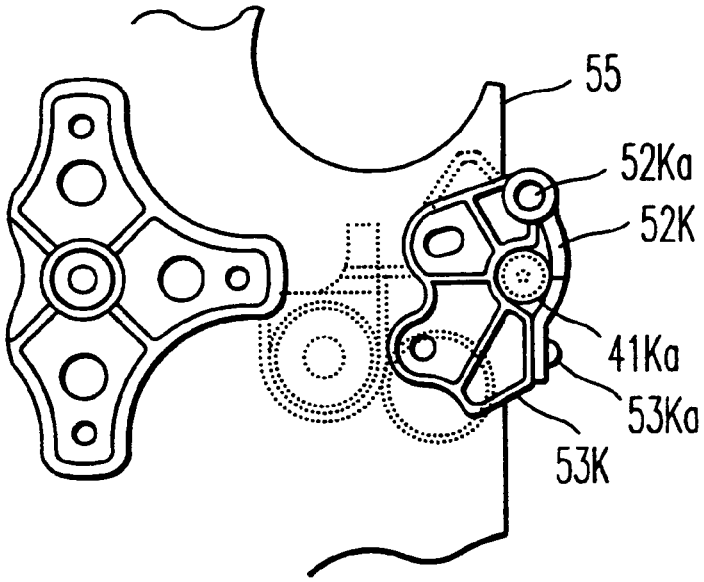
FIGS. 60(*a*) and 60(*b*) are explanatory diagrams for explaining a supporting mechanism for supporting a developing device.
Figure 60B:
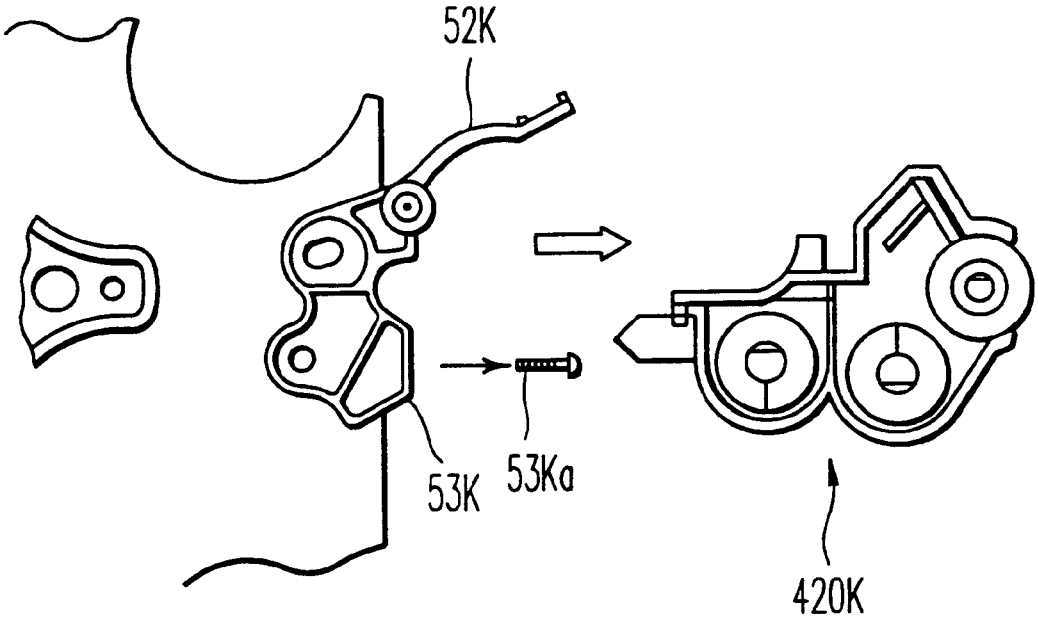

Hereinbelow, a removing mechanism for each of the developing units 420U is explained in detail. As described earlier, both front and rear side plates 54 and 55 respectively have a plurality of developing holders 52K, 52Y, 52M and 52C for each of the developing units 420U. However, since such developing holders mounted on both side plates 54 and 55 have a same shape and structure, only a black developing holder 52K for the black developing device 52 is explained as a typical mode thereof. As shown in FIG. 60, the black developing holder 52K is swingably mounted on a pin 52*ka.*

Such a black developing holder 52K holds a central axis 41*ka* of the black developing roller 41K by sandwiching the same with the side plate 55. Then, one end of the black developing holder 52K not fixed is connected with the side plate by fastening a screw 53*ka,* thereby completing firmly holding of the black developing unit thereon. To the contrary, if removing the black developing unit 420K, the screw 53*ka* is loosened and the black developing holder 52K is swung in a reverse rotational direction, and then the black developing unit 420K is removed in a direction as illustrated by an arrow as shown in FIG. 59.

The above described developing holder 52K may collide with the front side plate 501 of the body 500A when the withdrawal supporting unit 520 is set into the body 500A in a state that the developing holder 52K is opened as shown in FIG. 58, since a height of such a holder in an open state is higher than the insertion opening of the front side plate 501 of the body 500A. However, the above described joint member 902 is used to avoid such a collision therebetween.

In the above described position of the unit supporter 520, the yellow developing unit 420Y shown in FIG. 59 can be removed upwardly from the revolving type developing apparatus 420 only opening the developing holder 52Y. As for the other developing units, the magenta developing unit 420M positioned in a left side of the revolving type developing apparatus 420, for example, and the cyan developing unit 420C positioned at a lower side thereof, for example, are respectively removed therefrom by bending the toner receiving cover 524 to make an outlet therefrom. As for the black developing unit 420K, it is removed therefrom toward a right side direction, for example, after the PC drum unit 414U is removed from the withdrawal supporting unit 520. After maintaining each of the developing units 420U and PC drum unit 414U, each thereof is respectively set to the withdrawal supporting unit 520 in a reversed procedure.

According to the above described embodiment, each of the developing units 420U can be removed at one rotational position of the revolving type developing apparatus 420.

If only one of the developing units 420U is only required to be maintained, such a developing unit is positioned at an upper portion of the revolving type developing apparatus 420, since removing thereof is easiest among another positions. For that purpose, each of the developing units 420U can stop at a predetermined rotational angle so that the unit is positioned at an upper portion thereof.

After all maintenance is completed, the joint member is removed to allow insertion of the unit supporter 520 into the body 500A and rotation of the revolving type developing apparatus 420.

Figure 61:
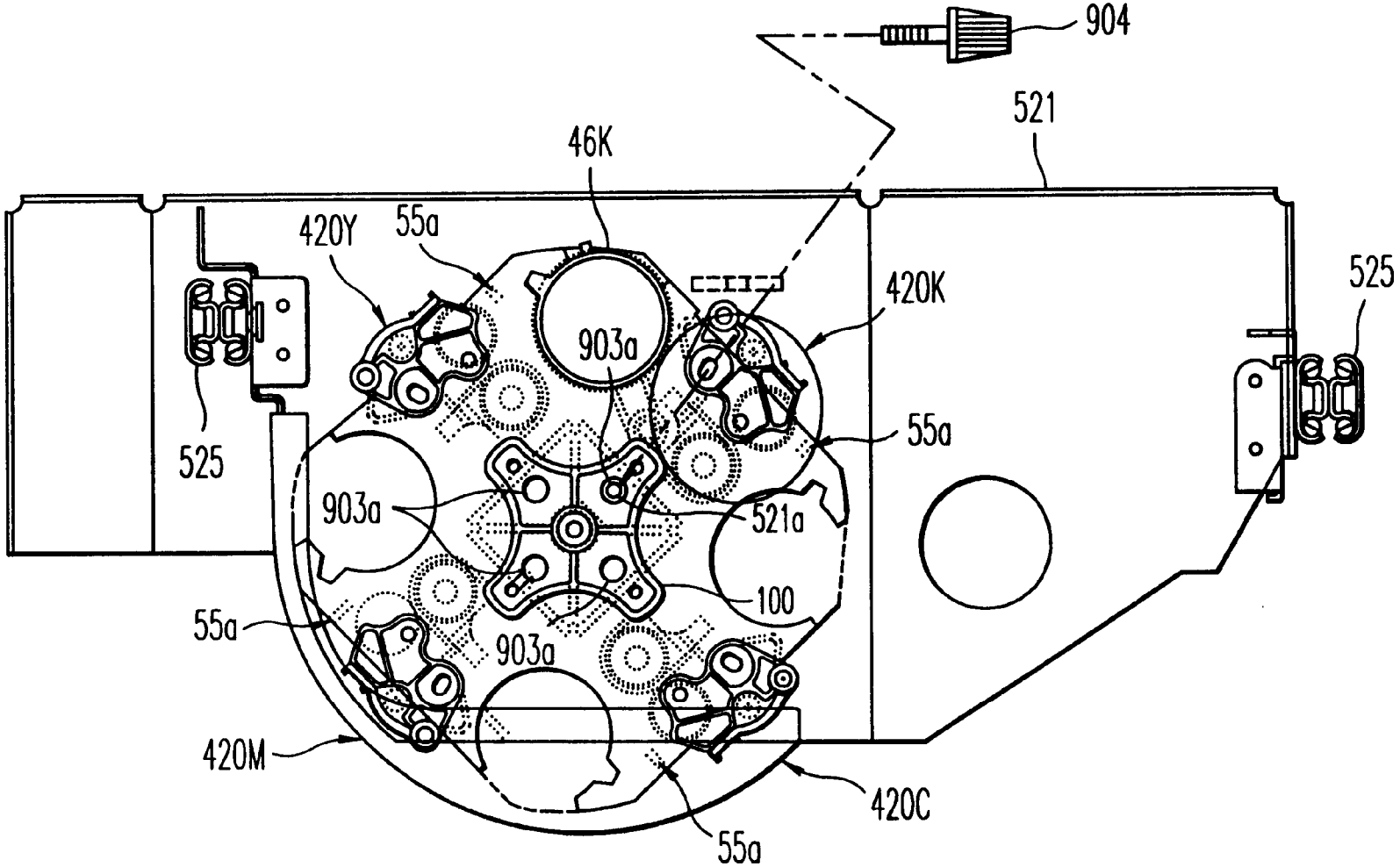
FIG. 61 is an explanatory diagram for explaining a rotation stop of a revolving type developing apparatus in a state that a unit supporter is housed with a slide in an apparatus body.

Hereinbelow, a slightly modified further embodiment is explained. The modified embodiment is explained referring to FIG. 61. The modified embodiment can avoid toner leakage from the developing device during transportation of the image forming apparatus when shipped. A knob 100 is integrally mounted on the revolving type developing apparatus 420 at a portion in front of the front side plate 521 of the unit supporter 520. Four slots 903*a* are formed on a predetermined circumferential circle around the axis thereof at predetermined intervals.

On the other hand, a screw hole 521*a* is formed on the front side plate of the unit supporter 520 in a state that each of the slots 903*a* faces thereof. When the revolving type developing apparatus 420 stops its rotation at a predetermined rotational angle, a screw 904 is fastened into a predetermined screw hole 521*a* so that the knob 100 is fixed to the unit supporter 520. Accordingly, the revolving type developing apparatus 420 is fixed to the unit supporter 520, and thereby rotation thereof is inhibited. Thus, toner leakage from each of the developing devices which may occur when the revolving type developing apparatus 420 is rotated is avoided.

The above described holes 903*a* are enabled to respectively face the screw slot 521*a* and are fastened with the screw 904 screwed through the screw slot 521*a* The above described fastening is executed at a predetermined rotational angle where damage to be caused by vibration thereof is completely avoided. Namely, the revolving type developing apparatus is fixed at a predetermined rotational angle where all of the developing rollers is separated from the developing station and a developing gear (not shown) is separated from the developing driving gear (not shown). Thus, damage for the periphery of the PC drum 414 and teeth of the gear are avoided in addition to avoiding the toner leakage.

The above described knob 100 is also used when the revolving type developing apparatus 420 is rotated to avoid contamination by the toner which may occur when the user rotates the same by his or her hand.

Figure 62A:
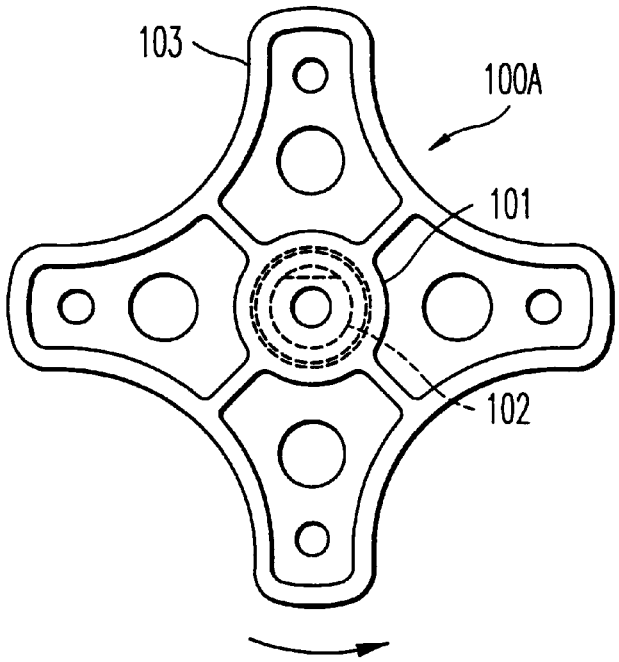
FIGS. 62(*a*) and 62(*b*) are cross sectional views of a knob mounted on a revolving type developing apparatus of the present invention.
Figure 62B:
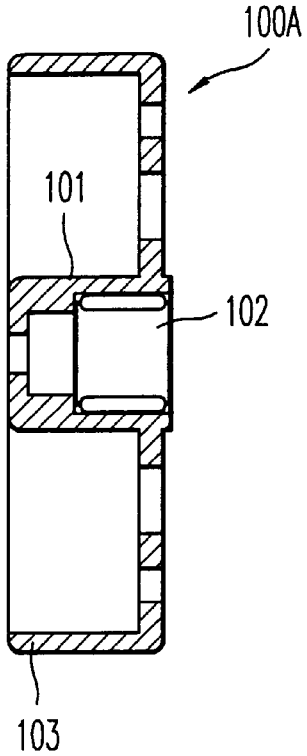
Figure 63:
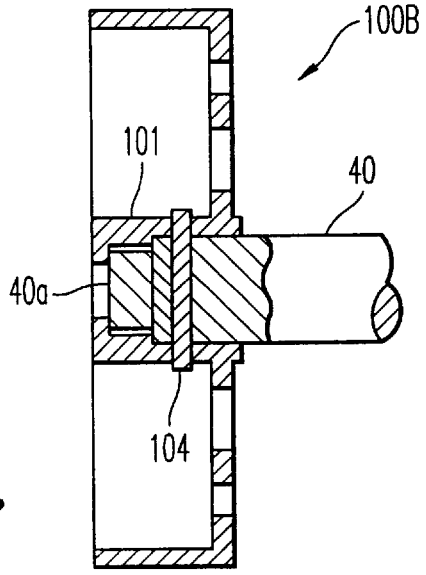
FIG. 63 is a cross sectional view of another knob mounted on a revolving type developing apparatus of the present invention.

Hereinbelow, a modified knob member is explained. As shown in FIGS. 62(*a*) and 62(*b*), the knob 100A includes a setting hole 202 in a boss portion 201 and the leading edge 40*a* of the central axis 240 of the revolving type developing apparatus 420 is inserted into the setting hole 202, thereby firmly connected with each other. Such a knob member 100A is formed in a cross shape like a valve for water service for avoiding a slip of a hand when rotated by the hand The above described knob member 100A can be used as a handle for withdrawing the unit supporter 520. For this purpose, as shown in FIG. 63, a rock pin 204 or the like is mounted on the central axis 240 not to be missing from the boss portion 201.

Figure 64A:
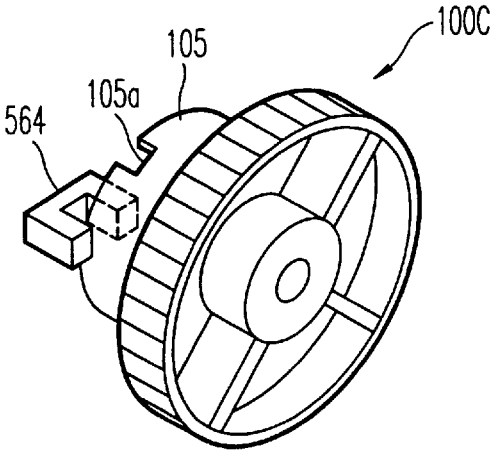
FIGS. 64(*a*), 64(*b*) and 64(*c*) are perspective views showing a plurality of knobs respectively having different home position detecting devices.
Figure 64B:
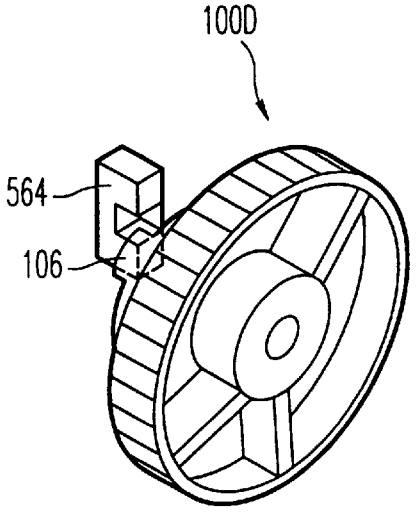
Figure 64C:
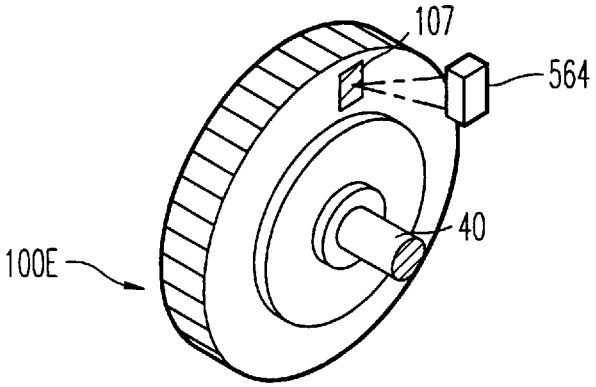

The above described knob member includes a home position reference thereon as shown in FIGS. 64(*a*), 64(*b*) and 64(*c*). One of a plurality of home position sensors 564 can be selectively employed for sensing a home position of the developing units 420U as shown in FIGS. 64(*a*), 64(*b*) and 64(*c*). As a first example as shown in FIGS. 64(*a*), the knob member 100C includes a lip formed in a state of a cylinder and a recess therein. Further, the home position sensor 564 of an optical light beam detecting type sensor is employed to sense the recess disposed corresponding to the home position of the developing units 420U.

As a second example, as shown in FIG. 64(*b*), an optical light beam detecting type sensor is employed to sense an extruding portion of a cylindrical rib 106 mounted on the knob member 100D corresponding to the home position. As a third example, a light reflecting type sensor is employed as shown in FIG. 64(*c*) for sensing a mark put on the knob member 100E corresponding to the home position.

Figure 65:
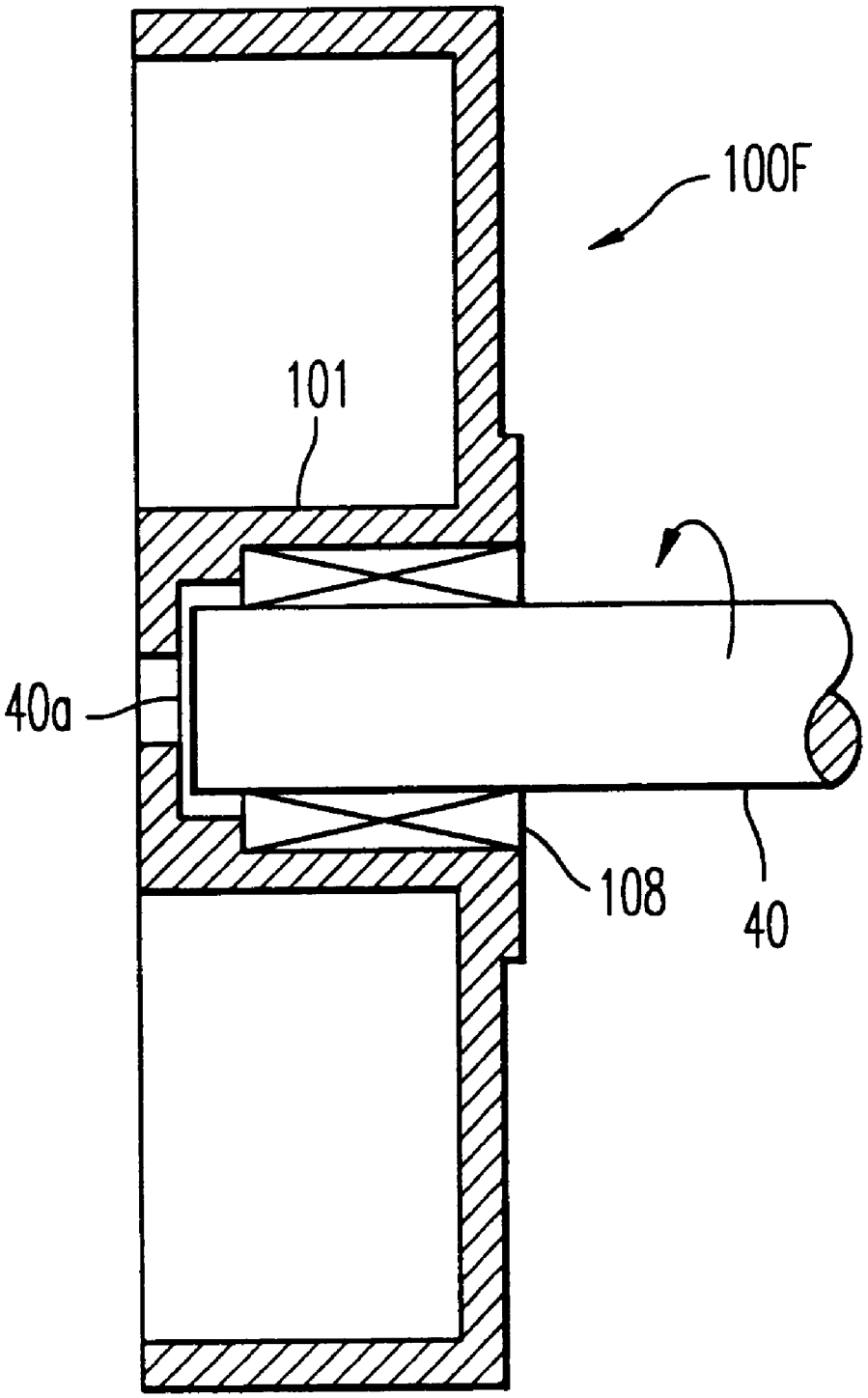
FIG. 65 is a cross-sectional view showing a knob having a one way clutch therein.

Further, as shown in FIG. 65, such a knob member 100F is enabled to only rotate in a same rotation direction as developing units 420U which are rotated when a color developing process is executed. Thereby, a trouble of reverse flowing of the developer or the like in the developing devices can be suppressed.

Hereinbelow, another embodiment of the present invention is explained referring to FIGS. 66 through 68. In the embodiment, each of toner cartridges is enabled to pop out from each of the developing units 420U. Since each of the toner cartridges 46K, 46Y, 46M and 46C has a same popping out mechanism, only a popping out mechanism for a black toner cartridge 46K is explained below as a typical model thereof.

Figure 66:
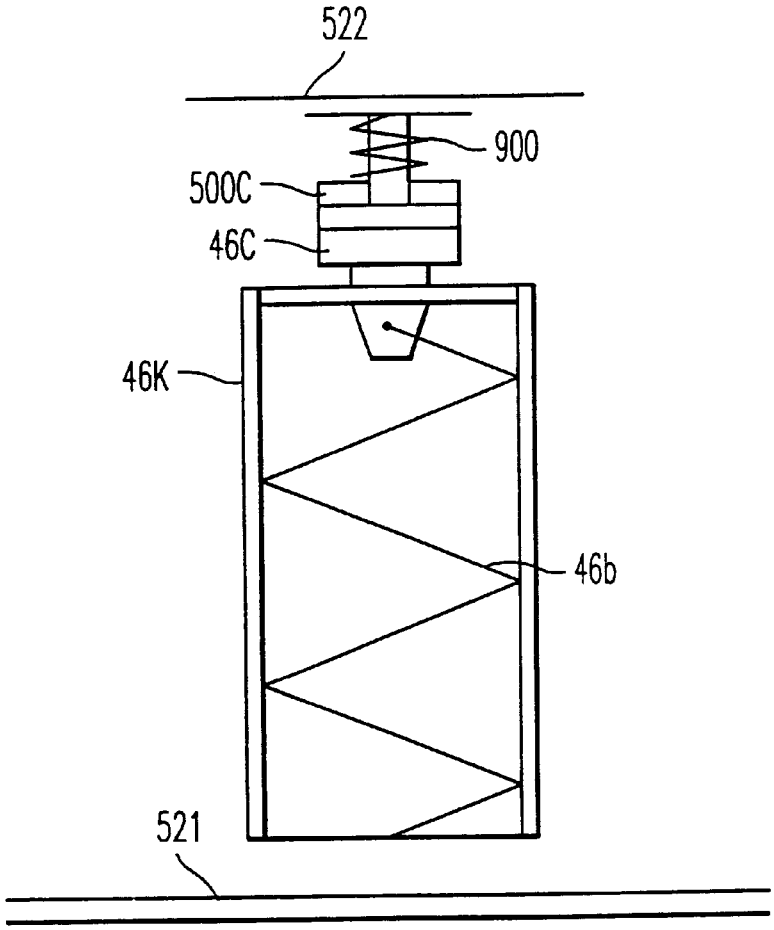
FIG. 66 is a cross-sectional view showing a toner cartridge installed in a unit supporter and contacted by both coupling devices and a compressing spring.

As shown in FIG. 66, both a developing coupling 500*c* which is rotated by a developing device and a toner cartridge coupling 46*c* which contacts the developing coupling 500*c* for transferring a rotational force transmitted by the developing coupling 500*c* toward the toner cartridge 46K are respectively provided on a same axis at a rear side of the toner cartridge 46K. Further, a coupling gear 46*c* and a coupling spring 900 are also provided at a rear side of the developing coupling 500*c* around the axis thereof. One end of the coupling spring 900 is connected with the rear side plate 522 of the unit supporter 520 and another end thereof contacts the developing coupling 500*c*.

Figure 67:
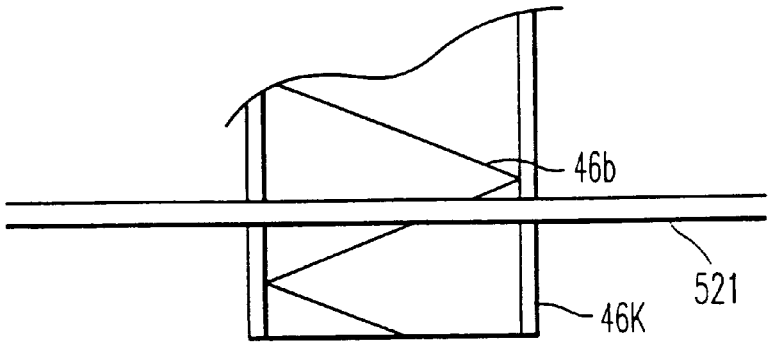
FIG. 67 is a cross-sectional view showing a toner cartridge popped out from a unit supporter.
Figure 68:
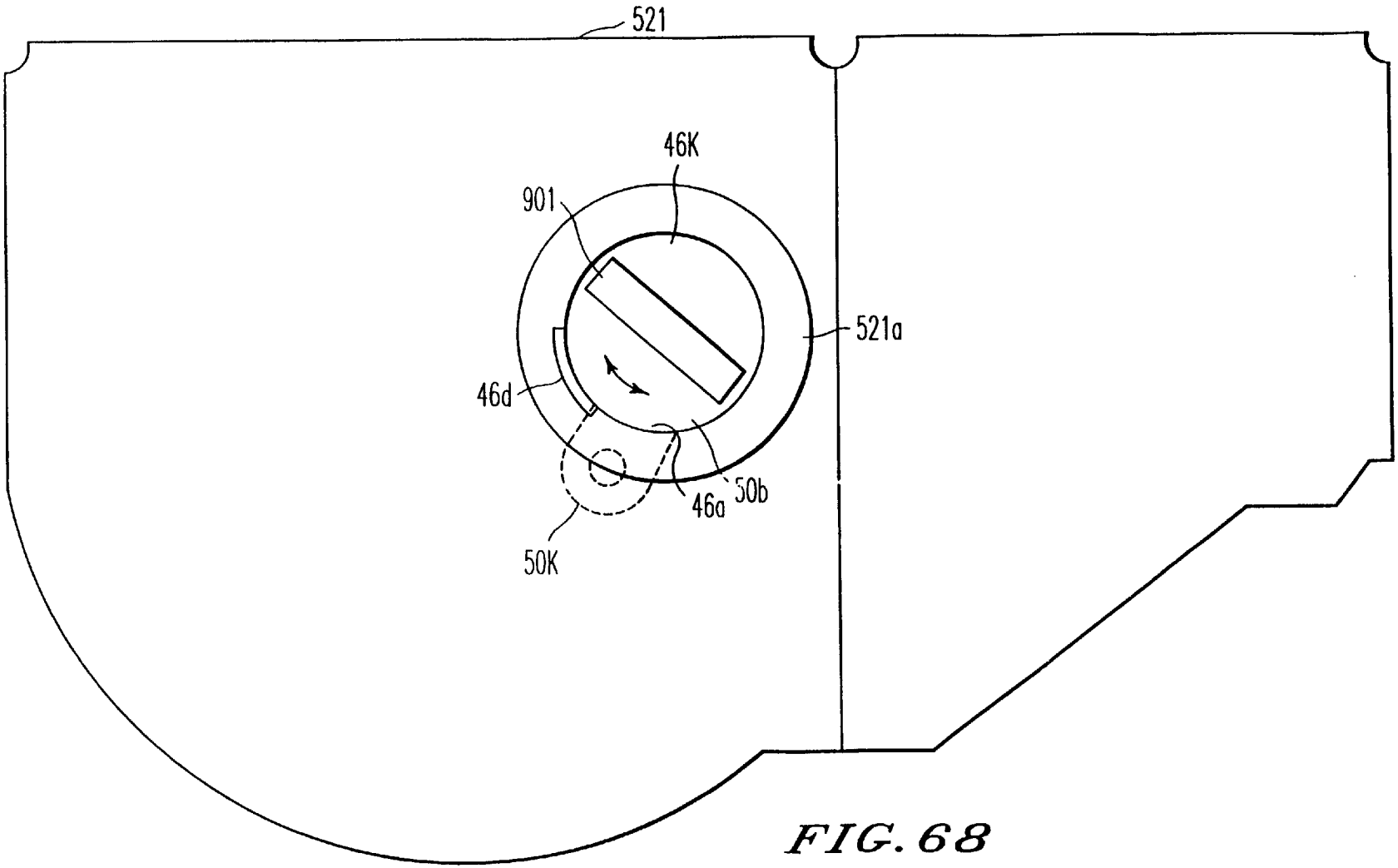
FIG. 68 is a front side view of a developer storing case installing the toner cartridge therein having a handle for rotating the toner cartridge installed.

As shown in FIG. 67, an opening 521*a* is formed on the front side plate 521 through which the toner cartridge 46K is withdrawn when the same positions a predetermined rotational angle. A handle 901 is mounted on a front side wall of the toner cartridge 46K for the cartridge 46K in a predetermined direction.

Further, a cartridge cover 46*d* is firmly mounted on the front side wall of the toner cartridge 46K which is adjacent to a toner supplying inlet 46*a*. A guide rail 51*a* is formed at a position on the toner supplying inlet 50*a* of a toner supplying case 50K where the cartridge cover 46*d* contacts thereto.

When the toner cartridge 46K is to be exchanged, the revolving type developing apparatus is rotated so that the side wall of the toner cartridge 46K appears from the opening 521*a* of the front side plate 521. Then, the toner cartridge 46K is rotated by the user using the handle 901 in a predetermined direction. When the toner cartridge 46K rotates by some rotational angles, as shown in FIG. 37(*b*), the cartridge cover 46*d* contacting the guide rail 51*b* is separated therefrom, thereby enabling to be removed through the opening 521*a*. At the same time, the toner cartridge 46K is popped out by a bias of the coupling spring 900 from the opening 521*a*.

On the other hand, if the toner cartridge 46K is to be set, the same is inserted into one of the developing device through the opening 521*a* and is rotated in a predetermined direction to have the cartridge cover 46*d* engaged with the guide rail 51*a* against the bias of the coupling spring 900. Since the toner cartridge is extruded through the opening 521*a* when not precisely set into the developing device, a setting condition thereof is easily confirmed by the user. The coupling spring 900 can contact the rear side plate 522 and is connected with the toner cartridge 46K so that both the coupling spring 900 and the toner cartridge 46K are popped out in a body therefrom.

Further, a key member can be employed for allowing popping out of the toner cartridge when the toner cartridge faces the opening 521*a* and after that the key is depressed.

Obviously, numerous additional modifications and variations of the present invention are possible in light of the above teachings. It is therefore to be understood that within the scope of the appended claims, the present invention may be practiced otherwise than as specifically described herein.

The present application is based on Japanese priority documents JPA09-208704, JPA09-165392, JPA09-208705, JPA09-208706, JPA09-208688, and JPA10-108800, the contents of which are incorporated herein by reference.

What is claimed is:

1. An image forming apparatus, comprising:

a latent image carrier on which an image is to be formed;

a revolving type developing apparatus, including a plurality of developing units having developing devices around a rotary shaft, which develops a latent image formed on said latent image carrier by said developing devices, and a pulled-out supporter to be pulled out of an image forming apparatus body for removably mounting both of said latent image carrier and said revolving type developing apparatus thereon with a predetermined interval between and latent image carrier and said revolving type developing apparatus.

2. An image forming apparatus as claimed in claim 1, further comprising:

a front side plate and a rear side plate disposed on said pulled-out supporter cooperatively supporting said at least one of said latent image carrier and said revolving type developing apparatus in a state that a rotary central axis of said latent image carrier is placed in parallel with a rotary central axis of said revolving type developing apparatus at said predetermined interval; and a stay member which integrates said front side plate with said rear side plate.

3. An image forming apparatus as claimed in claim 2, further comprising:

an apparatus body side supporting member which includes a supporting axis; and wherein said pulled-out supporter is positioned by said apparatus body side supporting member when said pulled-out supporter penetrates a hole when said pulled-out supporter is housed in said image forming apparatus body.

4. An image forming apparatus as claimed in claim 2, further comprising:

a pair of slide rails each including a fixed rail fixed to said image forming apparatus body and a movable rail for holding said pulled-out supporter thereon.

5. An image forming apparatus as claimed in claim 4, wherein said pulled-out supporter is removable upwardly from said movable rail of said slide rail when pulled out of said image forming apparatus body.

6. An image forming apparatus as claimed in claim 5, further comprising:

a projecting member mounted on the movable rail of said slide rail and extruding into a side of said pulled-out supporter to be upwardly removable; and a cutout portion formed on said stay member of said pulled-out supporter for engaging with said projecting portion and upwardly separating therefrom.

7. An image forming apparatus as claimed in claim 2, further comprising:

a developing device holder disposed for each developing unit of said revolving type developing apparatus and which holds respective developing devices of each developing unit so that said respective developing units are respectively separated at least upwardly from said pulled-out supporter.

8. An image forming apparatus as claimed in claim 2, wherein said latent image carrier is removed upwardly from said pulled-out supporter by dismounting said latent image carrier from said rotary shaft by pulling out said pulled-out supporter from said image is forming apparatus body.

* * * * *